US011771180B2

(12) United States Patent
Bock et al.

(10) Patent No.: US 11,771,180 B2
(45) Date of Patent: Oct. 3, 2023

(54) ARTICLE OF FOOTWEAR HAVING AN AUTOMATIC LACING SYSTEM

(71) Applicant: PUMA SE, Herzogenaurach (DE)

(72) Inventors: Markus Bock, Herzogenaurach (DE); Randolph Maussner, Spalt (DE)

(73) Assignee: PUMA SE, Herzogenaurach (DE)

( * ) Notice: Subject to any disclaimer, the term of this patent is extended or adjusted under 35 U.S.C. 154(b) by 21 days.

(21) Appl. No.: 17/346,450

(22) Filed: Jun. 14, 2021

(65) Prior Publication Data

US 2021/0298428 A1 Sep. 30, 2021

Related U.S. Application Data

(63) Continuation of application No. 16/392,470, filed on Apr. 23, 2019, now Pat. No. 11,033,079, which is a (Continued)

(51) Int. Cl.

| | |
|---|---|
| ***A43B 3/36*** | (2022.01) |
| ***A43C 1/00*** | (2006.01) |
| ***A43C 11/20*** | (2006.01) |
| ***A43C 11/16*** | (2006.01) |
| ***A43B 3/34*** | (2022.01) |

(52) U.S. Cl.

CPC ..... *A43C 11/165* (2013.01); *A43B 3/34* (2022.01); *A43B 3/36* (2022.01); *A43C 1/00* (2013.01); *A43C 1/003* (2013.01); *A43C 11/20* (2013.01)

(58) Field of Classification Search

CPC .... A43B 3/34; A43B 3/36; A43B 3/40; A43B 3/44; A43C 1/00; A43C 1/003; A43C 1/04; A43C 11/165; A43C 11/20

See application file for complete search history.

(56) References Cited

U.S. PATENT DOCUMENTS

| | | |
|---|---|---|
| 4,442,613 A | 4/1984 | Dobbin |
| 4,724,626 A | 2/1988 | Baggio |

(Continued)

FOREIGN PATENT DOCUMENTS

| | | |
|---|---|---|
| CA | 2500150 A1 | 9/2006 |
| CN | 2540805 Y | 3/2003 |

(Continued)

OTHER PUBLICATIONS

Japanese Office Action from corresponding Japanese Patent Application No. 2019-525884, dated Aug. 25, 2020 (English translation included) (8 pages).

(Continued)

*Primary Examiner* — Sharon M Prange

(74) *Attorney, Agent, or Firm* — Quarles & Brady LLP

(57) ABSTRACT

A lacing system for an article of footwear has a forefoot region, a midfoot region, and a heel region. The system includes a sole structure, an upper attached to the sole structure, the upper having a lateral side, a medial side, and a tongue, a housing that is disposed along the tongue and entirely within the midfoot region, and an electronics assembly enclosed entirely within the housing. The electronics assembly includes at least a motor and a gear assembly. A first lace extends from the housing through a first aperture and a second aperture, and the first lace is drawn into the housing when the motor is activated by a user.

20 Claims, 33 Drawing Sheets

Related U.S. Application Data continuation-in-part of application No. 15/766,199, filed as application No. PCT/EP2015/001963 on Oct. 7, 2015, now Pat. No. 10,349,703, said application No. 16/392,470 is a continuation-in-part of application No. PCT/EP2016/001967, filed on Nov. 22, 2016, and a continuation-in-part of application No. PCT/EP2016/001968, filed on Nov. 22, 2016.

(56) References Cited

U.S. PATENT DOCUMENTS

| | | | |
|---|---|---|---|
| 4,741,115 | A | 5/1988 | Pozzobon |
| 4,748,726 | A | 6/1988 | Schoch |
| 4,787,124 | A | 11/1988 | Pozzobon et al. |
| 4,922,634 | A | 5/1990 | Seidel |
| 4,961,544 | A | 10/1990 | Bidoia |
| 5,051,095 | A | 9/1991 | Slenker |
| 5,206,804 | A | 4/1993 | Thies et al. |
| 5,325,613 | A | 7/1994 | Sussmann |
| 5,724,265 | A | 3/1998 | Hutchings |
| 5,839,210 | A | 11/1998 | Bernier et al. |
| 5,955,667 | A | 9/1999 | Fyfe |
| 5,983,530 | A | 11/1999 | Chou |
| 6,018,705 | A | 1/2000 | Gaudet et al. |
| 6,032,387 | A | 3/2000 | Johnson |
| 6,052,654 | A | 4/2000 | Gaudet et al. |
| 6,202,953 | B1 | 3/2001 | Hammerslag |
| 6,289,558 | B1 | 9/2001 | Hammerslag |
| 6,427,361 | B1 | 8/2002 | Chou |
| 6,430,843 | B1 | 8/2002 | Potter et al. |
| 6,691,433 | B2 | 2/2004 | Liu |
| 6,865,825 | B2 | 3/2005 | Bailey, Sr. et al. |
| 6,876,947 | B1 | 4/2005 | Darley et al. |
| 6,882,955 | B1 | 4/2005 | Ohlenbusch et al. |
| 6,892,477 | B2 | 5/2005 | Potter et al. |
| 6,978,684 | B2 | 12/2005 | Nurse |
| 7,082,701 | B2 | 8/2006 | Dalgaard et al. |
| 7,096,559 | B2 | 8/2006 | Johnson |
| 7,188,439 | B2 | 3/2007 | DiBenedetto et al. |
| 7,310,895 | B2 | 12/2007 | Whittlesey et al. |
| 7,503,131 | B2 | 3/2009 | Nadel et al. |
| 7,607,243 | B2 | 10/2009 | Berner, Jr. et al. |
| 7,721,468 | B1 | 5/2010 | Johnson et al. |
| 7,752,774 | B2 | 7/2010 | Ussher |
| 7,794,101 | B2 | 9/2010 | Galica et al. |
| D648,110 | S | 11/2011 | Rasmussen |
| 8,046,937 | B2 | 11/2011 | Beers et al. |
| 8,056,269 | B2 | 11/2011 | Beers et al. |
| 8,058,837 | B2 | 11/2011 | Beers et al. |
| 8,061,061 | B1 | 11/2011 | Rivas |
| 8,074,379 | B2 | 12/2011 | Robinson, Jr. et al. |
| 8,277,401 | B2 | 10/2012 | Hammerslag et al. |
| 8,387,282 | B2 | 3/2013 | Baker et al. |
| 8,424,168 | B2 | 4/2013 | Soderberg et al. |
| 8,468,657 | B2 | 6/2013 | Soderberg et al. |
| 8,474,146 | B2 | 7/2013 | Hartford et al. |
| 8,516,662 | B2 | 8/2013 | Goodman et al. |
| D689,684 | S | 9/2013 | McMillan |
| 8,522,456 | B2 | 9/2013 | Beers et al. |
| 8,528,235 | B2 | 9/2013 | Beers et al. |
| 8,676,541 | B2 | 3/2014 | Schrock et al. |
| 8,678,541 | B2 | 3/2014 | Uchiyama |
| 8,713,820 | B2 | 5/2014 | Kerns et al. |
| 8,739,639 | B2 | 6/2014 | Owings et al. |
| 8,769,844 | B2 | 7/2014 | Beers et al. |
| D718,036 | S | 11/2014 | McMillan |
| 8,904,672 | B1 | 12/2014 | Johnson |
| 8,904,673 | B2 | 12/2014 | Johnson et al. |
| 8,935,860 | B2 | 1/2015 | Torres |
| 9,072,341 | B2 | 7/2015 | Jungkind |
| D740,538 | S | 10/2015 | Roulo |
| 9,149,089 | B2 | 10/2015 | Cotterman et al. |
| 9,204,690 | B1 * | 12/2015 | Alt ..... A43B 3/34 |
| D746,558 | S | 1/2016 | Campbell et al. |
| 9,241,539 | B1 | 1/2016 | Keswin |
| 9,248,040 | B2 | 2/2016 | Soderberg et al. |
| D750,879 | S | 3/2016 | Klein et al. |
| 9,301,573 | B2 | 4/2016 | Jasmine |
| 9,307,804 | B2 | 4/2016 | Beers et al. |
| D756,621 | S | 5/2016 | Weddle |
| 9,326,566 | B2 | 5/2016 | Beers et al. |
| 9,365,387 | B2 | 6/2016 | Beers et al. |
| 9,380,834 | B2 | 7/2016 | Rushbrook et al. |
| D768,977 | S | 10/2016 | Seamarks et al. |
| 9,462,844 | B2 | 10/2016 | Schrock et al. |
| 9,532,893 | B2 | 1/2017 | Beers et al. |
| 9,578,926 | B2 | 2/2017 | Alt et al. |
| 9,609,918 | B2 | 4/2017 | Beers |
| 9,610,185 | B2 | 4/2017 | Capra et al. |
| 9,629,418 | B2 | 4/2017 | Rushbrook et al. |
| 9,693,605 | B2 | 7/2017 | Beers |
| 9,706,814 | B2 | 7/2017 | Converse et al. |
| 9,756,895 | B2 | 9/2017 | Rice et al. |
| 9,763,489 | B2 | 9/2017 | Amos et al. |
| 9,848,674 | B2 | 12/2017 | Smith et al. |
| 9,861,164 | B2 | 1/2018 | Beers et al. |
| 9,861,165 | B2 | 1/2018 | Schneider et al. |
| 9,867,417 | B2 | 1/2018 | Beers et al. |
| 9,872,539 | B2 | 1/2018 | Beers |
| 9,907,359 | B2 | 3/2018 | Beers |
| 9,918,516 | B1 | 3/2018 | Hall |
| 9,918,865 | B2 | 3/2018 | Nickel et al. |
| D814,776 | S | 4/2018 | Odinot |
| D815,413 | S | 4/2018 | Weddle |
| 9,943,139 | B2 | 4/2018 | Beers et al. |
| 9,961,963 | B2 | 5/2018 | Schneider et al. |
| 9,993,046 | B2 | 6/2018 | Bock |
| 10,004,295 | B2 | 6/2018 | Gerber |
| 10,010,129 | B2 | 7/2018 | Beers et al. |
| 10,034,512 | B2 | 7/2018 | Rushbrook et al. |
| 10,046,942 | B2 | 8/2018 | Beers et al. |
| 10,070,681 | B2 | 9/2018 | Beers et al. |
| 10,070,683 | B2 | 9/2018 | Rushbrook et al. |
| 10,076,462 | B2 | 9/2018 | Johnson et al. |
| D829,425 | S | 10/2018 | Albrecht et al. |
| 10,085,517 | B2 | 10/2018 | Beers et al. |
| 10,092,065 | B2 | 10/2018 | Rushbrook et al. |
| 10,102,722 | B2 | 10/2018 | Levesque et al. |
| 10,104,937 | B2 | 10/2018 | Beers et al. |
| 10,111,496 | B2 | 10/2018 | Schneider et al. |
| 10,201,212 | B2 | 2/2019 | Beers et al. |
| 10,231,505 | B2 | 3/2019 | Beers et al. |
| 10,238,180 | B2 | 3/2019 | Beers et al. |
| 10,441,020 | B1 | 10/2019 | Andon et al. |
| 11,000,099 | B2 | 5/2021 | Beers et al. |
| 11,044,968 | B2 | 6/2021 | Beers |
| 2003/0009913 | A1 | 1/2003 | Potter et al. |
| 2003/0150135 | A1 | 8/2003 | Liu |
| 2004/0177531 | A1 | 9/2004 | DiBenedetto et al. |
| 2005/0081403 | A1 | 4/2005 | Mathieu |
| 2005/0183292 | A1 | 8/2005 | DiBenedetto et al. |
| 2005/0198867 | A1 | 9/2005 | Labbe |
| 2006/0000116 | A1 | 1/2006 | Brewer |
| 2006/0103538 | A1 | 5/2006 | Daniel |
| 2007/0000154 | A1 | 1/2007 | DiBenedetto et al. |
| 2007/0006489 | A1 | 1/2007 | Case et al. |
| 2007/0129907 | A1 | 6/2007 | Demon |
| 2007/0164521 | A1 | 7/2007 | Robinson |
| 2007/0260421 | A1 | 11/2007 | Berner et al. |
| 2007/0271817 | A1 | 11/2007 | Ellis |
| 2008/0066272 | A1 | 3/2008 | Hammerslag et al. |
| 2008/0196224 | A1 | 8/2008 | Hu |
| 2008/0301919 | A1 | 12/2008 | Ussher |
| 2009/0184189 | A1 | 7/2009 | Soderberg et al. |
| 2009/0193689 | A1 | 8/2009 | Galica et al. |
| 2009/0272007 | A1 | 11/2009 | Beers et al. |
| 2009/0272013 | A1 | 11/2009 | Beers et al. |
| 2010/0063778 | A1 | 3/2010 | Schrock et al. |
| 2010/0063779 | A1 | 3/2010 | Schrock et al. |
| 2010/0139057 | A1 | 6/2010 | Soderberg et al. |
| 2010/0289971 | A1 | 11/2010 | Odland et al. |
| 2011/0025704 | A1 | 2/2011 | Odland et al. |
| 2011/0175744 | A1 | 7/2011 | Englert et al. |
| 2011/0225843 | A1 | 9/2011 | Kerns et al. |

(56) References Cited

U.S. PATENT DOCUMENTS

2011/0232134 A1 9/2011 Radl et al.
2011/0266384 A1 11/2011 Goodman et al.
2012/0000091 A1 1/2012 Cotterman et al.
2012/0004587 A1 1/2012 Nickel et al.
2012/0067665 A1 3/2012 Chae et al.
2012/0124500 A1 5/2012 Hunter
2012/0185801 A1 7/2012 Madonna et al.
2013/0092780 A1 4/2013 Soderberg et al.
2013/0104429 A1* 5/2013 Torres ..... A43C 1/003 36/136
2013/0213147 A1 8/2013 Rice et al.
2013/0312293 A1 11/2013 Gerber
2014/0068838 A1 3/2014 Beers et al.
2014/0070042 A1 3/2014 Beers et al.
2014/0082963 A1 3/2014 Beers
2014/0257156 A1 9/2014 Capra et al.
2014/0292396 A1* 10/2014 Bruwer ..... H03K 17/962 327/517
2015/0007422 A1 1/2015 Cavanagh et al.
2015/0185764 A1 7/2015 Magi
2015/0250268 A1* 9/2015 Alt ..... A43C 11/165 24/68 SK
2015/0289594 A1* 10/2015 Rushbrook ..... A43B 17/00 12/142 T
2015/0312660 A1 10/2015 Lembacher et al.
2016/0027297 A1 1/2016 Wu et al.
2016/0157561 A1 6/2016 Schum et al.
2016/0256349 A1 9/2016 Mayer et al.
2016/0262485 A1 9/2016 Walker
2016/0345654 A1* 12/2016 Beers ..... A43B 3/34
2016/0345679 A1 12/2016 Beers et al.
2016/0345681 A1* 12/2016 Pheil ..... A43C 11/165
2016/0360828 A1 12/2016 Guyan
2017/0035151 A1* 2/2017 Peyton ..... A43B 3/26
2017/0150773 A1 6/2017 Beers
2017/0215524 A1 8/2017 Rushbrook et al.
2017/0265559 A1* 9/2017 Beers ..... A43B 5/02
2017/0265572 A1 9/2017 Beers et al.
2017/0265573 A1 9/2017 Beers
2017/0265574 A1 9/2017 Beers et al.
2017/0265575 A1 9/2017 Beers et al.
2017/0265576 A1 9/2017 Beers et al.
2017/0265577 A1 9/2017 Schneider
2017/0265578 A1 9/2017 Schneider
2017/0265579 A1 9/2017 Schneider et al.
2017/0265580 A1 9/2017 Schneider et al.
2017/0265581 A1 9/2017 Chang
2017/0265582 A1 9/2017 Walker et al.
2017/0265583 A1 9/2017 Schneider et al.
2017/0265584 A1 9/2017 Walker et al.
2017/0265585 A1 9/2017 Orand
2017/0265586 A1 9/2017 Schneider et al.
2017/0265587 A1 9/2017 Walker et al.
2017/0265588 A1 9/2017 Walker et al.
2017/0265589 A1 9/2017 Walker et al.
2017/0265591 A1 9/2017 Schneider
2017/0265594 A1 9/2017 Walker et al.
2017/0267485 A1 9/2017 Schneider et al.
2017/0272008 A1* 9/2017 Schneider ..... A43C 11/165
2017/0295889 A1 10/2017 Beers
2017/0303643 A1 10/2017 Converse et al.
2017/0312161 A1 11/2017 Johnson et al.
2017/0318908 A1 11/2017 Wyatt et al.
2017/0332734 A1 11/2017 Orand
2017/0332735 A1 11/2017 Orand et al.
2017/0340049 A1 11/2017 Rice et al.
2018/0020764 A1 1/2018 Walker
2018/0035760 A1* 2/2018 Bock ..... A43C 11/20
2018/0110288 A1 4/2018 Hatfield et al.
2018/0110294 A1 4/2018 Schneider et al.
2018/0110298 A1 4/2018 Schneider et al.
2018/0116326 A1 5/2018 Beers et al.
2018/0125168 A1* 5/2018 Beers ..... A43C 11/165
2018/0153260 A1 6/2018 Beers
2018/0153263 A1* 6/2018 Beers ..... A43C 7/08
2018/0199674 A1 7/2018 Walker et al.
2018/0219403 A1 8/2018 Schneider
2018/0228250 A1 8/2018 Beers et al.
2018/0263340 A1 9/2018 Schneider et al.
2018/0289110 A1 10/2018 Bock et al.
2018/0310644 A1 11/2018 Poupyrev et al.
2018/0310659 A1 11/2018 Poupyrev et al.
2018/0310670 A1 11/2018 Rovekamp, Jr. et al.
2018/0317609 A1 11/2018 Beers et al.
2018/0343977 A1 12/2018 Riccomini et al.
2018/0343978 A1 12/2018 Stillman et al.
2018/0368526 A1 12/2018 Bock et al.
2018/0368528 A1 12/2018 Beers et al.
2019/0246745 A1 8/2019 Bock et al.
2019/0246746 A1 8/2019 Bock et al.
2019/0246747 A1 8/2019 Bock et al.
2019/0328085 A1* 10/2019 Bock ..... A43B 3/34
2021/0162120 A1 6/2021 Prudden et al.
2021/0235819 A1 8/2021 Andreasen
2021/0383784 A1 12/2021 Leatherdale et al.

FOREIGN PATENT DOCUMENTS

CN 201222723 Y 4/2009
CN 102058197 A 5/2011
CN 202907266 U 4/2013
CN 104585975 A 5/2015
CN 104822284 A 8/2015
CN 105278768 A 1/2016
DE 29701491 U1 5/1998
DE 29817003 U1 3/1999
DE 19833801 A1 2/2000
DE 102005014709 A1 10/2006
DE 102005036013 A1 2/2007
DE 102005052903 A1 5/2007
EP 0614624 A1 9/1994
EP 2871994 A1 5/2015
EP 3046434 A1 7/2016
FR 2770379 A1 5/1999
FR 2924577 A1 6/2009
GB 2449722 A 12/2008
JP 3005659 U 1/1995
JP 3195320 B2 8/2001
JP 2004267784 A 9/2004
JP 2004275201 A 10/2004
JP 2009011460 A 1/2009
JP 2011519611 A 7/2011
JP 5486203 B2 5/2014
JP 2016530058 A 9/2016
JP 2018529479 A 10/2018
KR 100398822 B1 9/2003
KR 20050122149 A 12/2005
WO 9811797 A1 3/1998
WO 2007081822 A2 7/2007
WO 2008033963 A2 3/2008
WO 2009134858 A1 11/2009
WO 2012109244 A1 8/2012
WO 2014036374 A1 3/2014
WO 2014082652 A1 6/2014
WO 2015014374 A1 2/2015
WO 2015042216 A1 3/2015
WO 2015045598 A1 4/2015
WO 2015056633 A1 4/2015
WO 2015160406 A1 10/2015
WO 2015160768 A1 10/2015
WO 2015160790 A1 10/2015
WO 2015163982 A1 10/2015
WO 2016057697 A1 4/2016
WO 2016191115 A1 12/2016
WO 2016191117 A1 12/2016
WO 2016191123 A1 12/2016
WO 2016195957 A1 12/2016
WO 2016195965 A1 12/2016
WO 2017059876 A1 4/2017
WO 2017091769 A8 6/2017
WO 2017092775 A1 6/2017
WO 2017095945 A1 6/2017
WO 2017158410 A1 9/2017
WO 2017160534 A2 9/2017

(56) References Cited

FOREIGN PATENT DOCUMENTS

| | | | | |
|---|---|---|---|---|
| WO | 2017160536 | A2 | | 9/2017 |
| WO | 2017160558 | A2 | | 9/2017 |
| WO | 2017160561 | A2 | | 9/2017 |
| WO | 2017160563 | A2 | | 9/2017 |
| WO | 2017160657 | A2 | | 9/2017 |
| WO | 2017160708 | A2 | | 9/2017 |
| WO | 2017160865 | A1 | | 9/2017 |
| WO | 2017160866 | A1 | | 9/2017 |
| WO | 2017160881 | A1 | | 9/2017 |
| WO | 2017160969 | A1 | | 9/2017 |
| WO | 2017161000 | A2 | | 9/2017 |
| WO | 2017161014 | A1 | | 9/2017 |
| WO | 2017161037 | A1 | | 9/2017 |
| WO | 2017161044 | A1 | | 9/2017 |
| WO | 2017164612 | A1 | | 9/2017 |
| WO | 2017185160 | A1 | | 11/2017 |
| WO | 2017189926 | A1 | | 11/2017 |
| WO | 2017197627 | A1 | | 11/2017 |
| WO | WO-2017185160 | A1 | * | 11/2017 |
| WO | 2017091769 | A8 | | 1/2018 |
| WO | 2018028380 | A1 | | 2/2018 |
| WO | 2018028381 | A1 | | 2/2018 |
| WO | 2018081260 | A1 | | 5/2018 |
| WO | 2018094156 | A1 | | 5/2018 |
| WO | 2018095500 | A1 | | 5/2018 |
| WO | 2018095501 | A1 | | 5/2018 |
| WO | 2018095507 | A1 | | 5/2018 |
| WO | 2018120085 | A1 | | 7/2018 |
| WO | 2017161000 | A3 | | 8/2018 |
| WO | 2018170148 | A2 | | 9/2018 |
| WO | 2018170148 | A3 | | 11/2018 |
| WO | 2018222805 | A2 | | 12/2018 |
| WO | 2018222807 | A2 | | 12/2018 |
| WO | 2018222836 | A2 | | 12/2018 |

OTHER PUBLICATIONS

The First Office Action issued in corresponding Chinese Application No. 201580084987.2, dated May 6, 2020, 25 pages.
Notice of Reasons for Refusal issued in Japanese Application No. 2018-524270, dated Dec. 3, 2019, 9 pages.
Search Report by Registered Search Organization issued in Japanese Application No. 2018-524270, dated Nov. 27, 2019, 128 pages.
International Search Report and Written Opinion of International Application No. PCT/IB2020/053777, dated Jun. 18, 2020, 12 pages.
International Search Report and Written Opinion of International Application No. PCT/IB2020/053778, dated Jun. 18, 2020, 14 pages.
The First Office Action issued in corresponding Chinese Application No. 201680091000.4, dated Jun. 5, 2020, 19 pages.
Extended European Search Report of European Patent Application 20721799.3 dated Aug. 4, 2022 (8 pages).
Liszewski, Andrew "A Self-Adjusting Smart Belt: Yes, It's Come to This" Jan. 4, 2015, XP055386586 Retrieved from the Internet: URL: https://gizmodo.com/the-only-gadget-1677432880 [retrieved on May 13, 2019].
International search report issued in corresponding International Application No. PCT/EP2015/001963, dated Aug. 9, 2016, 5 pages.
International search report issued in corresponding International Application No. PCT/EP2016/001967, dated Jul. 26, 2017, 7 pages.
International search report issued in corresponding International Application No. PCT/EP2016/001968, dated Jul. 31, 2017, 6 pages.
Invitation to Pay Additional Fees and Communication Relating to Results of Partial International Search Report from corresponding PCT Application No. PCT/IB2020/058424 dated Dec. 8, 2020 (12 pages).
First Office Action from corresponding Chinese Patent Application No. 201680091016.5, dated Oct. 22, 2020 (15 pages).
Written Opinion of International Application No. PCT/EP2016/001968, dated Jul. 31, 2017, 6 pages.
International Preliminary Report on Patentability (Form IPEA/409) of International Application No. PCT/EP2016/001968, dated Jan. 9, 2019, 31 pages.
Written Opinion of International Application No. PCT/EP2016/001967, dated Jul. 26, 2017, 6 pages.
International Preliminary Report on Patentability (Form IPEA/409) of International Application No. PCT/EP2016/001967, dated Jan. 4, 2019, 23 pages.
International Search Report and Written Opinion of International Application No. PCT/IB2022/060994, dated Feb. 7, 2023 (15 pages).
Office Action from corresponding Japanese Application No. 2021-562055 dated Mar. 26, 2023 (9 pages) with English translation.
Preliminary Rejection in Korean Patent Application No. 10-2021-7036585, dated Jul. 11, 2023 (14 pages).
Preliminary Rejection in Korean Patent Application No. 10-2021-7036605, dated Jul. 11, 2023 (13 pages).
Preliminary Rejection in Korean Patent Application No. 10-2021-7036607, dated Jul. 11, 2023 (13 pages).

* cited by examiner

ARTICLE OF FOOTWEAR HAVING AN AUTOMATIC LACING SYSTEM

CROSS REFERENCE TO RELATED APPLICATIONS

This application is a continuation of U.S. application Ser. No. 16/392,470, filed on Apr. 23, 2019, which is a continuation-in-part of U.S. application Ser. No. 15/766,199 filed Apr. 5, 2018, which is a 371 of W.O. Application Serial Number PCT/EP2015/001963, filed on Oct. 7, 2015, and is further a continuation-in-part of W.O. Application Serial Number PCT/EP2016/001967, filed on Nov. 22, 2016, and a continuation-in-part of W.O. Application Serial Number PCT/EP2016/001968, filed on Nov. 22, 2016, which are each incorporated by reference herein in their entirety and are to be considered a part of this application.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including an automatic lacing system that includes an electronic assembly for automatically tightening or loosening one or more laces.

2. Description of the Background

Many conventional shoes or articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface of the upper and is positioned between the upper and the ground. As a result, the sole typically provides stability and cushioning to the user when the shoe is being worn and/or is in use. In some instances, the sole may include multiple components, such as an outsole, a midsole, and an insole. The outsole may provide traction to a bottom surface of the sole, and the midsole may be attached to an inner surface of the outsole, and may provide cushioning and/or added stability to the sole. For example, a sole may include a particular foam material that may increase stability at one or more desired locations along the sole, or a foam material that may reduce stress or impact energy on the foot and/or leg when a user is running, walking, or engaged in another activity.

The upper generally extends upward from the sole and defines an interior cavity that completely or partially encases a foot. In most cases, an upper extends over instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, the tongue being provided to allow for adjustment of shoe tightness. The tongue may further be manipulable by a user to permit entry and/or exit of a foot from the internal space or cavity. In addition, the lacing system may allow a user to adjust certain dimensions of the upper and/or the sole, thereby allowing the upper to accommodate a wide variety of foot types having varying sizes and shapes.

The upper may comprise a wide variety of materials, which may be chosen based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

Further, lacing systems associated with typical shoes historically have included a single lace that is drawn through a plurality of eyelets in a crisscrossing or parallel manner. Many shoes have historically included laces that extend from one side of the upper to another side, i.e., from the medial side to the lateral side of the upper. The lace for each shoe is laced through the eyelets and the two ends of the lace extend out of the eyelets such that a user can grasp the ends and tie the shoe in a manner that the user sees fit. Some shoes do not require a user to tie the laces, but rather include laces that are stretchable such that the laces can be stretched when a user puts the shoe on, and can return to an original tightness once the user has taken the shoe off.

Still further, some shoes do not include laces, such as slip on shoes, and some shoes include straps that can be adjusted to vary the tightness of the shoe. With respect to shoes that do include laces, it may be desirable to utilize a system that can automatically lace the shoes, for example, in situations where a user may desire adjustability of laces in differing circumstances. It also may be desirable to have an automatic lacing system for users who have difficulty tying shoes, such as the elderly or the infirm. It may also be desirable to include a lacing system where the laces do not apply forces along a top of the foot; rather, when the laces are tightened, forces are applied along the medial and lateral sides of the foot. Still further, it may be desirable to include a system by which the shoes can be automatically laced via a graphical user interface displayed on a portable electronic device.

Therefore, articles of footwear having uppers with automatic lacing systems may be desired.

SUMMARY

An article of footwear, as described herein, may have various configurations. The article of footwear may have an upper and a sole structure connected to the upper. In some embodiments, a lacing system for an article of footwear defining a forefoot region, a midfoot region, and a heel region, includes a sole structure, an upper attached to the sole structure, the upper comprising a lateral side, a medial side, and a tongue, a housing that is disposed along the tongue and entirely within the midfoot region, and an electronics assembly enclosed entirely within the housing, the electronics assembly including at least a motor and a gear assembly. A first lace extends from the housing through a first aperture and a second aperture, and the first lace is drawn into the housing when the motor is activated by a user.

In some embodiments, the electronics assembly further includes a sensor that is responsive to tactile interaction with the housing by a user. In some embodiments, the electronics assembly further includes a plurality of light sources that project light through a portion of the housing. In some embodiments, the plurality of light sources display a first configuration based on a first tactile signal, and the plurality of light sources display a second configuration based on a second tactile signal that is different than the first tactile signal. In some embodiments, the first tactile signal includes only a first swipe or a tap by a user.

In some embodiments, the second tactile signal includes multiple second swipes or taps by a user. In some embodiments, when the motor is activated, the first lace is spooled about a longitudinal axis and into the housing. In some embodiments, a battery unit is located within the sole structure, and is connected to the electronics assembly with a wire. In some embodiments, the battery unit includes a battery that is electrically coupled with a charging coil, and the battery is charged by induction when the charging coil is inductively coupled with an external charger. In some embodiments, the electronics assembly is provided along a flexible circuit that is disposed within the housing.

In some embodiments, a lacing system for an article of footwear defining a forefoot region, a midfoot region, and a heel region, includes a sole structure, an upper attached to the sole structure, the upper comprising a lateral side, a medial side, and a tongue, a housing that is disposed along the tongue and entirely within the midfoot region, and an electronics assembly enclosed entirely within the housing, the electronics assembly including at least a motor, a gear assembly, and a plurality of light sources that project light through a portion of the housing.

In some embodiments, a first lace extends from the housing through a first aperture and a second aperture, and the first lace is drawn into the housing when the motor is activated by a user. In some embodiments, the electronics assembly further includes a plurality of light sources that project light through a portion of the housing. In some embodiments, the plurality of light sources display a first configuration based on a first tactile signal, and the plurality of light sources display a second configuration based on a second tactile signal that is different than the first tactile signal. In some embodiments, the electronics assembly is provided along a flexible circuit that is disposed within the housing. In some embodiments, all of the light sources are visible to a user looking down at the housing while wearing the article of footwear.

In some embodiments, a lacing system for an article of footwear defining a forefoot region, a midfoot region, and a heel region, includes a sole structure, an upper attached to the sole structure, the upper comprising a lateral side, a medial side, and a tongue, a housing that is disposed along the tongue and entirely within the midfoot region, and an electronics assembly enclosed entirely within the housing, the electronics assembly including at least a motor and a gear assembly. The motor includes a motor shaft that defines a first axis, and when the motor is activated, a first lace is spooled about a second axis and into the housing, and the first axis is offset with respect to the second axis.

In some embodiments, the first axis and the second axis are orthogonally offset. In some embodiments, the electronics assembly further includes a plurality of light sources that project light through a portion of the housing. In some embodiments, all of the light sources are visible to a user looking down at the housing while wearing the article of footwear.

Other aspects of the articles of footwear described herein, including features and advantages thereof, will become apparent to one of ordinary skill in the art upon examination of the figures and detailed description herein. Therefore, all such aspects of the articles of footwear are intended to be included in the detailed description and this summary.

DETAILED DESCRIPTION OF THE DRAWINGS

Figure 1:
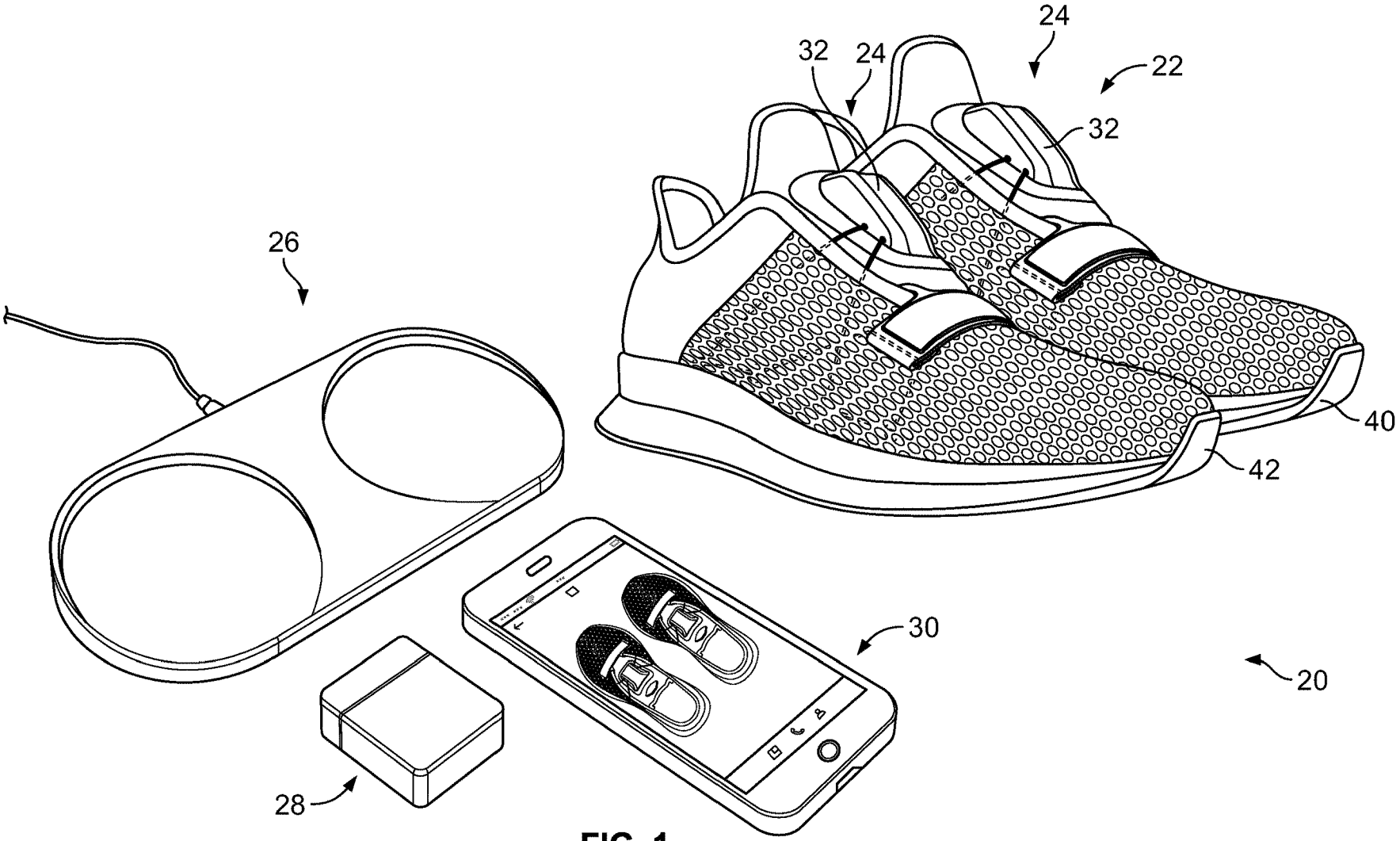
FIG. 1 is a perspective view of an automatic lacing footwear assembly that includes a pair of shoes comprising an automatic lacing system, a charger for charging one or more batteries within the pair of shoes, a battery cartridge for receiving a battery for charging, and an electronic device, such as a cell phone, which can be used to send one or more signals to the automatic lacing system.

The following discussion and accompanying figures disclose various embodiments or configurations of a shoe and an automatic lacing system for the shoe. Although embodiments are disclosed with reference to a sports shoe, such as a running shoe, tennis shoe, basketball shoe, etc., concepts associated with embodiments of the shoe may be applied to a wide range of footwear and footwear styles, including basketball shoes, cross-training shoes, football shoes, golf shoes, hiking shoes, hiking boots, ski and snowboard boots, soccer shoes and cleats, walking shoes, and track cleats, for example. Concepts of the shoe or the automatic lacing system may also be applied to articles of footwear that are considered non-athletic, including dress shoes, sandals, loafers, slippers, and heels. In addition to footwear, particular concepts described herein, such as the automatic lacing concept, may also be applied and incorporated in other types of articles, including apparel or other athletic equipment, such as helmets, padding or protective pads, shin guards, and gloves. Even further, particular concepts described herein may be incorporated in cushions, backpacks, suitcases, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The term "swipe" or variations thereof used herein refers to an act or instance of moving one's finger(s) across a panel or touchscreen to activate a function. A "swipe" involves touching a panel or touchscreen, moving one's finger along the panel or touchscreen in a first direction, and subsequently removing contact of one's finger with the panel or touchscreen.

The present disclosure is directed to an article of footwear and/or specific components of the article of footwear, such as an upper and/or a sole or sole structure, and an automatic lacing system. The upper may comprise a knitted component, a woven textile, a non-woven textile, leather, mesh, suede, and/or a combination of one or more of the aforementioned materials. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

FIG. 1 depicts a footwear assembly 20 that includes a pair of shoes 22, each of which includes an automatic lacing system 24, a charger 26 for charging one or more batteries (not shown) that are disposed within each of the shoes 22, a charging cartridge 28 for receiving a battery (not shown) for charging when the battery has been removed from one of the shoes 22, and an electronic device 30, which may be a cellular phone or tablet, that can be used to send one or more signals to the automatic lacing system 24 based on one or more inputs from a user. The footwear assembly 20 may include additional components not specifically addressed herein.

As discussed in greater detail hereinafter below, the footwear assembly 20 is intended to allow a user to tighten or loosen the laces of the shoes 22 by swiping, tapping, pressing, or applying a pressure to a control or swipe panel 32 of the automatic lacing system 24. As non-limiting examples, a user can swipe down along the panel 32 of the automatic lacing system 24 to close or tighten laces of the automatic lacing system 24, swipe up to open or loosen the laces, tap an upper end of the panel 32 to more precisely loosen the laces, or tap a lower end of the panel 32 to more precisely tighten the laces. These and other features will be described in greater detail below.

Figure 2:
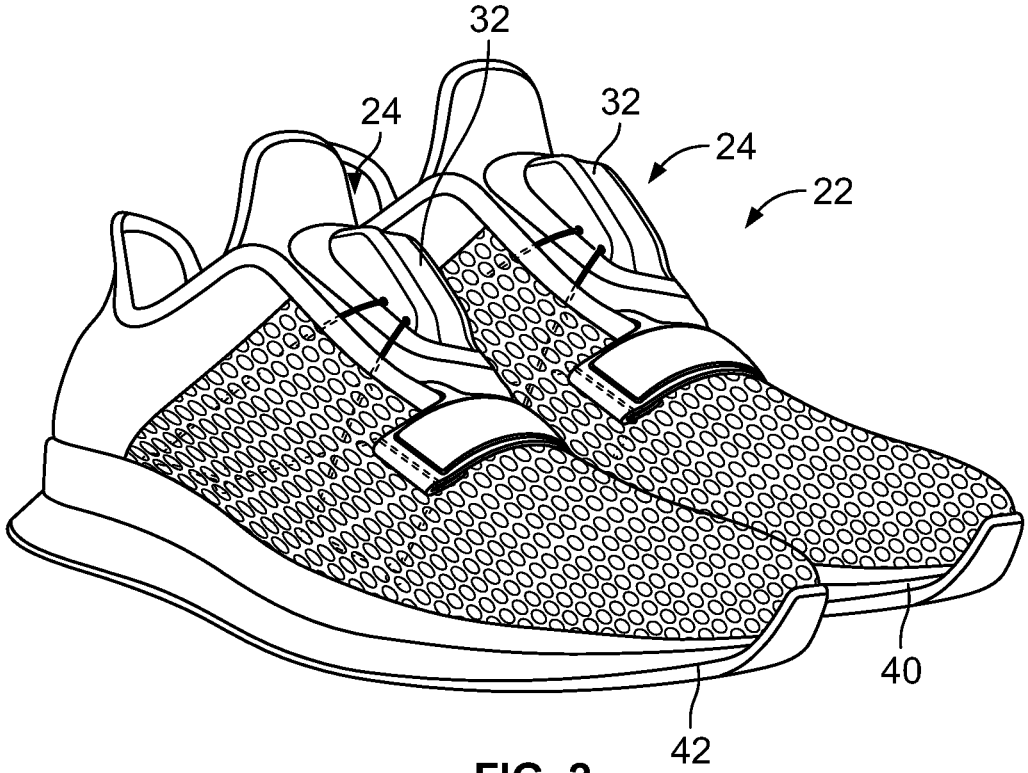
FIG. 2 is a perspective view of the pair of shoes of FIG. 1.
Figure 3:
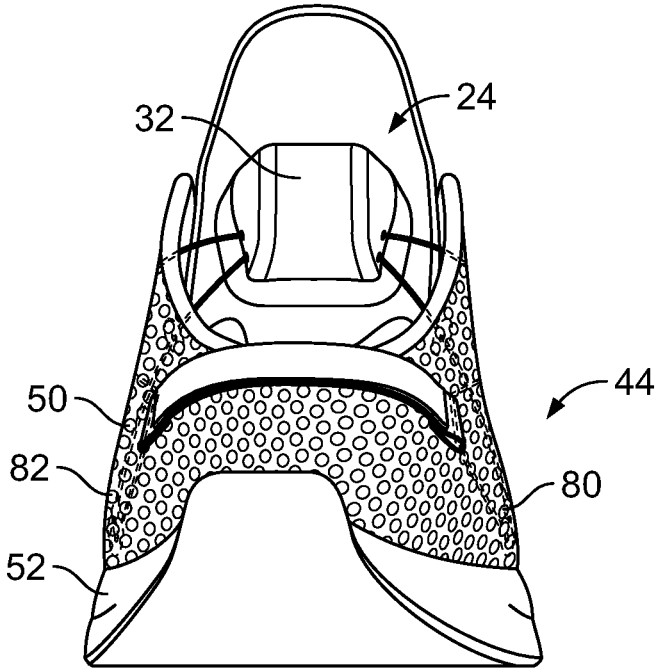
FIG. 3 is a front view of one of the shoes of FIG. 2.

Referring to FIG. 2, the shoes 22 are shown in greater detail. The shoes 22 comprise a first or left shoe 40 and a second or right shoe 42. The left shoe 40 and the right shoe 42 may be similar in all material aspects, except that the left shoe 40 and the right shoe 42 are sized and shaped to receive a left foot and a right foot of a user, respectively. For ease of disclosure, a single shoe or article of footwear 44 will be referenced to describe aspects of the disclosure. In some figures, the article of footwear 44 is depicted as a right shoe, and in some figures the article of footwear is depicted as a left shoe. The disclosure below with reference to the article of footwear 44 is applicable to both the left shoe 40 and the right shoe 42. In some embodiments, there may be differences between the left shoe 40 and the right shoe 42 other than the left/right configuration. For example, in some embodiments, the left shoe 40 may include the automatic lacing system 24, while the right shoe 42 may not include the automatic lacing system 24, or vice versa. Further, in some embodiments, the left shoe 40 may include one or more additional elements that the right shoe 42 does not include, or vice versa. As discussed hereinafter below, the article of footwear 44 need not include the automatic lacing system 24, but rather may be manually laced according to the lacing system disclosed herein.

FIGS. 3-6B depict an exemplary embodiment of the article of footwear 44 including an upper 50 and a sole structure 52. As will be further discussed herein, the upper 50 is attached to the sole structure 52 and together define an interior cavity 54 (see FIGS. 4 and 5) into which a foot of a user may be inserted. For reference, the article of footwear 44 defines a forefoot region 56, a midfoot region 58, and a heel region 60 (see FIGS. 6A and 6B). The forefoot region 56 generally corresponds with portions of the article of footwear 44 that encase portions of the foot that include the toes, the ball of the foot, and joints connecting the metatarsals with the toes or phalanges. The midfoot region 58 is proximate and adjoining the forefoot region 56, and generally corresponds with portions of the article of footwear 44 that encase the arch of a foot, along with the bridge of a foot. The heel region 60 is proximate and adjoining the midfoot region 58 and generally corresponds with portions of the article of footwear 44 that encase rear portions of the foot, including the heel or calcaneus bone, the ankle, and/or the Achilles tendon.

Many conventional footwear uppers are formed from multiple elements, e.g., textiles, polymer foam, polymer sheets, leather, and/or synthetic leather, which are joined through bonding or stitching at a seam. In some embodiments, the upper 50 of the article of footwear 44 is formed from a knitted structure or knitted components. In various embodiments, a knitted component may incorporate various types of yarn that may provide different properties to an upper. For example, one area of the upper 50 may be formed from a first type of yarn that imparts a first set of properties, and another area of the upper 50 may be formed from a second type of yarn that imparts a second set of properties. Using this configuration, properties of the upper 50 may vary throughout the upper 50 by selecting specific yarns for different areas of the upper 50. In a preferred embodiment, and referring to FIG. 8, the article of footwear 44 includes a first or mesh layer 62 and a second or base layer 64. The base layer 64 may include multiple layers, such as an outer surface 66 upon which a plurality of eyelets 68 may be provided, and an interior surface 70 that engages with a foot when a user puts on the article of footwear 44. The mesh layer 62 and the base layer 64 may be connected at one or more locations along the article of footwear 44.

With reference to the material(s) that comprise the upper 50, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 50.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 50 may also include additional structural elements. For example, in some embodiments, a heel plate or cover (not shown) may be provided on the heel region 60 to provide added support to a heel of a user. In some instances, other elements, e.g., plastic material, logos, trademarks, etc., may also be applied and fixed to an exterior surface using glue or a thermoforming process. In some embodiments, the properties associated with the upper 50, e.g., a stitch type, a yarn type, or characteristics associated with different stitch types or yarn types, such as elasticity, aesthetic appearance, thickness, air permeability, or scuff-resistance, may be varied.

Figure 4:
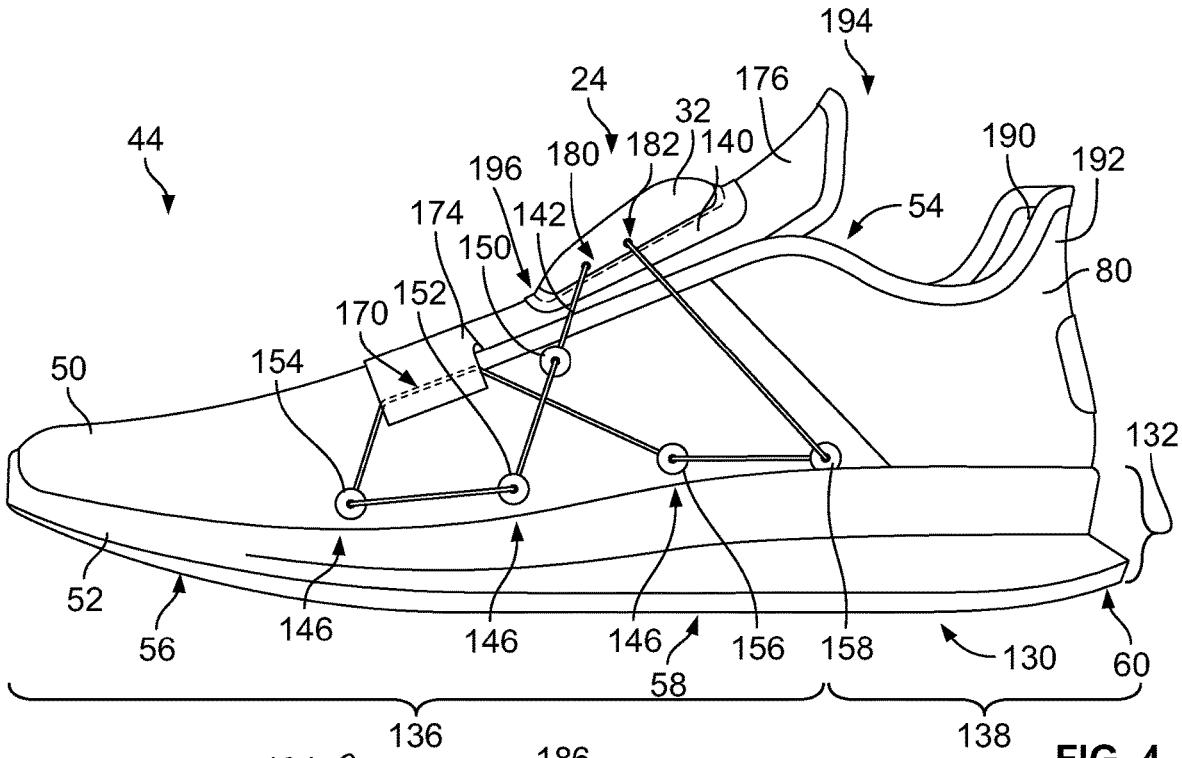
FIG. 4 is a right or lateral side view of the shoe of FIG. 3 with an outer mesh layer removed.
Figure 5:
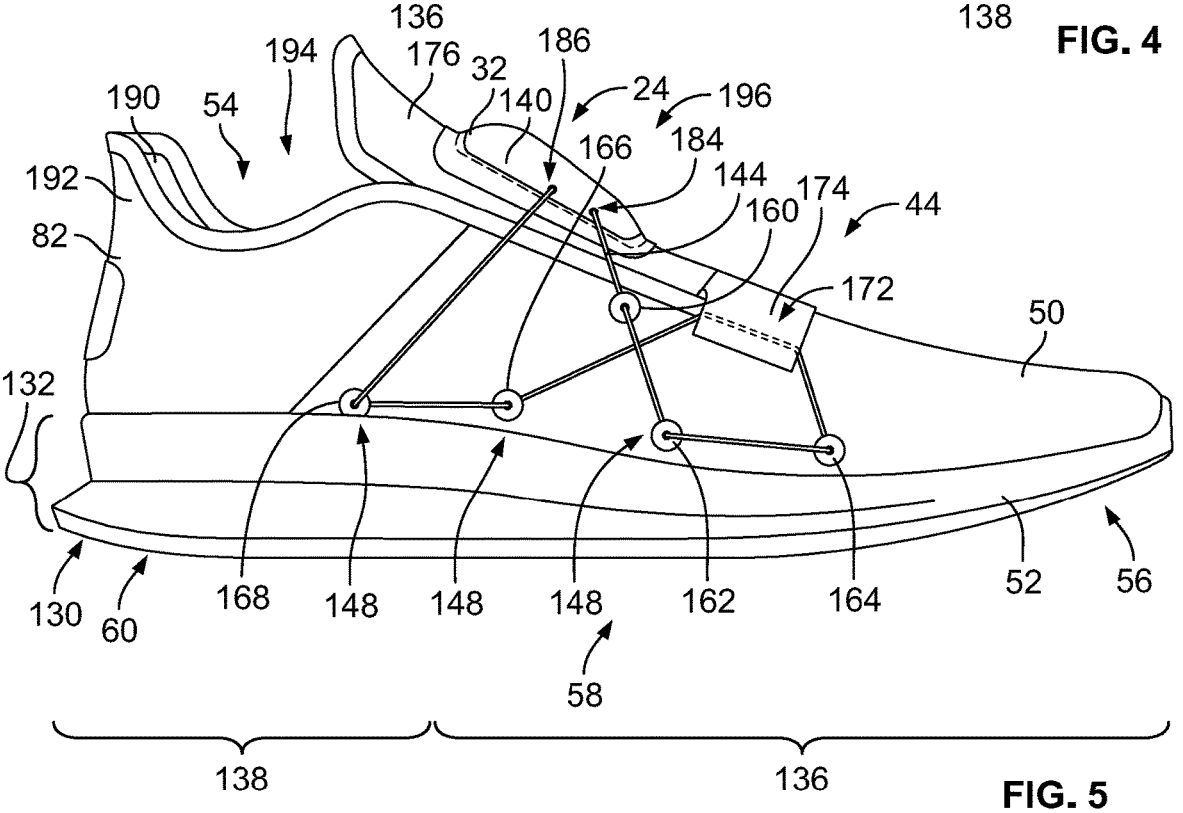
FIG. 5 is a left or medial side view of the shoe of FIG. 3 with an outer mesh layer removed.

Referring to FIGS. 4 and 5, the article of footwear 44 also defines a lateral side 80 and a medial side 82, the lateral side 80 being shown in FIG. 4 and the medial side 82 being shown in FIG. 5. When a user is wearing the shoes, the lateral side 80 corresponds with an outside-facing portion of the article of footwear 44 while the medial side 82 corresponds with an inside-facing portion of the article of footwear 44. As such, the left shoe 40 and the right shoe 42 have opposing lateral sides 80 and medial sides 82, such that the medial sides 82 are closest to one another when a user is wearing the shoes 22, while the lateral sides 80 are defined as the sides that are farthest from one another while the shoes 22 are being worn. As will be discussed in greater detail below, the medial side 82 and the lateral side 80 adjoin one another at opposing, distal ends of the article of footwear 44.

Figure 6A:
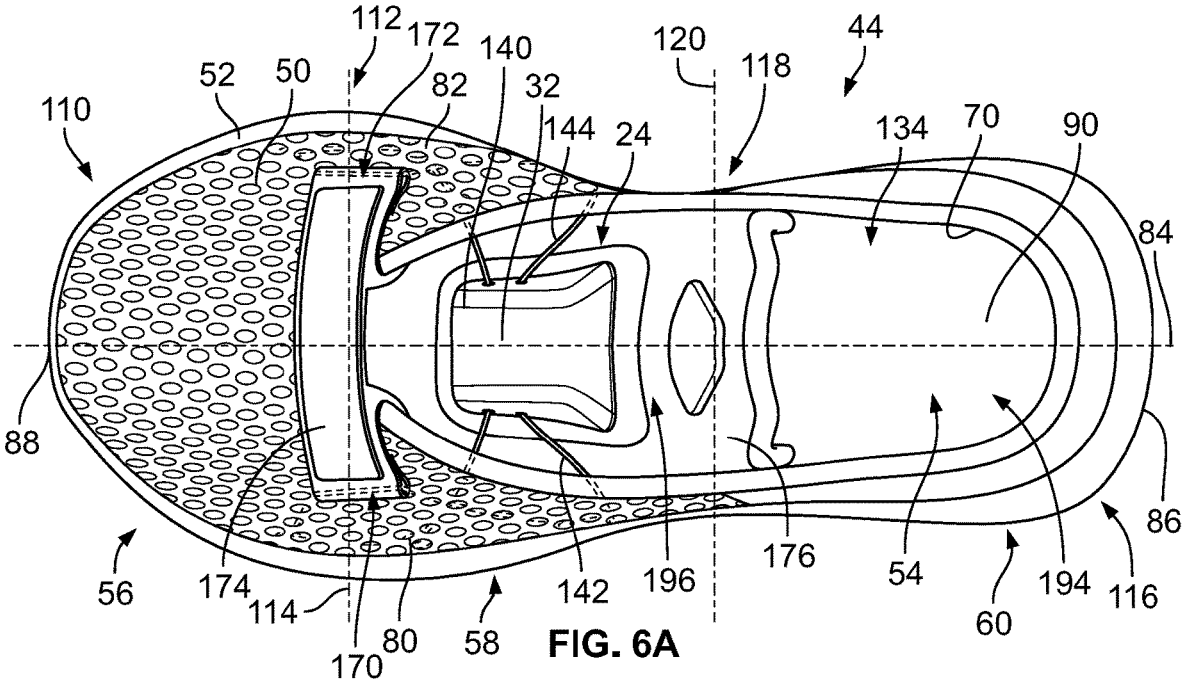
FIG. 6A is a top view of the shoe of FIG. 3.
Figure 6B:
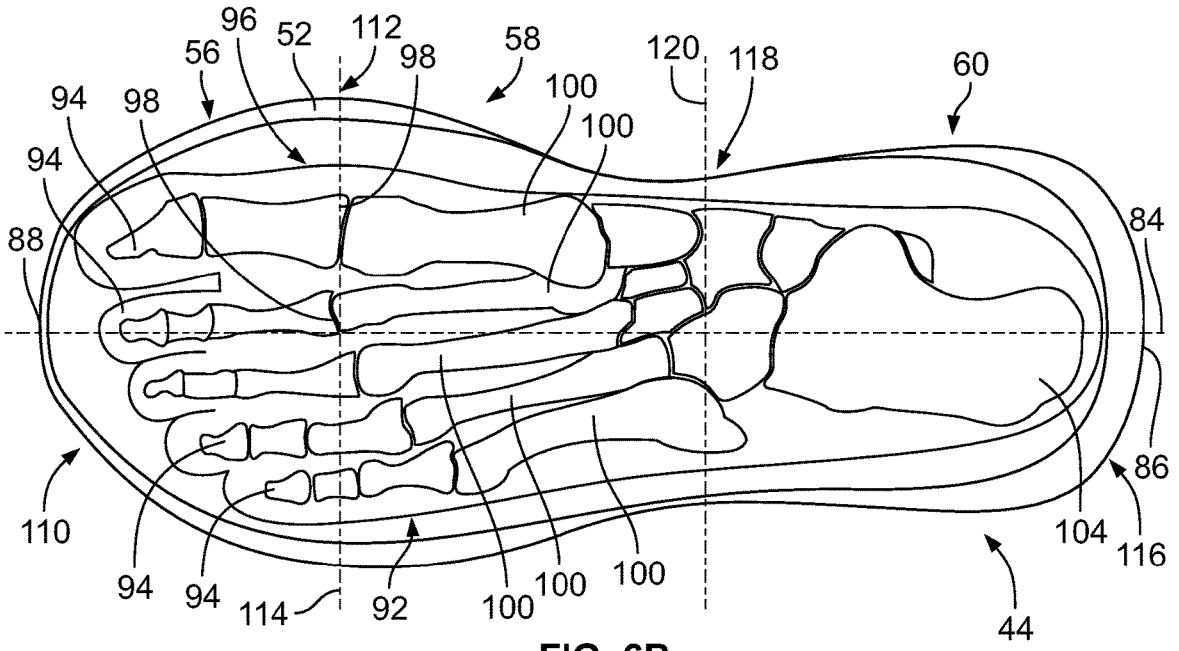
FIG. 6B is a top plan view of the article of footwear of FIG. 3, with an upper removed and a user's skeletal foot structure overlaid thereon.

Referring to FIGS. 6A and 6B, the medial side 82 and the lateral side 80 adjoin one another along a longitudinal central plane or axis 84 of the article of footwear 44. As will be further discussed herein, the longitudinal central plane or axis 84 may demarcate a central, intermediate axis between the medial side 82 and the lateral side 80 of the article of footwear 44. Put differently, the longitudinal plane or axis 84 may extend between a rear, distal end 86 of the article of footwear 44 and a front, distal end 88 of the article of footwear 44 and may continuously define a middle of an insole 90, the sole structure 52, and/or the upper 50 of the article of footwear 44, i.e., the longitudinal plane or axis 84 is a straight axis extending through the rear, distal end 86 of the heel region 60 to the front, distal end 88 of the forefoot region 56.

Unless otherwise specified, and referring to FIGS. 6A and 6B, the article of footwear 44 may be defined by the forefoot region 56, the midfoot region 58, and the heel region 60. The forefoot region 56 may generally correspond with portions of the article of footwear 44 that encase portions of a foot 92 that include the toes or phalanges 94, the ball of the foot 96, and one or more of the joints 98 that connect the metatarsals 100 of the foot 92 with the toes or phalanges 94. The midfoot region 58 is proximate and adjoins the forefoot region 56. The midfoot region 58 generally corresponds with portions of the article of footwear 44 that encase an arch of a foot 92, along with a bridge of the foot 92. The heel region 60 is proximate to the midfoot region 58 and adjoins the midfoot region 58. The heel region 60 generally corresponds with portions of the article of footwear 44 that encase rear portions of the foot 92, including the heel or calcaneus bone 104, the ankle (not shown), and/or the Achilles tendon (not shown).

Still referring to FIGS. 6A and 6B, the forefoot region 56, the midfoot region 58, the heel region 60, the medial side 82, and the lateral side 80 are intended to define boundaries or areas of the article of footwear 44. To that end, the forefoot region 56, the midfoot region 58, the heel region 60, the medial side 82, and the lateral side 80 generally characterize sections of the article of footwear 44. Certain aspects of the disclosure may refer to portions or elements that are coextensive with one or more of the forefoot region 56, the midfoot region 58, the heel region 60, the medial side 82, and/or the lateral side 80. Further, both the upper 50 and the sole structure 52 may be characterized as having portions within the forefoot region 56, the midfoot region 58, the heel region 60, and/or along the medial side 82 and/or the lateral side 80. Therefore, the upper 50 and the sole structure 52, and/or individual portions of the upper 50 and the sole structure 52, may include portions thereof that are disposed within the forefoot region 56, the midfoot region 58, the heel region 60, and/or along the medial side 82 and/or the lateral side 80.

Still referring to FIGS. 6A and 6B, the forefoot region 56, the midfoot region 58, the heel region 60, the medial side 82, and the lateral side 80 are shown in detail. The forefoot region 56 extends from a toe end 110 to a widest portion 112 of the article of footwear 44. The widest portion 112 is defined or measured along a first line 114 that is perpendicular with respect to the longitudinal axis 84 that extends from a distal portion of the toe end 110 to a distal portion of a heel end 116, which is opposite the toe end 110. The midfoot region 58 extends from the widest portion 112 to a thinnest portion 118 of the article of footwear 44. The thinnest portion 118 of the article of footwear 44 is defined as the thinnest portion of the article of footwear 44 measured across a second line 120 that is perpendicular with respect to the longitudinal axis 84. The heel region 60 extends from the thinnest portion 118 to the heel end 116 of the article of footwear 44.

It should be understood that numerous modifications may be apparent to those skilled in the art in view of the foregoing description, and individual components thereof, may be incorporated into numerous articles of footwear. Accordingly, aspects of the article of footwear 44 and components thereof, may be described with reference to general areas or portions of the article of footwear 44, with an understanding the boundaries of the forefoot region 56, the midfoot region 58, the heel region 60, the medial side 82, and/or the lateral side 80 as described herein may vary between articles of footwear.

However, aspects of the article of footwear 44 and individual components thereof, may also be described with reference to exact areas or portions of the article of footwear 44 and the scope of the appended claims herein may incorporate the limitations associated with these boundaries of the forefoot region 56, the midfoot region 58, the heel region 60, the medial side 82, and/or the lateral side 80 discussed herein.

Still referring to FIGS. 6A and 6B, the medial side 82 begins at the distal toe end 88 and bows outward along an inner side of the article of footwear 44 along the forefoot region 56 toward the midfoot region 58. The medial side 82 reaches the first line 114, at which point the medial side 82 bows inward, toward the central, longitudinal axis 84. The medial side 82 extends from the first line 114, i.e., the widest portion 112, toward the second line 120, i.e., the thinnest portion 118, at which point the medial side 82 enters into the midfoot region 58, i.e., upon crossing the first line 114. Once reaching the second line 120, the medial side 82 bows outward, away from the longitudinal, central axis 84, at which point the medial side 82 extends into the heel region 60, i.e., upon crossing the second line 120. The medial side 82 then bows outward and then inward toward the heel end 86, and terminates at a point where the medial side 82 meets the longitudinal, center axis 84.

Still referring to FIGS. 6A and 6B, the lateral side 80 also begins at the distal toe end 88 and bows outward along an outer side of the article of footwear 44 along the forefoot region 56 toward the midfoot region 58. The lateral side 80 reaches the first line 114, at which point the lateral side 80 bows inward, toward the longitudinal, central axis 84. The lateral side 80 extends from the first line 114, i.e., the widest portion 112, toward the second line 120, i.e., the thinnest portion 118, at which point the lateral side 80 enters into the midfoot region 58, i.e., upon crossing the first line 114. Once reaching the second line 120, the lateral side 80 bows outward, away from the longitudinal, central axis 84, at which point the lateral side 80 extends into the heel region 60, i.e., upon crossing the second line 120. The lateral side 80 then bows outward and then inward toward the heel end 86, and terminates at a point where the lateral side 80 meets the longitudinal, center axis 84.

Referring back to FIGS. 4 and 5, the sole structure 52 is connected or secured to the upper 50 and extends between a foot of a user and the ground when the article of footwear 44 is worn by the user. The sole structure 52 may also include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user.

Referencing FIGS. 4-6A the sole structure 52 of the present embodiment may be characterized by an outsole or outsole region 130, a midsole region 132, and an insole or insole region 134 (see FIG. 6A). The outsole region 130, the midsole region 132, and the insole region 134, and/or any components thereof, may include portions within the forefoot region 56, the midfoot region 58, and/or the heel region 60. Further, the outsole region 130, the midsole region 132, and the insole region 134, and/or any components thereof, may include portions on the lateral side 80 and/or the medial side 82.

In other instances, the outsole region 130 may be defined as a portion of the sole structure 52 that at least partially contacts an exterior surface, e.g., the ground, when the article of footwear 44 is worn. The insole region 134 may be defined as a portion of the sole structure 52 that at least partially contacts a user's foot when the article of footwear is worn. Finally, the midsole region 132 may be defined as at least a portion of the sole structure 52 that extends between and connects the outsole region 130 with the insole region 134.

The upper 50, as shown in FIGS. 4 and 5, extends upwardly from the sole structure 52 and defines the interior cavity 54 that receives and secures a foot of a user. The upper 50 may be defined by a foot region 136 and an ankle region 138. In general, the foot region 136 extends upwardly from the sole structure 52 and through the forefoot region 56, the midfoot region 58, and the heel region 60. The ankle region 138 is primarily located in the heel region 60; however, in some embodiments, the ankle region 138 may partially extend into the midfoot region 58.

Referring again to FIGS. 4 and 5, which depict the article of footwear 44 without the outer mesh layer 62, portions of the lacing of the automatic lacing system 24 are shown in greater detail. The automatic lacing system 24 includes a housing 140 defining the panel 32, and laces that include a lateral or first lace 142 and a medial or second lace 144. The automatic lacing system 24 also includes a number of electronic components, which will be discussed hereinafter below. The first lace 142 extends through a plurality of lateral eyelets 146 and the second lace 144 extends through a plurality of medial eyelets 148. The lateral eyelets 146 include a first lateral eyelet 150, a second lateral eyelet 152, a third lateral eyelet 154, a fourth lateral eyelet 156, and a fifth lateral eyelet 158. The medial eyelets 148 include a first medial eyelet 160, a second medial eyelet 162, a third medial eyelet 164, a fourth medial eyelet 166, and a fifth medial eyelet 168. Both the first lace 142 and the second lace 144 also extend through a first channel or slit 170 and a second channel or slit 172 that are provided within a strap 174 that extends across the midfoot region 58, adjacent a base of a tongue 176. The lateral eyelets 146 are disposed within all of the forefoot region 56, the midfoot region 58, and the heel region 60, and the medial eyelets 148 are disposed within all of the forefoot region 56, the midfoot region 58, and the heel region 60.

Further, both the first lace 142 and the second lace 144 include portions that are disposed within the housing 140, which allows the automatic lacing system 24 to draw in the laces 142, 144, or let out the laces 142, 144, depending on a particular input or desired operation of the user. In a preferred embodiment, the first lace 142 and the second lace 144 are closed loops, and each include a portion that is disposed within the housing 140, a portion that extends through the strap 174, and portions that extend through the eyelets 146, 148. In some embodiments, the first lace 142 and/or the second lace 144 may not comprise a closed loop, and may instead have ends that are fixedly attached to portions of the article of footwear 44.

Referring to FIG. 4, the first lace 142 extends from a first lateral aperture 180 along the housing 140 downward and slightly toward the forefoot region 56 to the first lateral eyelet 150. The first lace 142 may slightly bend or angle as it passes through the first lateral eyelet 150, however, the first lace 142 remains substantially linear as it passes through the first lateral eyelet 150. The first lace 142 then extends to the second lateral eyelet 152 through which the first lace 142 passes as it extends toward the third lateral eyelet 154. The first lace 142 forms an angle of about 120 degrees as it passes through the second lateral eyelet. After passing through the second lateral eyelet 152, the first lace 142 extends toward the forefoot region 56 and through the third lateral eyelet 154. The first lace 142 forms an angle of about 80 degrees as it passes through the third lateral eyelet 154. After passing through the third lateral eyelet 154, the first lace 142 extends upward and rearward, toward the strap 174. The first lace 142 then passes through the first channel 170 in the strap 174 toward the heel region, and extends downward toward the fourth lateral eyelet 156. As it extends toward the fourth lateral eyelet 156, the first lace 142 crosses over a portion of the first lace 142 that extends between the first lateral eyelet 150 and the second lateral eyelet 152. In some embodiments, the first lace 142 crosses under a portion of the first lace 142 that extends between the first lateral eyelet 150 and the second lateral eyelet 152. The first lace 142 forms an angle of about 155 degrees as it passes through the fourth lateral eyelet 156.

Still referring to FIG. 4, once reaching the fourth lateral eyelet 156, the first lace 142 angles slightly, and extends to the fifth lateral eyelet 158. The first lace 142 forms an angle of about 50 degrees as it passes through the fifth lateral eyelet 158. At the fifth lateral eyelet 158, the first lace 142 sharply turns back toward the midfoot region 58 and extends upward to a second lateral aperture 182 of the housing 140. The first lace 142 then passes through the second lateral aperture 182, and into the housing 140, as discussed in greater detail hereinafter below. Alternative configurations of the lacing structure as outlined above are contemplated, and more or fewer eyelets and or intersections of the first lace 142 with itself may be included. However, as noted above, in a preferred embodiment the first lace 142 crosses over itself a single time. In some embodiments, the first lace 142 may cross over itself two, three, four, five, six, or seven times. However, in the preferred embodiment, the specific orientation of the housing 140, the first eyelets 146, and the strap 174, allows the article of footwear 44 to be adequately and securely tightened around a user's foot, and forces applied by the first lace 142 and the second lace 144 are spread over a user's foot in an efficient and retentive manner so as to apply reduced forces along a user's foot while the article of footwear 44 is being worn. In that sense, a preferable orientation of the first lace 142 is to extend from the housing 140 downward, toward the sole structure 52 through two of the first eyelets 146 and through the remaining eyelets, as noted above.

Referring to FIG. 5, the second lace 144 extends from a first medial aperture 184 along the housing 140 downward and slightly toward the forefoot region 56 to the first medial eyelet 160. The second lace 144 may slightly bend or angle as it passes through the first medial eyelet 160, however, the second lace 144 remains substantially linear as it passes through the first medial eyelet 160. The second lace 144 then extends to the second medial eyelet 162 through which the second lace 144 passes as it extends toward the third medial eyelet 164. The second lace 144 forms an angle of about 120 degrees as it passes through the second medial eyelet. After passing through the second medial eyelet 162, the second lace 144 extends toward the forefoot region 56 and through the third medial eyelet 164. The second lace 144 forms an angle of about 80 degrees as it passes through the third medial eyelet 164. After passing through the third medial eyelet 164, the second lace 144 extends upward and rearward, toward the strap 174. The second lace 144 then passes through the second channel 172 in the strap 174, toward the heel region 60, and then extends downward toward the fourth medial eyelet 166. As it extends toward the fourth medial eyelet 166, the second lace 144 crosses over a portion of the second lace 144 that extends between the first medial eyelet 160 and the second medial eyelet 162. In some embodiments, the second lace 144 crosses under a portion of the second lace 144 that extends between the first medial eyelet 160 and the second medial eyelet 162. The second lace 144 forms an angle of about 155 degrees as it passes through the fourth medial eyelet 166.

Still referring to FIG. 5, once reaching the fourth medial eyelet 166, the second lace 144 angles slightly, and extends to the fifth medial eyelet 168. The second lace 144 forms an angle of about 50 degrees as it passes through the fifth medial eyelet 168. At the fifth medial eyelet 168, the second lace 144 sharply turns back toward the midfoot region 58 and extends upward to a second medial aperture 186 of the housing 140. The second lace 144 then passes through the second medial aperture 186, and into the housing 140, as discussed in greater detail hereinafter below. Alternative configurations of the lacing structure as outlined above are contemplated, and more or fewer eyelets and or intersections of the second lace 144 may be included.

As noted above, the second lace 144 crosses over itself a single time. In some embodiments, the second lace 144 may cross over itself two, three, four, five, six, or seven times. However, in the preferred embodiment. the specific orientation of the housing 140, the second eyelets 148, and the strap 174, allows the article of footwear 44 to be adequately and securely tightened around a user's foot, and forces applied by the first lace 142 and the second lace 144 are spread over a user's foot in an efficient and retentive manner so as to apply reduced forces along a user's foot while the article of footwear 44 is being worn. In that sense, a preferable orientation of the second lace 144 is to extend from the housing 140 downward, toward the sole structure 52 through two of the second eyelets 148 and through the remaining eyelets, as noted above.

The lacing system 24 as described above may allow a user to modify dimensions of the upper 50, e.g., to tighten or loosen portions of the upper 50, around a foot as desired by the user. As will also be discussed in further detail herein, the lacing system 24 may allow a user to modify tightness, as desired by the user. In some embodiments, both the first lace 142 and the second lace 144 are tightened or loosened the same amount when a command is input by a user. In some embodiments, only one of the first lace 142 or the second lace 144 is tightened or loosened when a command is input by a user. In some embodiments, the first lace 142 tightens or loosens to a first tightness level, and the second lace 144 tightens or loosens to a second tightness level, different than the first tightness level. As such, the first lace 142 and the second lace 144 may be tightened to the same tightness level or may be tightened to different levels.

Referring to FIGS. 6A and 6B, the upper 50 extends along the lateral side 80 and the medial side 82, and across the forefoot region 56, the midfoot region 58, and the heel region 60 to house and enclose a foot of a user. When fully assembled, the upper 50 also includes an interior surface 190 and an exterior surface 192. The interior surface 190 faces inward and generally defines the interior cavity 54, and the exterior surface 192 of the upper 50 faces outward and generally defines an outer perimeter or boundary of the upper 50. The interior surface 190 and the exterior surface 192 may comprise portions of the layers 62, 64 disclosed above. The upper 50 also includes an opening 194 that is at least partially located in the heel region 60 of the article of footwear 44, that provides access to the interior cavity 54 and through which a foot may be inserted and removed. In some embodiments, the upper 50 may also include an instep area 196 that extends from the opening 194 in the heel region 60 over an area corresponding to an instep of a foot to an area adjacent the forefoot region 56. The instep area 196 may comprise an area similar to where tongue 176 of the present embodiment is disposed. In some embodiments, the upper 50 does not include the tongue 176, i.e., the upper 50 is tongueless, and the housing 140 is disposed along a portion of the upper 50 as discussed above.

Referring to FIG. 6A, the housing 140, or components thereof, may be formed through additive manufacturing techniques, such as by 3D printing. To that end, a number of 3D printed techniques may be implemented to form the housing 140, such as vat photopolymerization, material jetting, binder jetting, powder bed fusion, material extrusion, directed energy deposition, and/or sheet lamination. In some embodiments, the housing 140, or components thereof, may be 3D printed directly upon the instep region 196, or along another region of the foot, such as the forefoot region 56, the midfoot region 58, or the heel region 60. In some embodiments, the housing 140, or components thereof, may be 3D printed and then separately coupled with a portion of the shoe 44.

Figure 7:
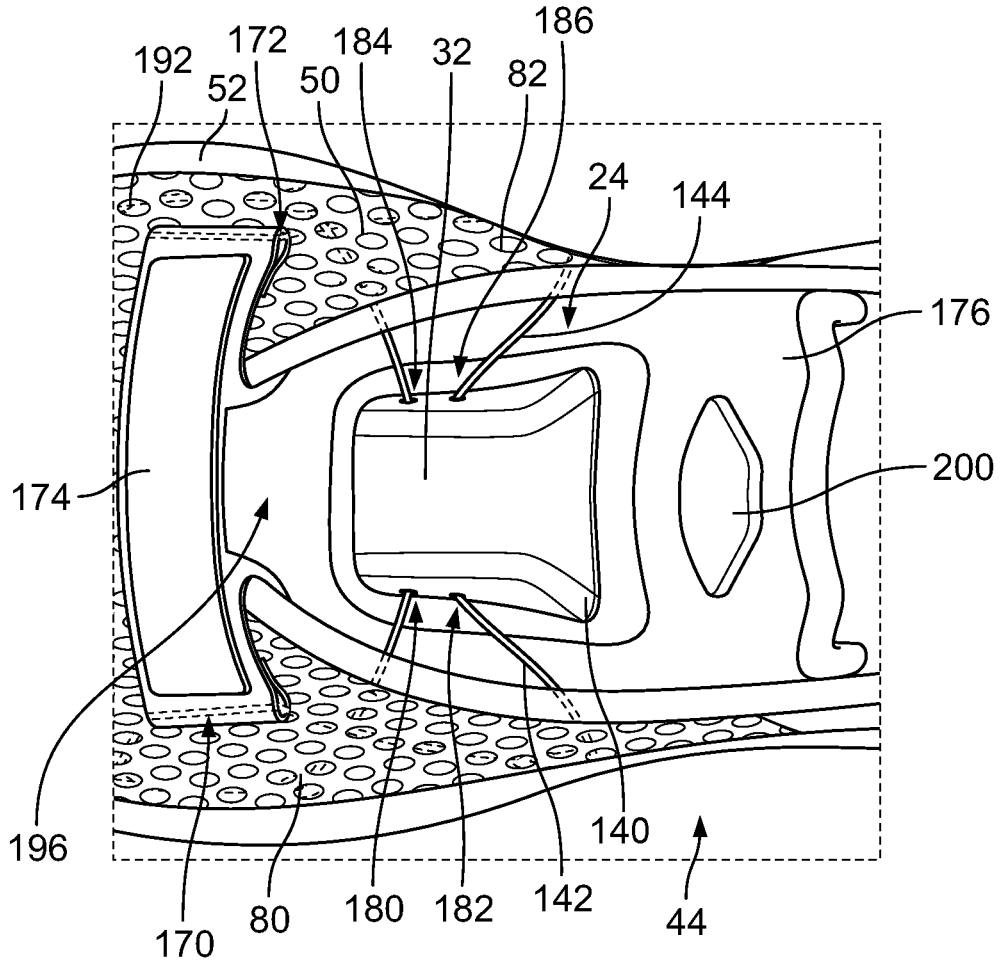
FIG. 7 is a detail view of the automatic lacing system along the shoe of FIG. 3.

Referring to FIG. 7, the housing 140 of the automatic lacing system 24 is shown in greater detail. The housing 140 is centrally disposed along the tongue 176, which is located between the lateral side 80 of the upper 50 and the medial side 82 of the upper 50. The strap 174 is located at the base of the tongue 176, the strap 174 including the channels 170, 172 through which the first and second laces 142, 144 can move when the laces are being tightened or loosened. The panel 32 along the housing 140 is shown clearly in FIG. 7. The first and second lateral apertures 180, 182 and the first and second medial apertures 184, 186 are also shown, through which the first lace 142 and the second lace 144 extend. A design element 200 is also provided along the tongue 176, which, in some embodiments, may include an LED or sensor disposed therealong, which may receive or provide feedback from a user. The tongue 176 of the article of footwear 44 may be connected to the upper 50 at a number of connection points, or along the sides and base thereof. The tongue 176 may also include additional aspects not specifically recited herein.

Figure 8:
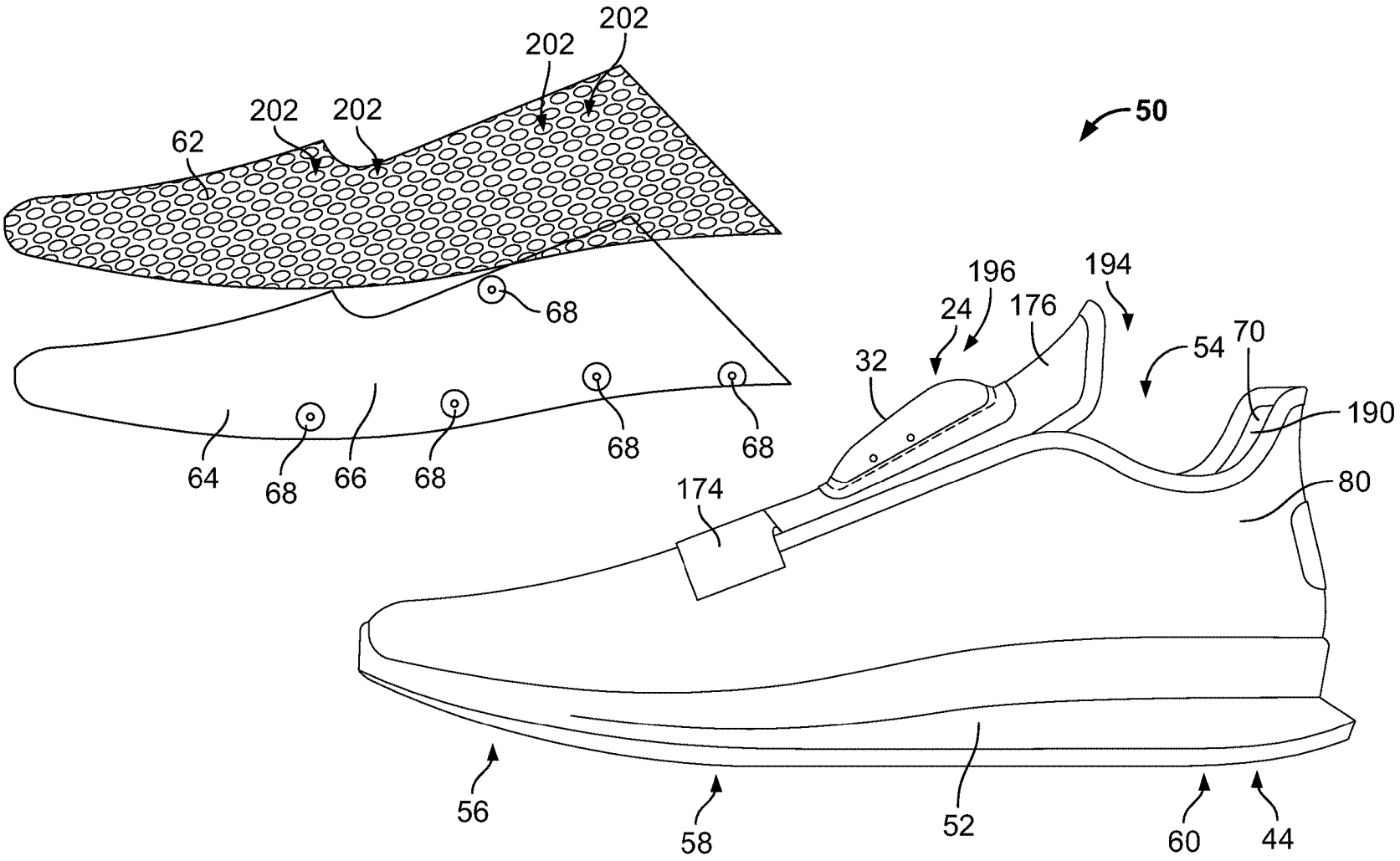
FIG. 8 is a right side view of the shoe of FIG. 3 illustrating layers that comprise an upper of the shoe.

Referring now to FIG. 8, a partially exploded view of the layering of the article of footwear 44 is shown. As provided in the exploded view, the first or mesh layer 62 and the second or base layer 64 are shown separated from the article of footwear 44. The mesh layer 62 is shown comprising a web or web-like structure with a plurality of apertures 202 provided along the web-like structure. The base layer 64 is a generally homogenous layer without any apertures or holes therealong. Further, the base layer 64 comprises the plurality of eyelets 68. Portions of the base layer 64 and portions of the mesh layer 62, in combination, form the exterior surface 192 of the upper 50. The base layer 64 is also disposed under the mesh layer 62 when the article of footwear 44 is fully assembled. There may be additional layers provided intermediate the mesh layer 62 and the base layer 64, e.g., in some embodiments, one or more additional layers are provided between the base layer 64 and the mesh layer 62. In some embodiments, additional layers are provided above or below the mesh layer 62 or the base layer 64, respectively.

The first layer 62 and the second layer 64 may include varying characteristics, e.g., a stitch type, a yarn type, or characteristics associated with different stitch types or yarn types, such as elasticity, aesthetic appearance, thickness, air permeability, or scuff-resistance, may be varied between the first layer 62 and the second layer 64, and/or or other portions of the upper 50. For example, the upper 50, and the individual components thereof, e.g., the mesh layer 62 and the base layer 64, may be individually formed using a variety of elements, textiles, polymers (including foam polymers and polymer sheets), leather, synthetic leather, etc. Further, the upper 50, and the individual components thereof, may be joined together through bonding, stitching, or by a seam to create the upper 50.

Figure 9A:
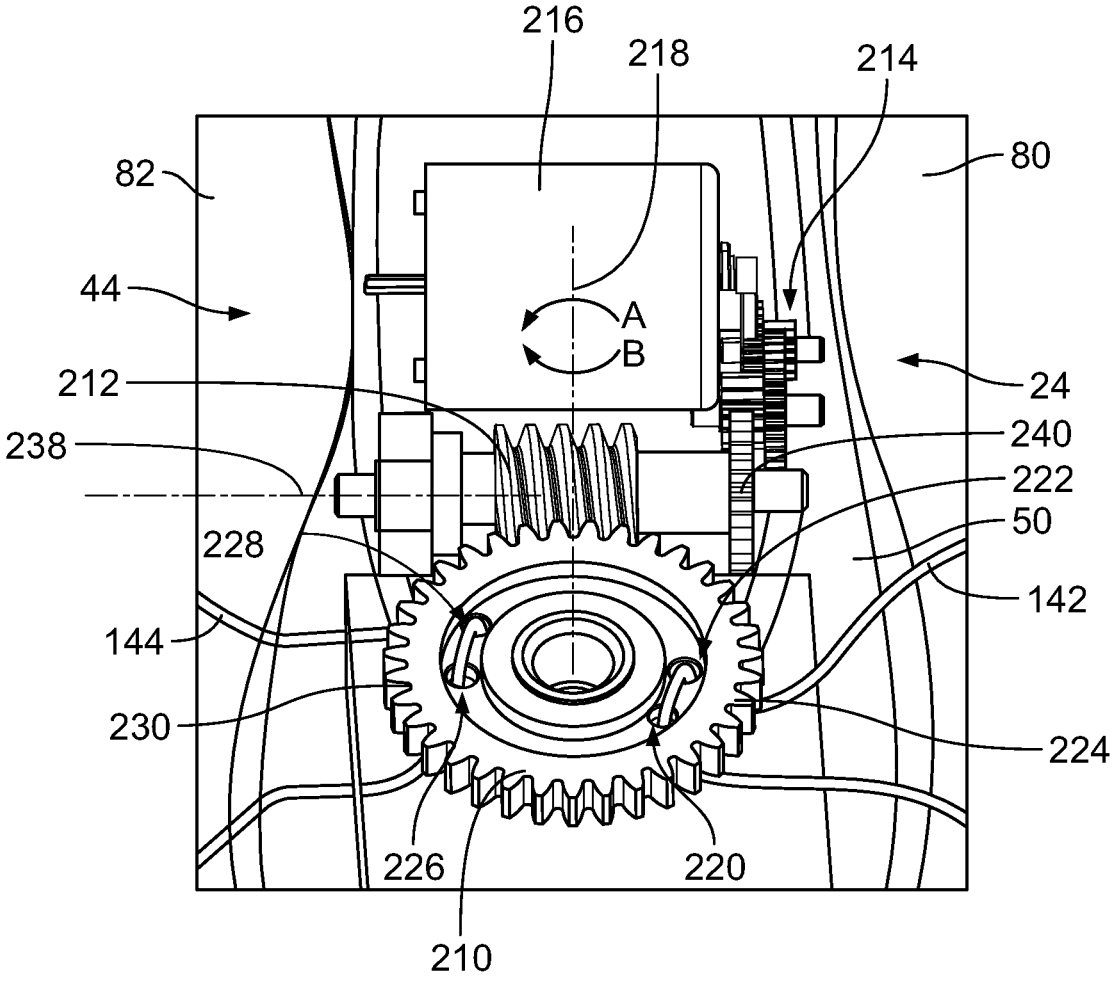
FIG. 9A is a detail top phantom view of internal components of the automatic lacing system of FIG. 7.

Referring to FIGS. 9A-15, the lacing system 24 will now be described in greater detail. Referring to FIGS. 9A and 9B, ghost views of some internal components of the automatic lacing system 24 illustrate a wheel gear 210, a worm gear 212, a gear train 214 comprising additional gears, and a motor 216. A spool (not shown) is formed by an underside of the wheel gear 210, and is operable to spool the first lace 142 and the second lace 144. Portions of the housing 140 are removed for clarity. The specific gear configuration will be discussed below, but the motor 216 is operable to rotate the worm gear 212 via the gear train 214. The worm gear 212 is configured to drive the wheel gear 210, which allows the first lace 142 and the second lace 144 to rotate about a wheel gear axis 218. As the wheel gear 210 turns and draws the first lace 142 and the second lace 144 around the axis 218, which is coincident with an axis of the spool, the laces 142, 144 are either tightened or loosened, depending on a direction of rotation of the wheel gear 210 (and by extension, the worm gear 212, the gears of the gear train 214, and the motor 216). As described below, the motor 216 may be a DC brushless motor.

Referring specifically to FIG. 9A, the wheel gear 210 includes a first aperture 220 and a second aperture 222 on a lateral or right side 224 thereof, and a third aperture 226 and a fourth aperture 228 on a medial or left side 230 thereof. The first and second apertures 220, 222 are disposed adjacent one another, and the third and fourth apertures 226, 228 are disposed adjacent one another. In a preferred embodiment, the first lace 142 passes into the housing 140, is strung upward through the first aperture 220, and back downward through the second aperture 222. In a preferred embodiment, the second lace 144 passes into the housing 140, is strung upward through the third aperture 226, and back downward through the fourth aperture 228. This orientation allows the first lace 142 and the second lace 144 to be drawn inward, around the gear axis 218 in a direction of arrows A or B, depending upon whether the automatic lacing system 24 is being used to tighten or loosen the laces 142, 144. As may be apparent from the orientation of the first lace 142 and the second lace 144 along the wheel gear 210, the first lace 142 and the second lace 144 are tightened or loosened at the same time in this orientation and to the same degree.

In a preferred embodiment, from an initial or loose configuration (shown in FIG. 9A), rotation of the wheel gear 210 by about 90 degrees results in a first level of tightness, rotation of the wheel gear 210 by about 180 degrees results in a second level of tightness, rotation of the wheel gear by about 270 degrees results in a third level of tightness, etc. In some embodiments, rotation of the wheel gear 210 in increments of about 60 degrees results in a first level of tightness, second level of tightness, third level of tightness, etc. In some embodiments, rotation of the wheel gear 210 by increments of about 45 degrees results in a first level of tightness, second level of tightness, third level of tightness, etc. In some embodiments, rotation of the wheel gear 210 in increments of about 30 degrees results in a first level of tightness, second level of tightness, third level of tightness, etc. In some embodiments, rotation of the wheel gear 210 by increments of about 15 degrees results in a first level of tightness, second level of tightness, third level of tightness, etc.

Figure 9B:
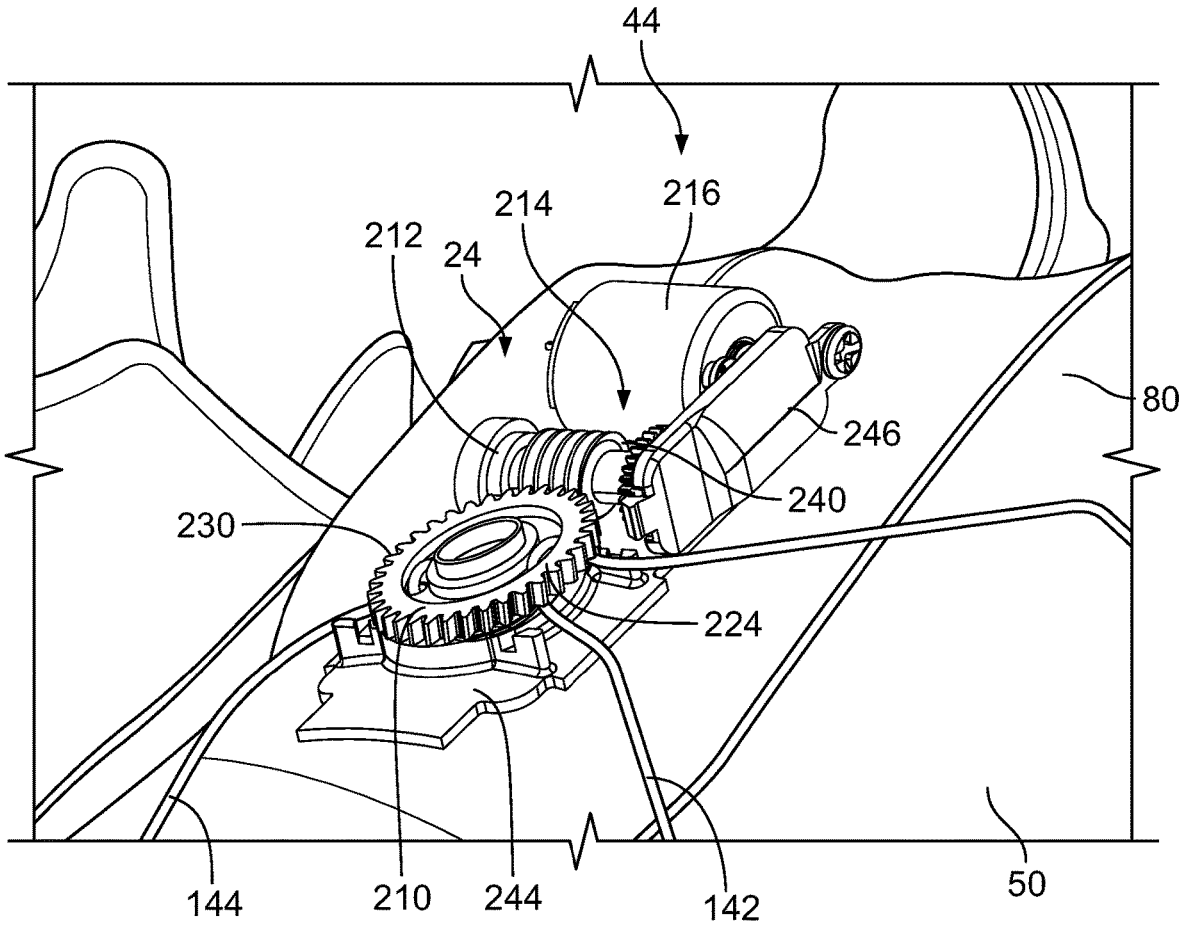
FIG. 9B is a detail perspective phantom view of internal components of the automatic lacing system of FIG. 7.

Still referring to FIG. 9A, the worm gear 212 defines a worm gear axis 238, along which a first gear 240 is disposed, which is one of the gears in the gear train 214. Referring to FIG. 9B, a motor housing 242 (see FIGS. 11 and 12) of the housing 140 is shown removed, while a gear base 244 of the housing 140 is shown having the wheel gear 210 coupled thereto. In FIG. 9B, the first gear 240 is visible, along with the wheel gear 210 and the worm gear 212, however, the remaining gears of the gear train 214 are hidden by a gear train housing 246. The gear train housing 246 is provided to retain the gear train 214 in a compact, and protected configuration. As provided in FIGS. 9B and 10B, the gear train 214 and the gear train housing 246 are disposed along a lateral side of the footprint of the housing 140. Further, the motor 216 is disposed at a heel end of the footprint of the housing 140, while the wheel gear 210 is provided at a midfoot end of the footprint of the housing 140.

Figure 10A:
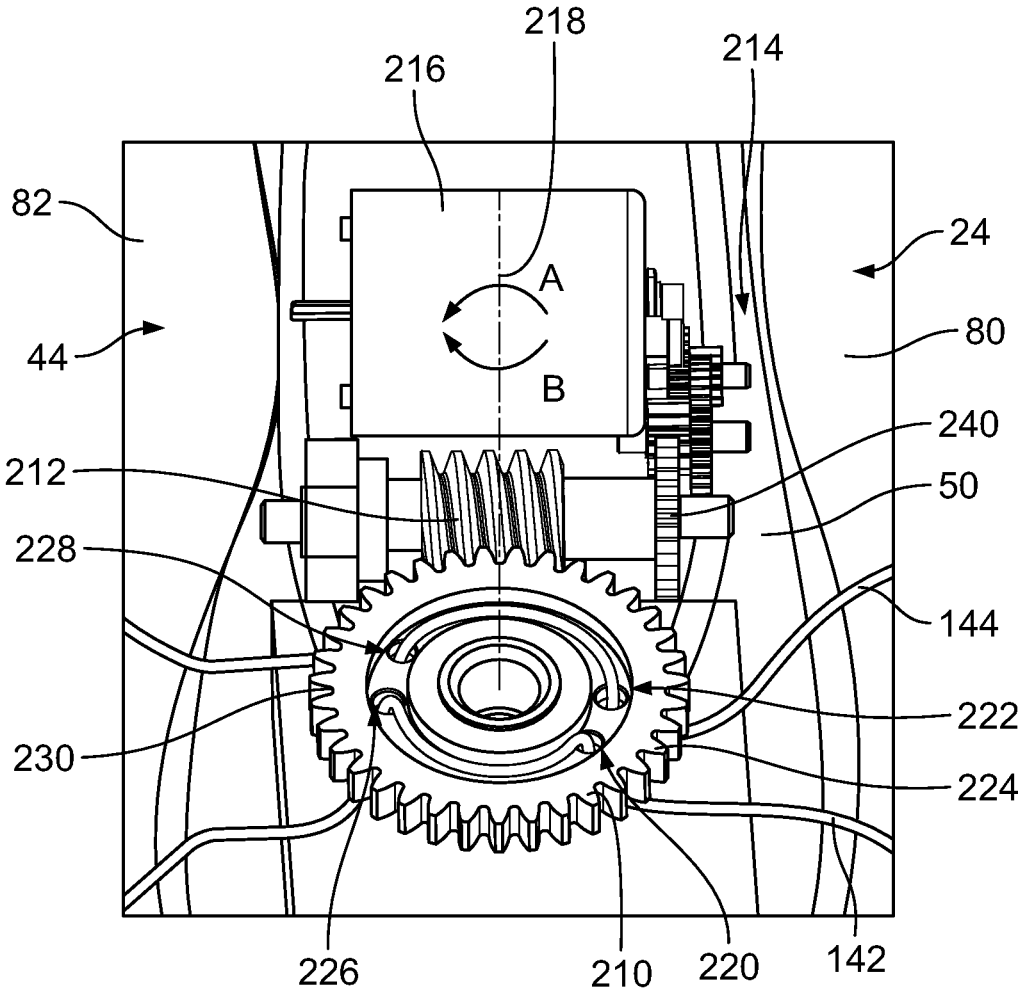
FIG. 10A is a detail top phantom view of internal components of another embodiment of an automatic lacing system.
Figure 10B:
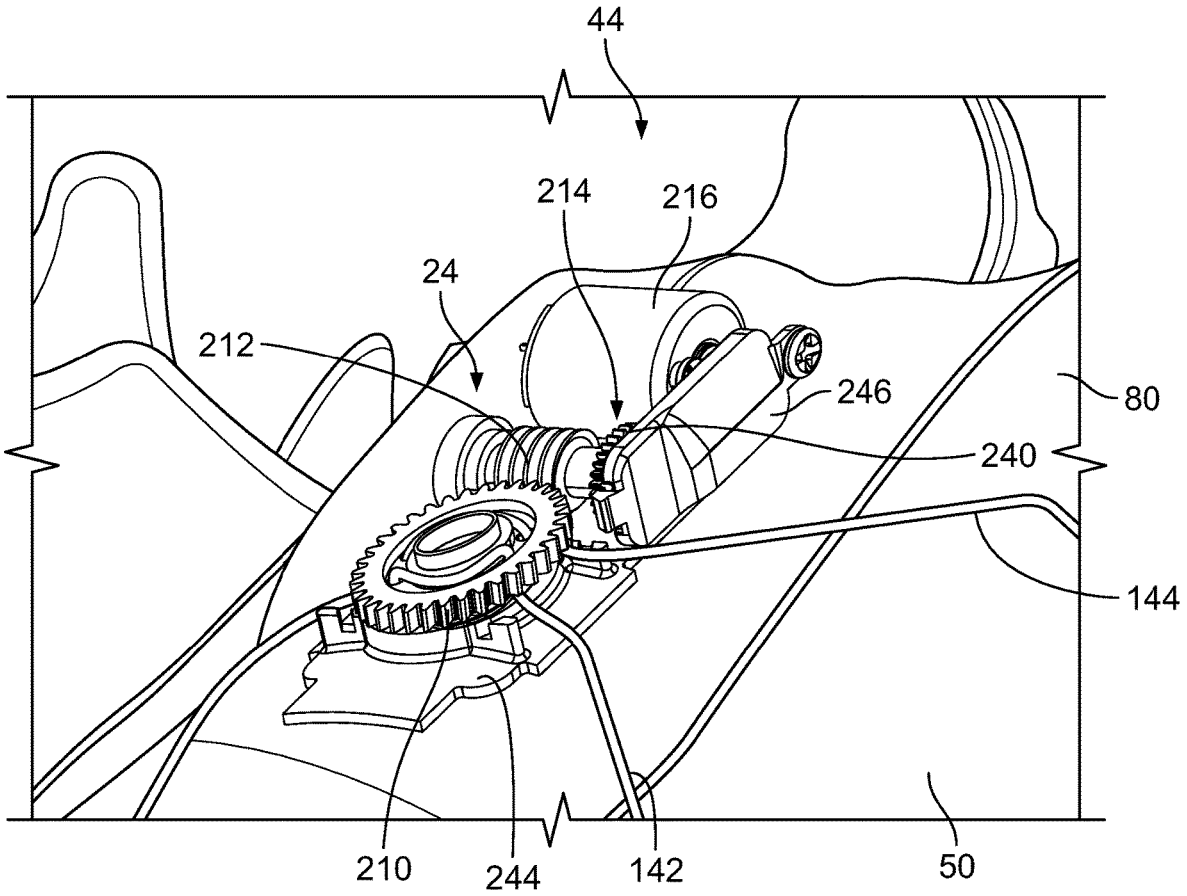
FIG. 10B is a detail perspective phantom view of internal components of the automatic lacing system of FIG. 10A.

Referring now to FIGS. 10A and 10B, ghost views of some internal components of the automatic lacing system 24 illustrate the wheel gear 210, the worm gear 212, the gear train 214, and the motor 216. Referring specifically to FIG. 10A, the wheel gear 210 includes the first aperture 220 and the second aperture 222 on the right side 224 thereof, and the third aperture 226 and the forth aperture 228 on the left side 230 thereof. The first and second apertures 220, 222 are disposed adjacent one another, and the third and fourth apertures 226, 228 are disposed adjacent on another. In the alternative embodiment depicted in FIGS. 10A and 10B, the first lace 142 passes into the housing 140, is strung upward through the first aperture 220, and back downward through the third aperture 226. In the same embodiment, the second lace 144 is passed into the housing 140, strung upward through the second aperture 222, and strung back downward through the fourth aperture 228. This orientation allows the first lace 142 and the second lace 144 to be drawn inward, around the gear axis 218 in a direction of arrows A or B, depending upon whether the automatic lacing system 24 is being used to tighten or loosen the laces 142, 144. As may be apparent from the orientation of the first lace 142 and the second lace 144 along the wheel gear 210, the first lace 142 and the second lace 144 are tightened or loosened at the same time in this orientation to the same degree.

Figure 11:
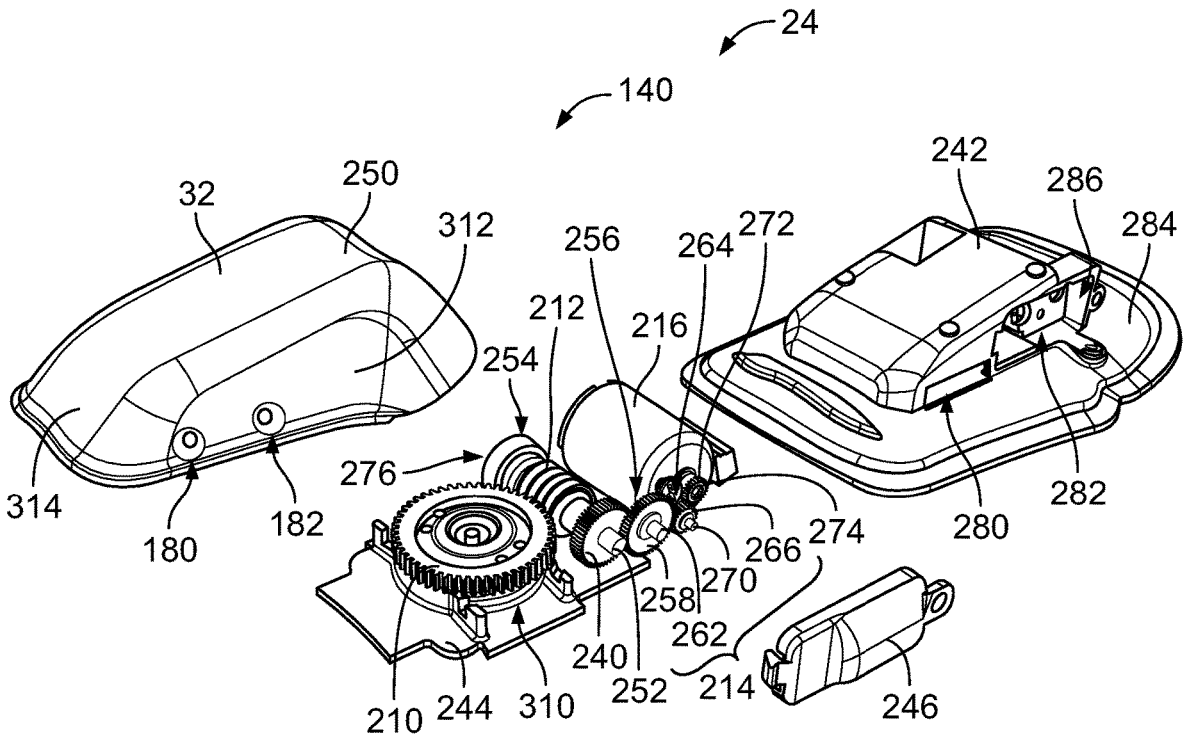
FIG. 11 is an exploded perspective view of some components of the automatic lacing system of FIG. 7.

FIGS. 11-15 depict elements of the automatic lacing system 24 in an exploded configuration. Referring specifically to FIG. 11, an exploded perspective view of some components of the automatic lacing system 24 is shown. The components include a top cover 250, the gear base 244, the motor housing 242, the gear train housing 246, the wheel gear 210, the worm gear 212, and the gear train 214. The worm gear 212 is provided about a first shaft 252, and the first gear 240 is disposed at an end of the first shaft 252. The worm gear 212, the first shaft 252, and the first gear 240 comprise a first gear assembly 254. A second gear assembly 256 includes a second gear 258 and a third gear 260 (see FIG. 13) that are disposed along a second shaft 262. The second gear 258 and the third gear 260 are fixedly coupled to one another, thus, when the second gear 258 is rotated, the third gear 260 is also rotated. A third gear assembly 264 is also provided, the third gear assembly 264 including a fourth gear 266 and a fifth gear 268 (see FIG. 13). The fourth gear 266 and the fifth gear 268 are fixedly coupled to one another and are disposed along a third shaft 270. A motor gear 272 is also shown extending from the motor 216, the motor gear 272 being disposed along a motor shaft 274 (see FIG. 15).

The first gear 240, second gear 258, third gear 260, fourth gear 266, and fifth gear 268 may be spur or cylindrical gears. Spur gears or straight-cut gears include a cylinder or disk with teeth projecting radially. Though the teeth are not straight-sided, the edge of each tooth is straight and aligned parallel to the axis of rotation. When two of the gears mesh, e.g., the first gear 240 and the third gear 260, if one gear is bigger than the other (the first gear 240 has a diameter that is larger than third gear 260), then a mechanical advantage is produced, with the rotational speeds and the torques of the two gears differing in proportion to their diameters. Since the larger gear is rotating less quickly, its torque is proportionally greater, and in the present example, the torque of the third gear 260 is proportionally greater than the torque of the first gear 240.

Still referring to FIGS. 11-15, the first gear assembly 254 includes the worm gear 212, which is in communication with the wheel gear 210. A worm gear is a species of helical gear, but its helix angle is usually somewhat large (close to 90 degrees) and its body is usually fairly long in the axial direction. As one of ordinary skill in the art would appreciate, use of the worm gear 212 results in a simple and compact way to achieve a high torque, low speed gear ratio between the worm gear 212 and the wheel gear 210. In the present embodiment, the worm gear 212 can always drive the wheel gear 210, but the opposite is not always true. The combination of the worm gear 212 and the wheel gear 210 results in a self-locking system, thus, an advantage is achieved, i.e., when a particular tightness level is desired, the worm gear 212 can be easily used to hold that position. The worm gear 212 can be right or left-handed. For purposes of this disclosure, a worm gear assembly 276 includes the wheel gear 210, the worm gear 212, the first shaft 252, and the first gear 240. The worm gear 212, the first shaft 252, and the first gear 240, may comprise a single material, or may comprise different materials.

The worm gear assembly 276 is in communication with the second gear assembly 256, which is in communication with the third gear assembly 264, which is in communication with the motor gear 272. As a result, when the motor shaft 274 is rotated by the motor 216, the motor gear 272 spins in a clockwise or counterclockwise direction, depending upon whether the wheel gear 210 is intended to be spun clockwise or counterclockwise, i.e., to tighten or loosen the first lace 142 and the second lace 144. The motor gear 272 is in communication with the fifth gear 268, rotation of which causes the third shaft 270 and the fourth gear 266 to rotate. The fourth gear 266 is in communication with the second gear 258, which is fixedly coupled with the third gear 260. As noted above, the second gear 258, the third gear 260, and the second shaft 262 comprise the second gear assembly 256.

Still referring to FIGS. 11-15, the second gear assembly 256 is thereby caused to rotate when the third gear assembly 264 is caused to rotate by the motor gear 272. The third gear 260 of the second gear assembly 256 is in communication with the first gear 240, thus, rotation of the third gear 260 causes rotation of the first gear 240. When the first gear 240 is caused to rotate by the second gear assembly 256, the first gear 240 causes the first shaft 252 to rotate, and the first shaft 252 is fixedly coupled with the worm gear 212. The worm gear 212 is thereby caused to rotate when the first gear 240 is caused to rotate. Since the wheel gear 210 is in communication with the worm gear 212, the wheel gear 210 is also caused to rotate when the first gear assembly 254 is caused to rotate. When the wheel gear 210 rotates, the first lace 142 and the second lace 144 are drawn into the housing, about the wheel gear axis 218 or spool. As noted above, the first gear assembly 254 includes the first gear 240, the first shaft 252, and the worm gear 212. The worm gear assembly 276 includes the first gear assembly 254 and the wheel gear 210. To that end, when the motor gear 272 rotates, the third gear assembly 264 is caused to rotate, which causes the second gear assembly 256 to rotate, which causes the worm gear assembly 276 to rotate.

Figure 12:
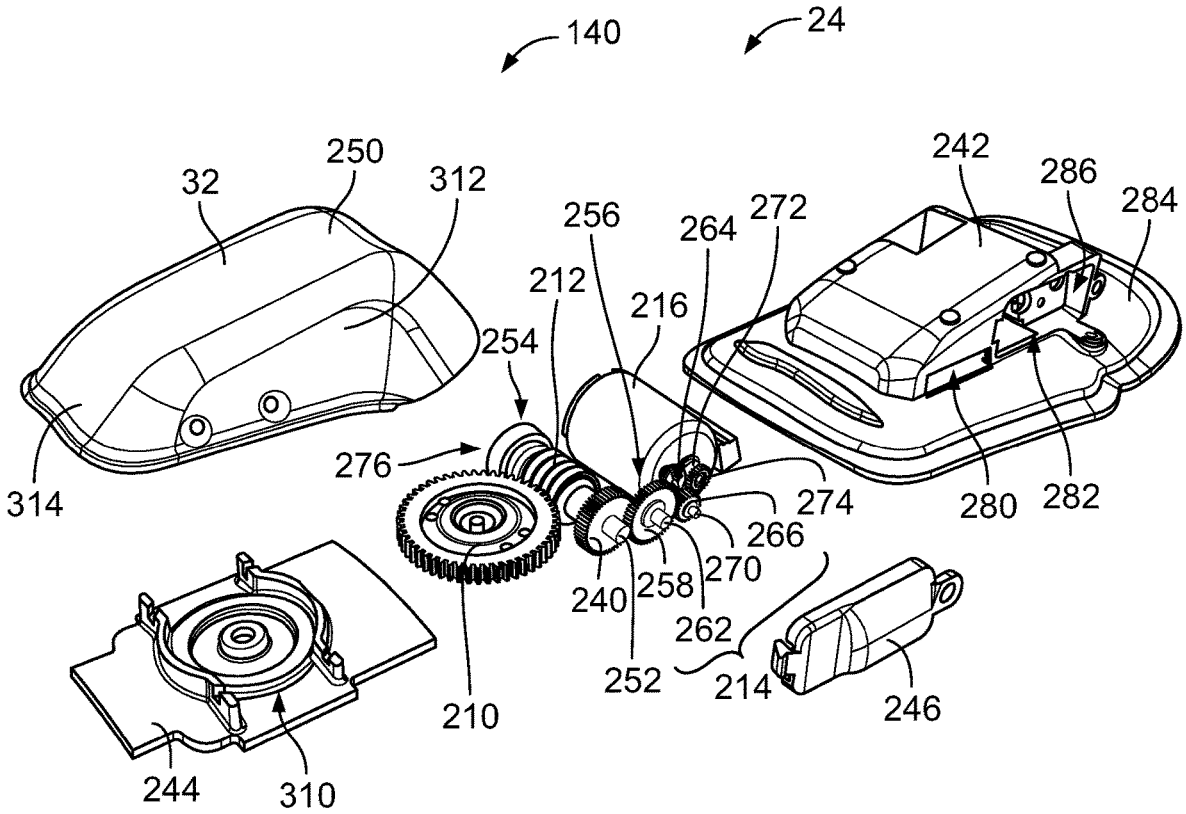
FIG. 12 is another exploded perspective view of the components of the automatic lacing system of FIG. 11.

Referring now to FIGS. 11 and 12, the motor housing 242, the base 244, the gear housing 140, and the top cover 250 of the housing 140 are shown in detail. The motor housing 242 includes lace apertures 280 on left and right (or medial and lateral) sides thereof, and a gear train aperture 282 along the right (or lateral) side thereof. The lace apertures 280 allow the first lace 142 and the second lace 144 to enter into the motor housing 242 unimpeded. The motor housing 242 further includes an outer platform 284 that circumscribes a motor compartment 286. The motor compartment 286 houses all of the gear assemblies 256, 264, 276, and the motor 216. The gear housing 140 includes a plurality of shaft retaining holes 288 (see FIG. 15), which retain the shafts 252, 262, 270 of the gear assemblies 256, 264, 276. The motor compartment 286 generally defines a profile of the housing 140, and the top cover 250 is formed to be seated over the motor housing 242 and gear housing 140.

Figure 15:
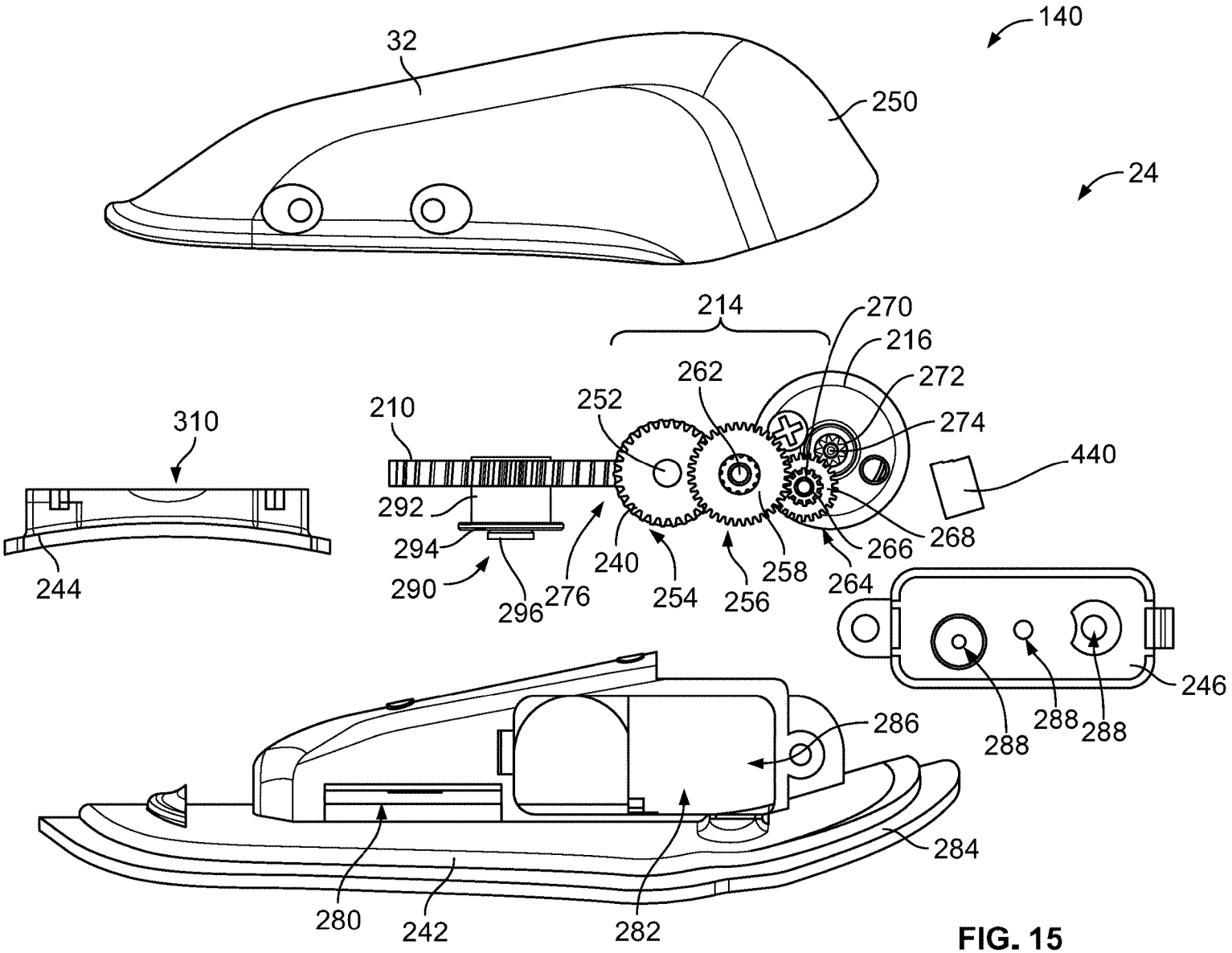
FIG. 15 is an exploded side view of the components of the automatic lacing system of FIG. 11 with a gear housing flipped around for illustrative purposes.

Referring to FIG. 15, the gear housing 140 is shown in greater detail. The gear housing 140 includes the shaft retaining holes 288, which are located so as to allow the shafts 252, 262, 270 to rotate securely in place. A spool 290 is shown depending downward from the wheel gear 210, the spool 290 comprising a cylindrical reel 292 and a lower flange 294, which are both centered around a spool shaft 296. The cylindrical reel 292 may be sized and shaped to retain the first lace 142 and the second lace 144 when the laces are wound around the spool 290 during operation of the lacing system 24. The reel 292 may have varying diameters, but in a preferred embodiment, the reel 292 has a diameter that is smaller than a diameter of the wheel gear 210. In some embodiments, the spool 290 need not include the lower flange 294, thus, the spool may simply comprise a cylindrical structure on which the laces are wound. When the gear 210 is rotated, the first lace 142 and the second lace 144 are wound around the reel 292, and are thereby drawn into the housing 140. The spool 290 may be spun clockwise or counterclockwise, depending on whether the laces 142, 144 are being tightened or loosened. The spool shaft 296 may disposed on or in rotatable communication with the gear base 244.

Figure 13:
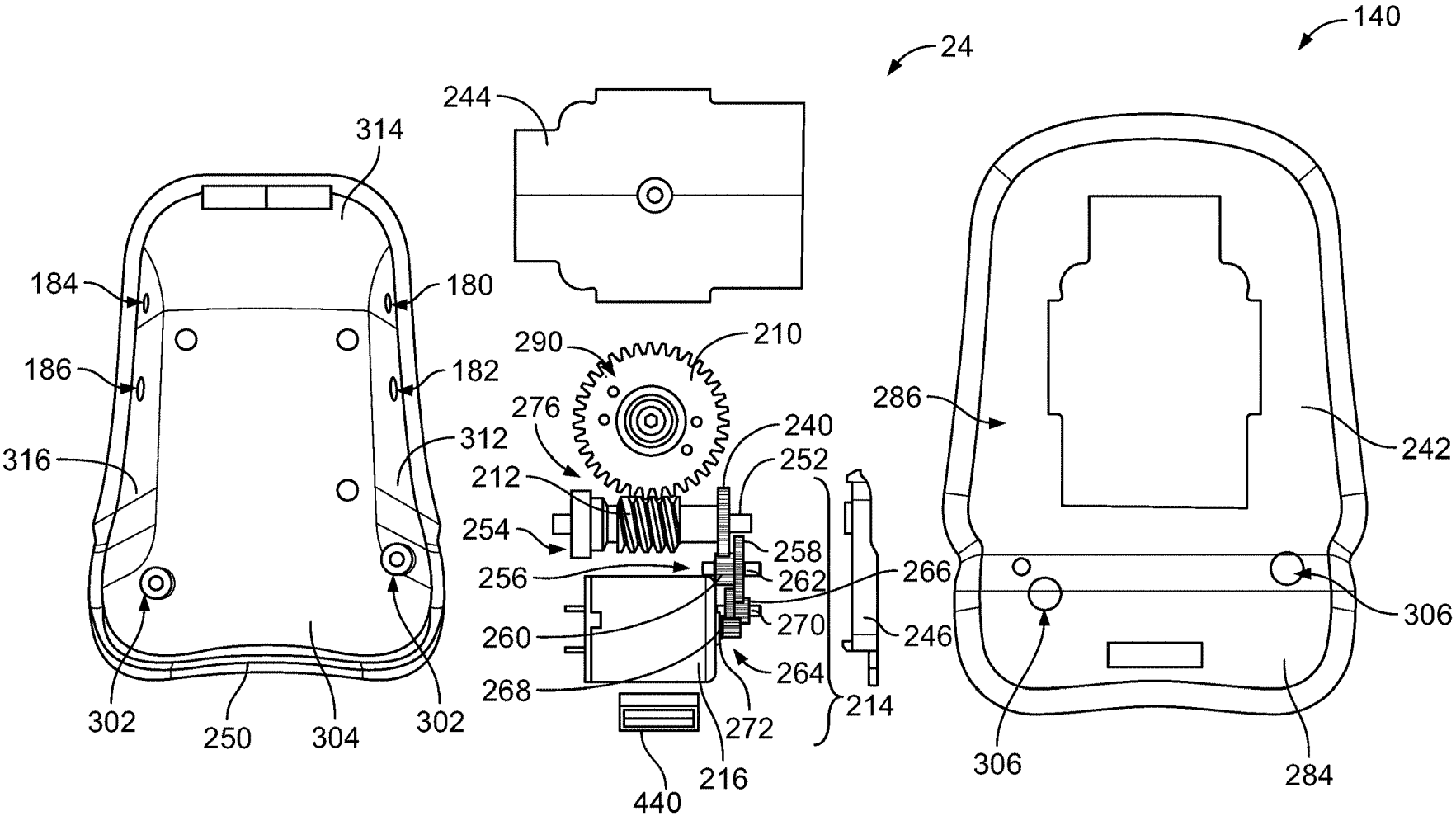
FIG. 13 is an exploded bottom view of the components of the automatic lacing system of FIG. 11.

Referring to FIG. 13, the top cover 250 is shown, the top cover 250 being securable with the outer platform 284 of the motor housing 242 via snap fit. Fastener bores 302 are disposed along an underside 304 of the top cover 250, the bores 302 aligning with screw holes 306 along the motor housing 242. Fasteners, such as bolts or screws, can be inserted through the screw holes 306 and into the fastener bores 302 along the top cover 250 to further secure the top cover 250 with the motor housing 242. The top cover 250 can also be securable to the motor housing 242 via other methods of coupling.

Still referring to FIG. 13, the lace apertures 180, 182, 184, 186 are provided along the sides of the top cover 250. The lace apertures 180, 182, 184, 186 are sized to allow the first lace 142 and the second lace 144 to extend into the housing 140 and out of the housing 140. The laces 142, 144 therefore extend into the lace apertures 180, 182, 184, 186 through the lace holes 280 of the motor housing 242, and are engaged with the apertures 220, 222, 226, 228 of the wheel gear 210, as discussed above. Referring again to FIG. 12, the gear base 244 is shown. The gear base 244 includes a wheel gear compartment 310, which is sized and shaped to receive the wheel gear 210. The wheel gear 210 may be coupled with the gear base 244 via a shaft, or the wheel gear 210 may sit upon a protrusion or shaft that extends from the base 244. The wheel gear 210 is disposed within the wheel gear compartment 310 so as to rotate freely when caused to rotate via the gear train 214.

Figure 14:
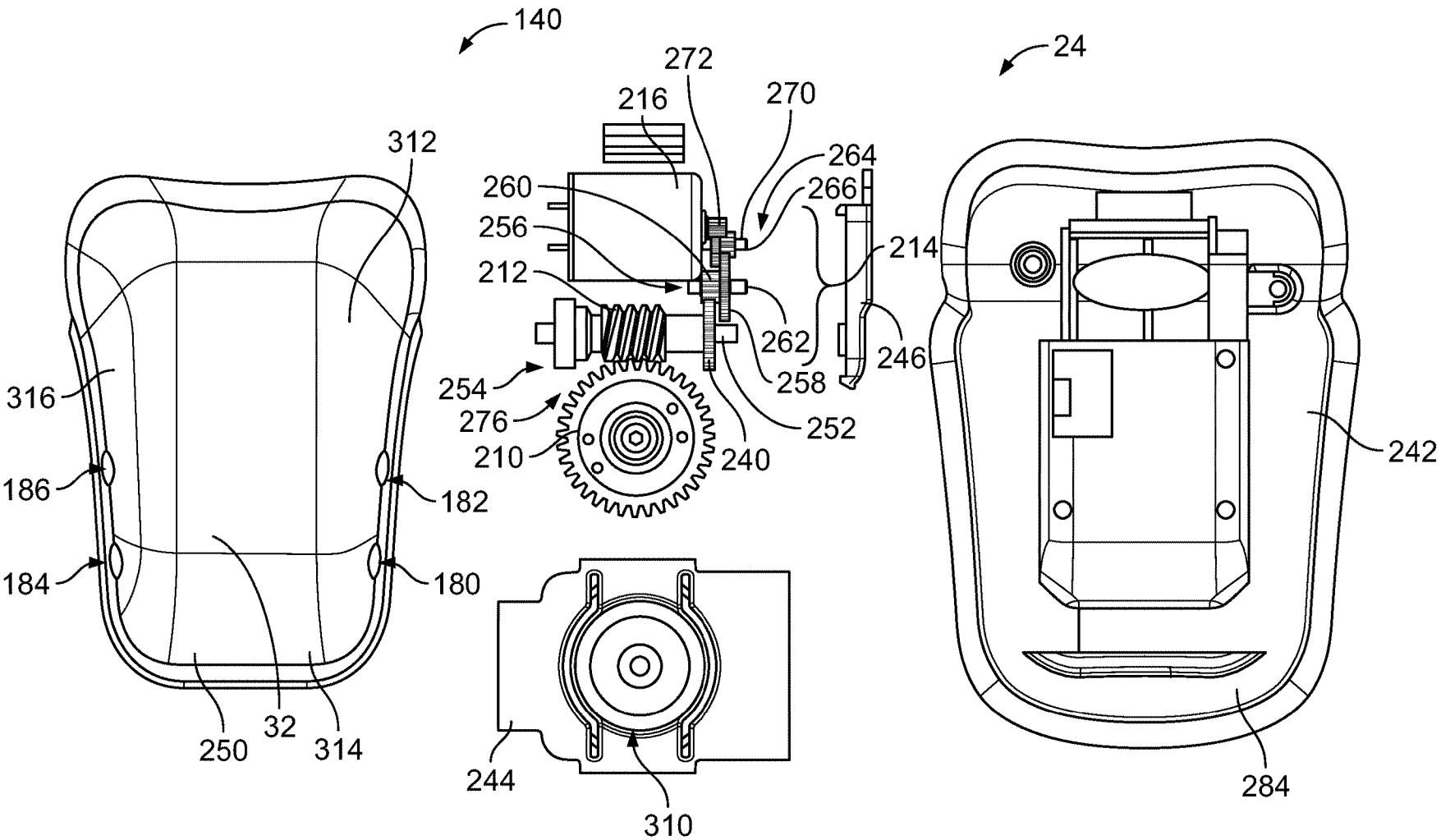
FIG. 14 is an exploded top view of the components of the automatic lacing system of FIG. 11.

Referring to FIG. 14, the top cover 250 includes the panel 32, a lateral side 312, a front side 314, and a medial side 316. The panel 32 and the sides 312, 314, 316 of the top cover 250 of the housing 140 are intended to completely cover the electronics and sensors of the automatic lacing system 24. As will be discussed in greater detail below, one or more LEDs are disposed under the lateral side 312, the front side 314, and the medial side 316 of the top cover 250. While the top cover 250 may be any color, including the color black, in a preferred embodiment, light can be seen through the top cover 250 when one or more light sources are activated within the housing 140. Specific activation of the light sources is discussed with respect to FIGS. 18A-18M.

Figure 16:
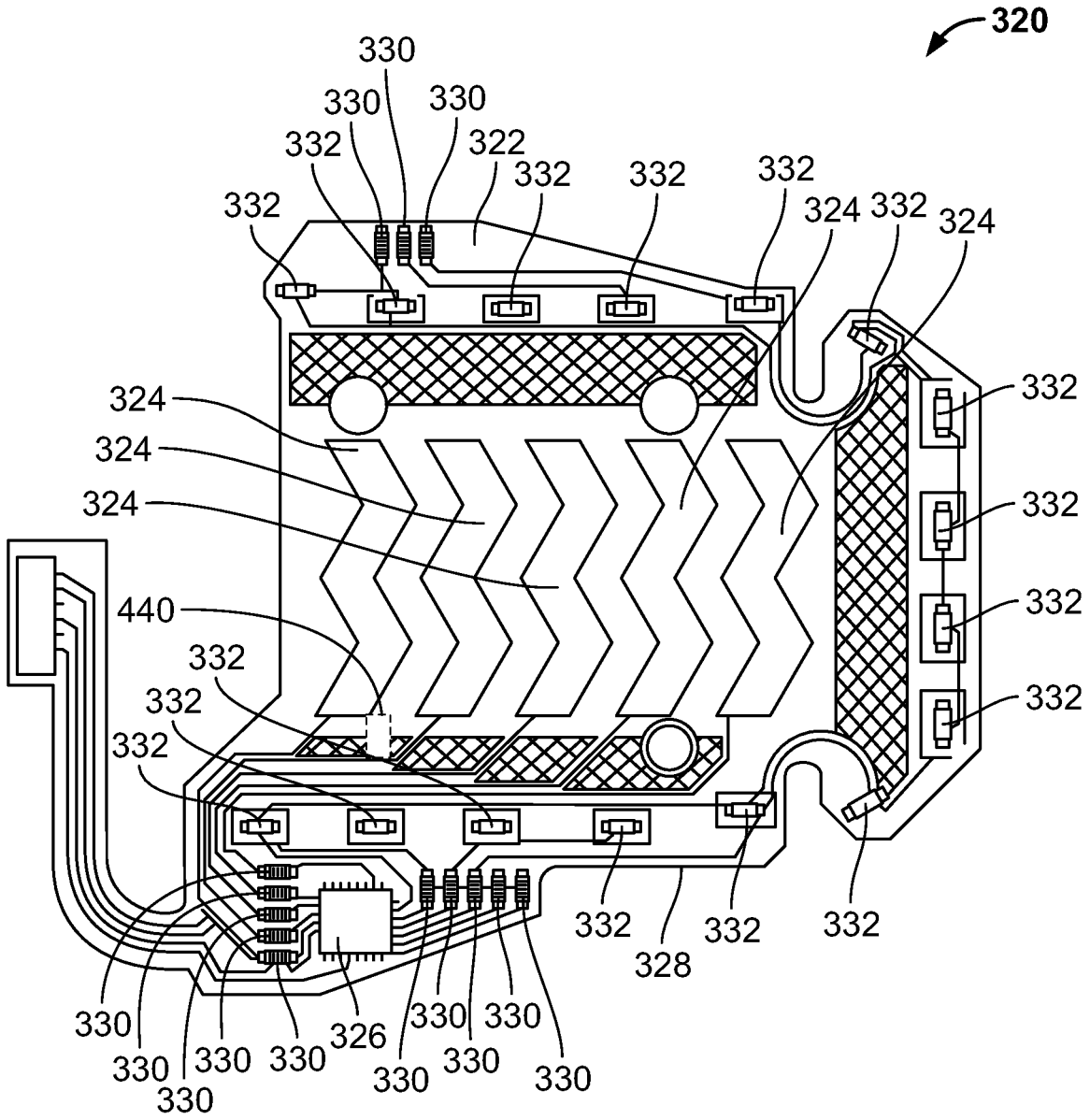
FIG. 16 is a top plan view of a flexible printed circuit that is configured to be disposed within the automatic lacing system of FIGS. 11-15.

A sensor system 320 is shown in FIG. 16, the sensor system 320 being configured to be disposed between the top cover 250 and the motor housing 242 of the housing 140. The sensor system 320 comprises a flexible circuit 322, which includes a plurality of swipe sensors 324 disposed therealong. The swipe sensors 324 are in the shape of repeating chevrons or the letter "M," however, the swipe sensors 324 may comprise alternative shapes, such as ovals, squares, rectangles, circles, triangles, or other polygonal shapes. The swipe sensors 324 are responsive to tactile interaction with the panel 32 of the housing 140 by a user. The sensor system 320 includes a plurality of layers, which may comprise varying circuitry, sensors, LEDs, etc. The sensor system 320 also includes a first controller or microcontroller 326, which is shown disposed along a medial or left side 328 of the sensor system 320. A plurality of resistors 330 are disposed along the flexible circuit 322. Further a plurality of Light Emitting Diodes, or LEDs 332, are provided along a periphery of the flexible circuit 322. The plurality of LEDs 332 are disposed along the flexible circuit 322 so that the LEDs 332 are aligned with the lateral side 312, the front side 314, and the medial side 316 of the top cover 250 when fully assembled.

As noted above, the flexible circuit 322 may be disposed between the top cover 250 and the motor housing 242. The flexible circuit 322 includes the plurality of swipe sensors 324 which, in some embodiments, may also be caused to flash or light up in response to a signal sent by one or more controllers, including the microcontroller 326. In some embodiments, additional LEDs are provided along the panel 32, or along another portion of the housing 140. The flexible circuit 322 may be disposed in a reverse configuration, as noted above, in light of the differences between the left shoe 40 and the right shoe 42. When the automatic lacing system 24 is assembled, the swipe sensors 324 of the flexible circuit 322 are disposed beneath the panel 32 of the top cover 250 of the housing 140. As a result, the plurality of LEDs 332 are disposed along and adjacent the sides of the top cover 250. The top cover 250 may have portions that are transparent or translucent to allow the light emitted from the LEDs 332 to shine through.

Still referring to FIG. 16, in the present embodiment, the flexible circuit 322 includes 16 of the LEDs 332, which are positioned around a periphery of the motor compartment 286 and under the top cover 250 when the lacing system 24 is assembled. The LEDs 332 provide light-based feedback to a user. In particular, the LEDs 332 provide visual cues that indicate a tightness level of the laces 142, 144 and/or an energy level of a battery 340 (see FIGS. 20, 22, and 24), e.g., a low power warning, as well as visual cues that indicate when the battery 340 is being charged. For example, none of the LEDs 332 may be illuminated when the laces 142, 144 are in an open configuration, four of the LEDs 332 are illuminated when the automatic lacing system 24 is in a first state, nine of the LEDs 332 are illuminated when the automatic lacing system 24 is in a second state (which is tighter than the first state), and/or sixteen of the LEDs 332 are illuminated when the automatic lacing system 24 is in a third state (which is tighter than the first state and the second state). As noted above, LEDs 332 are positioned under the top cover 250 of the housing 140. The LEDs may also be disposed in such a way as to light up a variety of symbols along or within the top cover 250, such as stars, battery charge information, etc., when the battery is in a low power mode, or a lightning symbol when the battery is charging, for example.

Figure 17A:
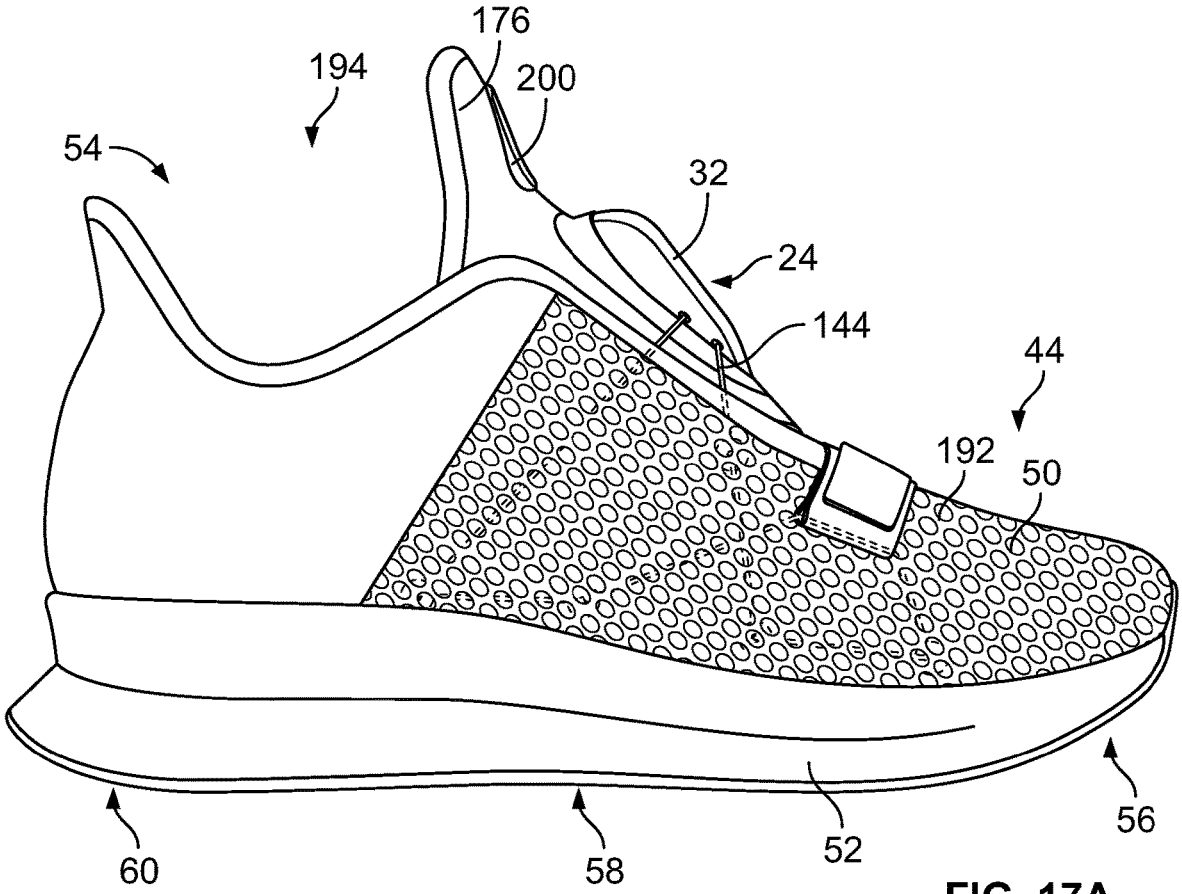
FIG. 17A is a side view of one of the shoes of FIG. 2 in a loosened configuration.
Figure 17B:
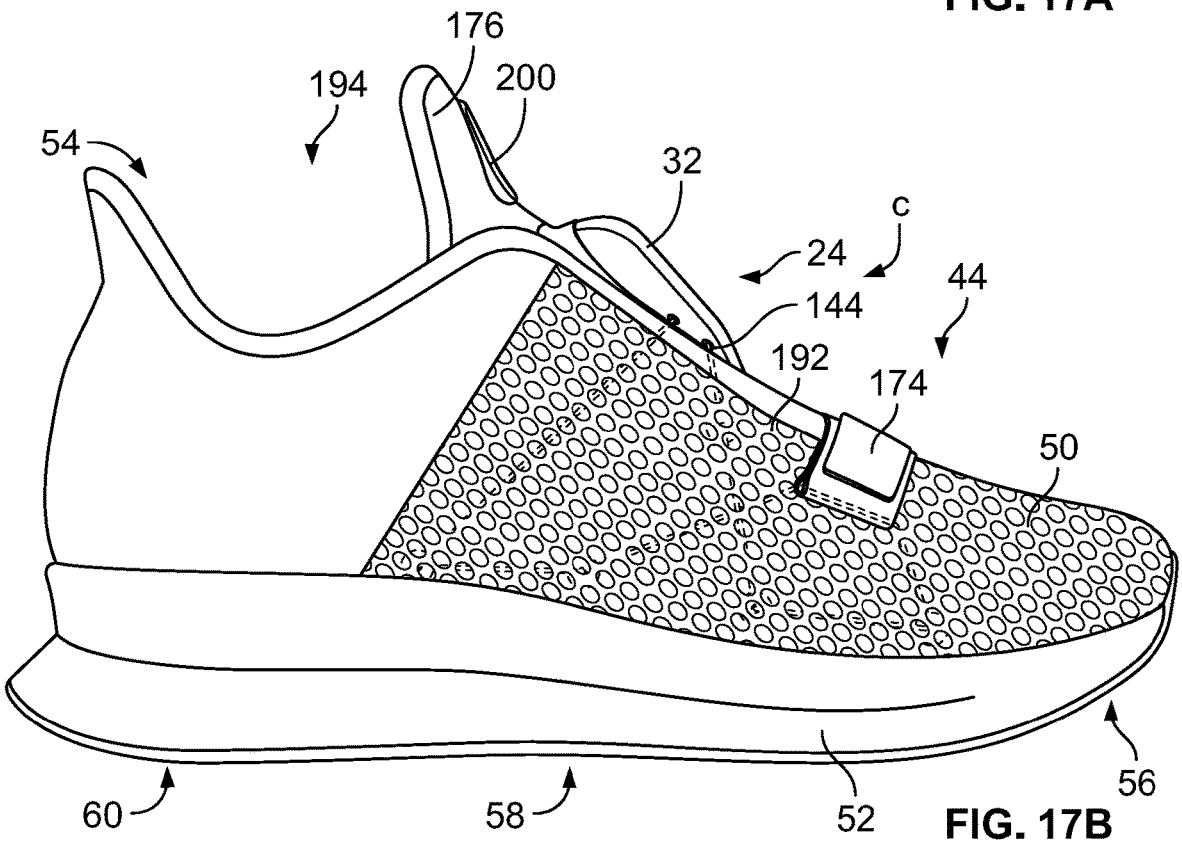
FIG. 17B is a side view of one of the shoes of FIG. 2 in a tightened configuration.

Referring now to FIGS. 17A and 17B, side views of the shoe 44 are shown in a loosened configuration, and a tightened configuration, respectively. Referring specifically to FIG. 17A, in the loosened configuration, the first lace 142 and the second lace 144 are not taut, but are laced through all of the first eyelets 146 and the second eyelets 148, respectively. In some embodiments, the first lace 142 and the second lace 144 have a slight amount of pretensioning to ensure a more comfortable instep if the shoe is in an untightened mode. To that end, the shoe 44 as shown in FIG. 17A achieves a more comfortable instep position, which may be utilized by a user in certain circumstances when the shoe 44 is being worn. Referring back to FIG. 9A, in the loosened configuration, the first lace 142 and the second lace 144 may be disposed as shown in this detail view, where the wheel gear 210 is not rotated in such a way as to cause the first lace 142 or the second lace 144 to be tightened. While the wheel gear 210 may be disposed in alternative configurations in the loosened state, the wheel gear 210 is preferably disposed in a similar fashion as shown in FIG. 9A in the loosened configuration. In a preferred embodiment, a line drawn between the first aperture 220 and the third aperture 226 of the wheel gear 210 is parallel with an axis of the first shaft 252 in the loosened configuration.

Referring now to FIG. 17B, when the automatic lacing system 24 is commanded to tighten the first lace 142 and the second lace 144, the tongue 176, and, therefore, the housing 140 are drawn downward in a direction of the arrow C, thereby achieving a first tightened configuration. There may be any number of tightened configurations, based on levels of tightness that can be achieved based on user inputs or pre-set settings of the automatic lacing system 24. The first tightened configuration may have a first level of tightness, and a second tightened configuration may have a second level of tightness that is greater than the first level of tightness. Referring again to FIG. 9A, the first level of tightness may be achieved when the wheel gear 210 is rotated by about 15 degrees, or about 30 degrees, or about 45 degrees, or about 60 degrees, or about 90 degrees. Each subsequent level of tightness may be achieved by rotating the wheel gear 210 by another amount, which may be about 15 degrees, or about 30 degrees, or about 45 degrees, or about 60 degrees, or about 90 degrees.

Once the shoe 44 has achieved the first tightened configuration, the shoe 44 may be returned to the loosened configuration by rotating the wheel gear 210 in a reverse direction, i.e., if the wheel gear 210 is tightened by rotating in the direction of arrow A (see FIG. 9A), then the wheel gear 210 is loosened by being rotated in the direction of arrow B. To that end, the shoe 44 shown in FIG. 17A, which is shown in a loosened configuration, may be adjusted into the tightened configuration as shown in FIG. 17B, and may subsequently be returned to the original, loosened configuration shown in FIG. 17A. The laces 142, 144 of the shoe 44 may be tightened or loosened any number of times and in any number of increments. Certain tightening/loosening sequences are described in the present application, however, the present disclosure is not intended to be limiting.

Referring now to FIGS. 18A-18M, and as previously noted, the automatic lacing system 24 may be manipulated by a user using two methods: (1) physical contact with the panel 32 of the housing 140, i.e., user interaction with the swipe sensors 324; and (2) using the wireless device 30. The first method of manipulation, i.e., physical adjustment, will be discussed with in reference to FIGS. 18A-18M. To that end, the automatic lacing system 24 can have predetermined levels of tightness, which includes an open configuration, wherein the laces 142, 144 are loosened to a predetermined tightness, and a closed configuration, wherein the laces 142, 144 are tightened to a predetermined tightness. In practice, a user may be able to swipe down on the panel 32 to tighten the laces 142, 144 to the predetermined tightness of the closed configuration, or swipe up on the panel 32 to loosen the laces 142, 144 to the predetermined tightness of the open state. Further, a user can adjust the predetermined tightness of the laces of the open and closed states by tapping the upper end of the panel 32 to decrease the tightness of either the closed configuration or the open configuration, or by tapping the bottom end of the panel 32 to increase the tightness of either the closed configuration or the open configuration. In addition, a user can reset the aforementioned predetermined levels by applying a pressure to the panel 32 for a predetermined amount of time, e.g., 10 seconds, the user can "wake up" or activate the automatic lacing system 24 by tapping the panel 32, or the user can connect/pair the wireless device 30 by applying a pressure to the top surface for a second predetermined amount of time, e.g., 1-2 seconds, as discussed in greater detail hereinafter below.

FIGS. 18A-18M depict schematic illustrations of swipe commands along the control/display panel 32 in various states and show various responses to one or more input commands. The plurality of LEDs 332 are shown illuminated in various configurations based on the state of the automatic lacing system 24. For example, when the article of footwear 44 is in a loose configuration, none of the LEDs 332 are activated. When the article of footwear 44 is in a first tightness level configuration, a bottom row of the LEDs 332 is illuminated. When the article of footwear 44 is in a second tightness level configuration, the bottom row of the LEDs 332 and side columns of the LEDs 332 are illuminated. In the figures, a first circle 342 indicates a touch point along the panel 32 by a user, and an arrow 344 indicates a swipe direction to a second circle 346, which indicates another touch point along the panel 32.

Figures 18A, 18B, 18C, 18D, 18E, 18F, 18G, 18H, 18I, 18J, 18K, 18L, 18M:
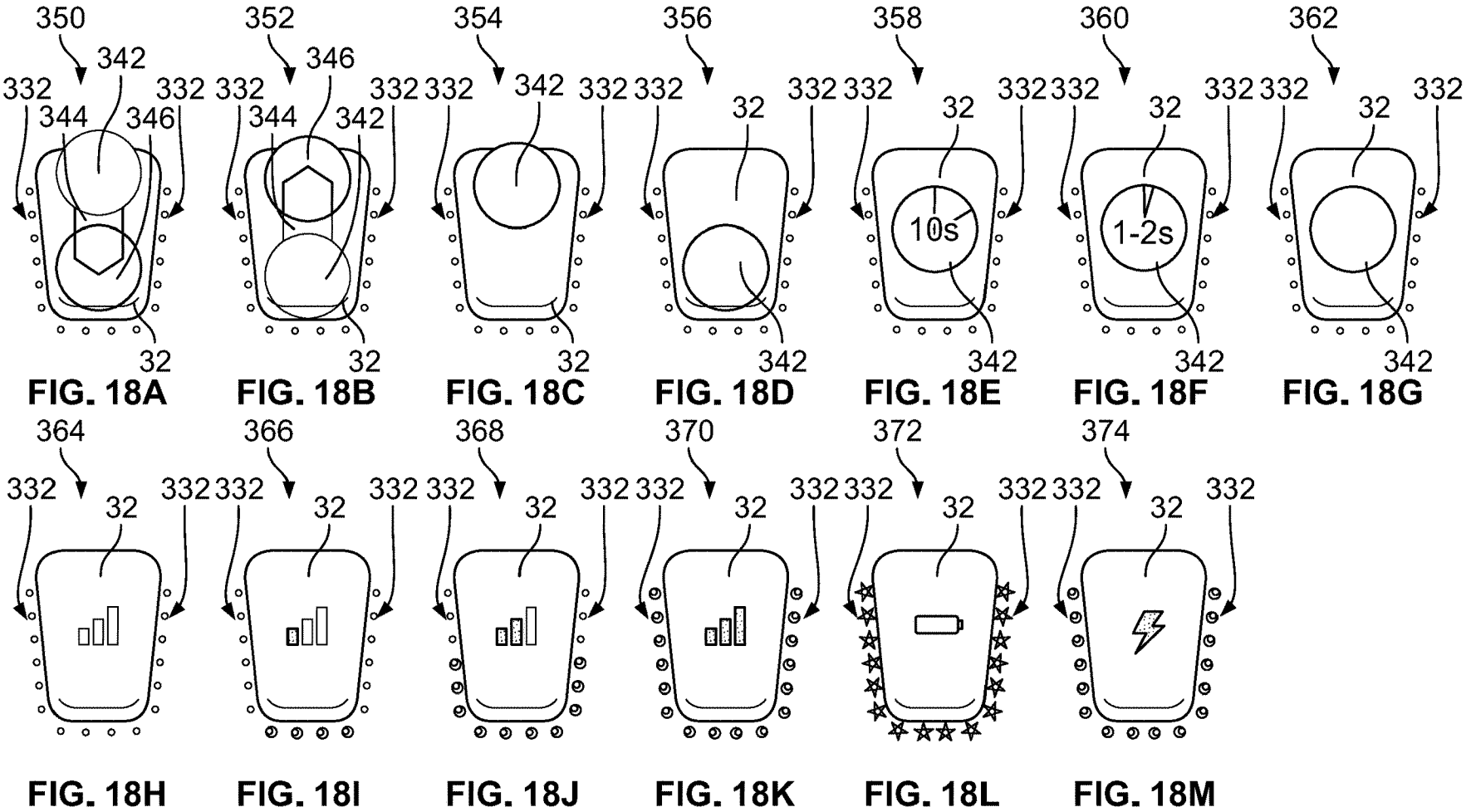
FIGS. 18A-18M depict top views of a control/display panel of the automatic lacing system in various states and showing various responses to one or more input commands or states.

The various swipe commands will now be described. Referring specifically to FIG. 18A, a first or closing swipe command 350 is shown. To effectuate the closing swipe command 350, a user touches the panel 32 at the first circle 342 and swipes down in the direction of the arrow 344 toward the second circle 346. The closing swipe command 350 may fully tighten the shoes 22. Referring to FIG. 18B, a second or opening swipe command 352 is shown. To effectuate the opening swipe command 352, a user touches the panel 32 at the first circle 342 and swipes up in the direction of the arrow 344 toward the second circle 346. The opening swipe command 352 may fully loosen the shoes 22. Referring to FIG. 18C, an adjust/loosen command 354 is shown. To effectuate the adjust/loosen command 354, a user touches the panel 32 at the first circle 342. The adjust/loosen command 354 incrementally loosens the laces of the automatic lacing system 24. Referring to FIG. 18D, an adjust/tighten command 356 is shown. To effectuate the adjust/tighten command 356, a user touches the panel 32 at the first circle 342. The adjust/tighten command 356 incrementally tightens the laces of the automatic lacing system 24.

Referring now to FIG. 18E, a reset command 358 is shown. To effectuate the reset command 358, a user touches or presses the panel 32 for 10 seconds at the first circle 342. The reset command 358 may return the automatic lacing system 24 to factory settings, or another type of null setting. Referring to FIG. 18F, a connect/pair command 360 is shown. To effectuate the connect/pair command 360, a user depresses the panel 32 at the first circle 342 for one to two seconds. The connect/pair command 360 may be used to connect or pair the shoes 22 with the electronic device 30 via Bluetooth®, i.e., a type of short-range wireless communication. Referring to FIG. 18G, a wake up command 362 is shown. To effectuate the wake up command 362, a user touches the panel 32 at the first circle 342. The wake up command 362 may turn on the automatic lacing system 24.

Referring now to FIGS. 18H-18K, various illumination configurations of the LEDs 332 are shown, the illumination configurations representing an open configuration 364, a first closed configuration 366, a second closed configuration 368, and a third closed configuration 370, respectively. In the open configuration 364, none of the LEDs 332 are illuminated. In the first closed configuration 366, four of the LEDs 332 along the bottom row of LEDs 332 are illuminated. In the second closed configuration 368, four of the LEDs 332 along the bottom row and six of the LEDs 332 along each of the side columns of the panel 32 are illuminated. In the third closed configuration 370, all of the LEDs 332 are illuminated. As one may appreciate, the open configuration 364 may indicate that the automatic lacing system 24 is in a fully open state, while the third closed configuration 370 may indicate that the automatic lacing system 24 is in a fully closed state. The first closed configuration 366 and the second closed configuration 368 may be intermediate states of closure between the fully open state and the fully closed state.

Referring to FIG. 18L, a low battery state 372 is shown. In the low battery state 372, all of the LEDs 332 may flash or blink to indicate to a user that the automatic lacing system 24 is running low on battery. In some embodiments, the automatic lacing system 24 may enter the low battery state 372 when the battery has run down to about 5% of charge. In some embodiments, if the battery runs under 3% of charge, the automatic lacing system 24 will loosen the laces 142, 144 to the open configuration 364 to allow a user to remove the shoes 22. Referring now to FIG. 18M, a charging state 374 is shown. In the charging state 374, all of the LEDs 332 are illuminated, and may display a different color than the color of the open/closed states 364, 366, 368, 370. While the above configurations and states have been described with respect to varying illumination configurations of the LEDs 332, alternative variations are contemplated. For example, in some configurations or states, the LEDs 332 may flash, turn a different color, blink, or blink one at a time to indicate alternative states or configurations.

Figure 19:
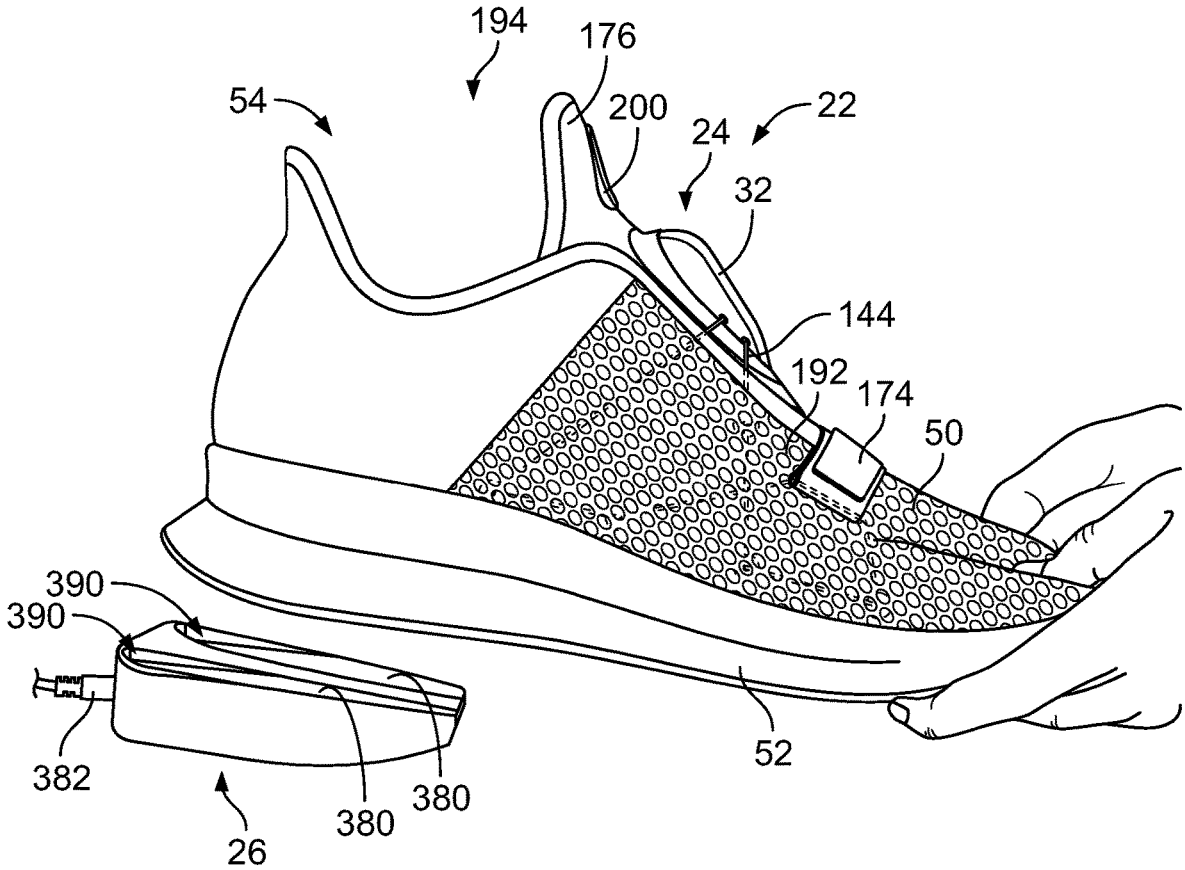
FIG. 19 is a side view of the pair of shoes and charger of FIG. 1, with the pair of shoes being placed onto the charger for charging.

FIG. 19 is a side view of the pair of shoes and charger of FIG. 1, with the pair of shoes being placed onto the charger 26 to begin charging or to enter the charging state 374. As shown in the figure, a user may place the heel regions 60 of the shoes 22 onto heel receiving docks 380 of the charger 26. The heel receiving docks 380 may be circular, or otherwise elliptically-shaped, and may be generally formed to receive the heel regions 60 of the shoes 22. The charger 26 also includes a detachable power cord 382 that may be plugged into a charging source, such as an electrical socket within a wall (not shown). As discussed in greater detail below, the charger 26 includes inductive coils (not shown), which provide electric charge to shoe coils 384 (see FIGS. 23A-C) that are disposed within the shoes 22. The shoe coils 384 are electrically coupled to the batteries 340 that are disposed within the sole structures 52 of the shoes 22. As also noted herein, the battery 340 of the article of footwear 44 can be charged either wirelessly, or by removing the battery 340 from the article of footwear 44 and by connecting the battery 340 directly to a power source. In some embodiments, the act of the user placing the shoes 22 along the charger 26 activates a power source to transmit inductive power to the coils positioned within the sole structures 52 of the shoes 22 and, thereby, provide power to the battery.

Figure 20:
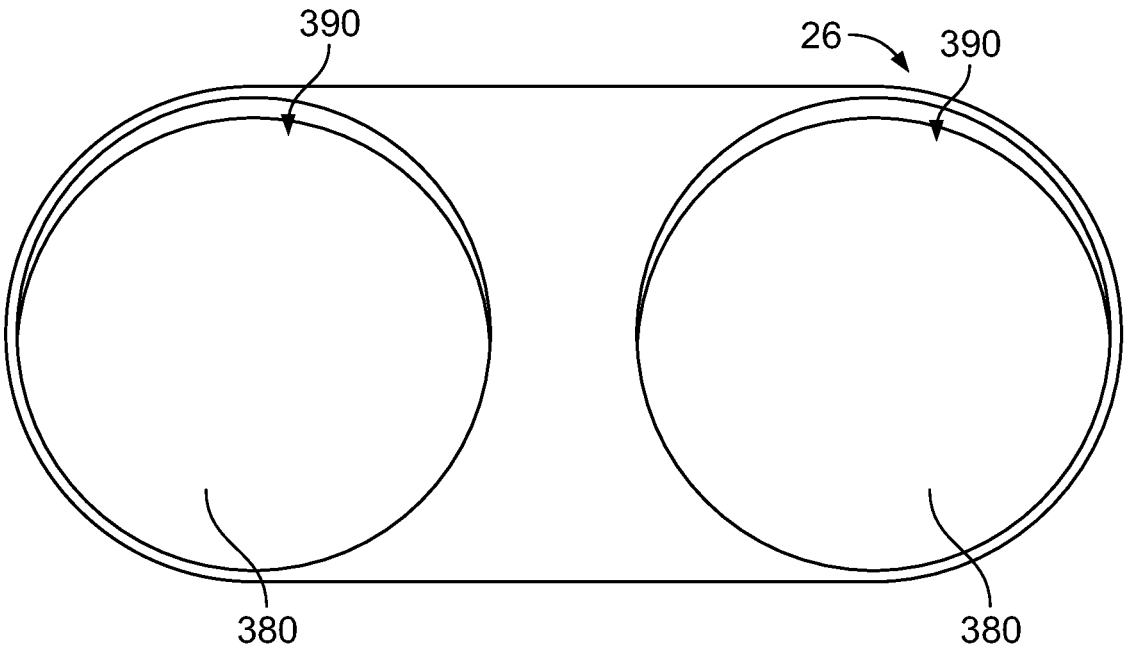
FIG. 20 is a top view of the charger of FIG. 1 with a power cord disconnected therefrom.
Figure 21:
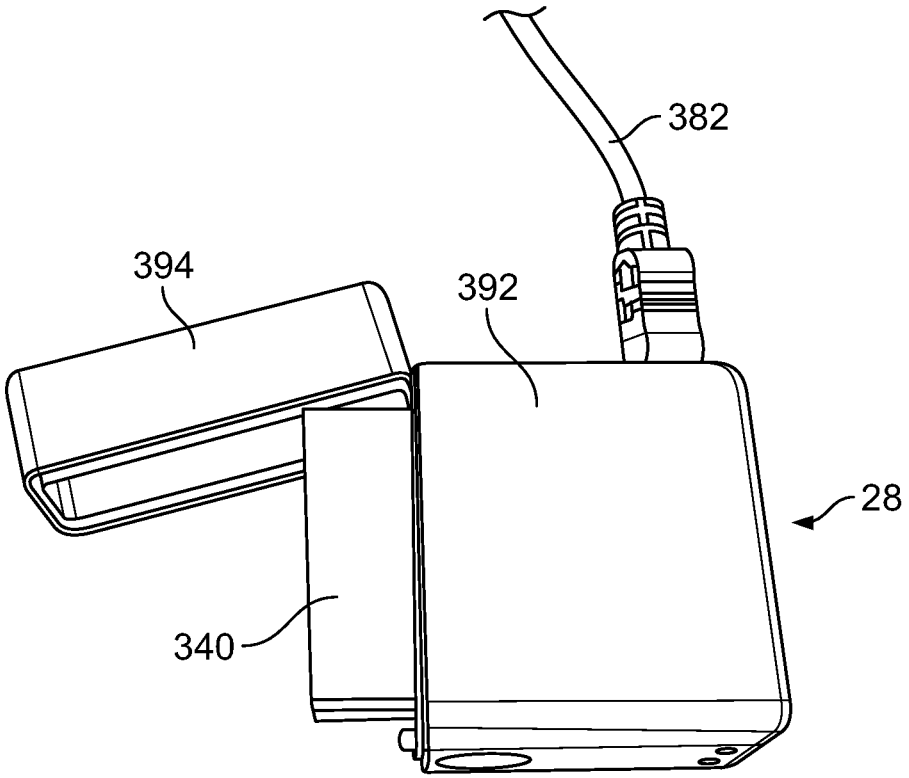
FIG. 21 is a perspective view of the battery cartridge of FIG. 1 in an open configuration, with a battery disposed within the battery cartridge.

FIG. 20 is a top view of the charger 26 without the power cord 382 coupled thereto. As shown in FIG. 20, the charger 26 includes two of the heel receiving docks 380, which are generally circular and include recessed portions 390 that are capable of receiving and retaining the heel regions 60 of the shoes 22. FIG. 21 is a perspective view of the battery cartridge 28 of FIG. 1 shown in an open configuration and retaining the battery 340. The battery cartridge 28 is shown connected with the power cord 382, which may be the same power cord as shown in FIG. 19, or may be a different power cord. The power cord 382 may be fixedly coupled with the battery cartridge 28, or the power cord 382 may be removably coupled with the battery cartridge 28. The battery cartridge 28 includes a base 392 and a cover 394 that is pivotally connected with the base 392. When the battery 340 is inserted into the base 392, the cover 394 may be closed over the battery 340 to completely secure the battery 340 within the battery cartridge 28.

Figure 22:
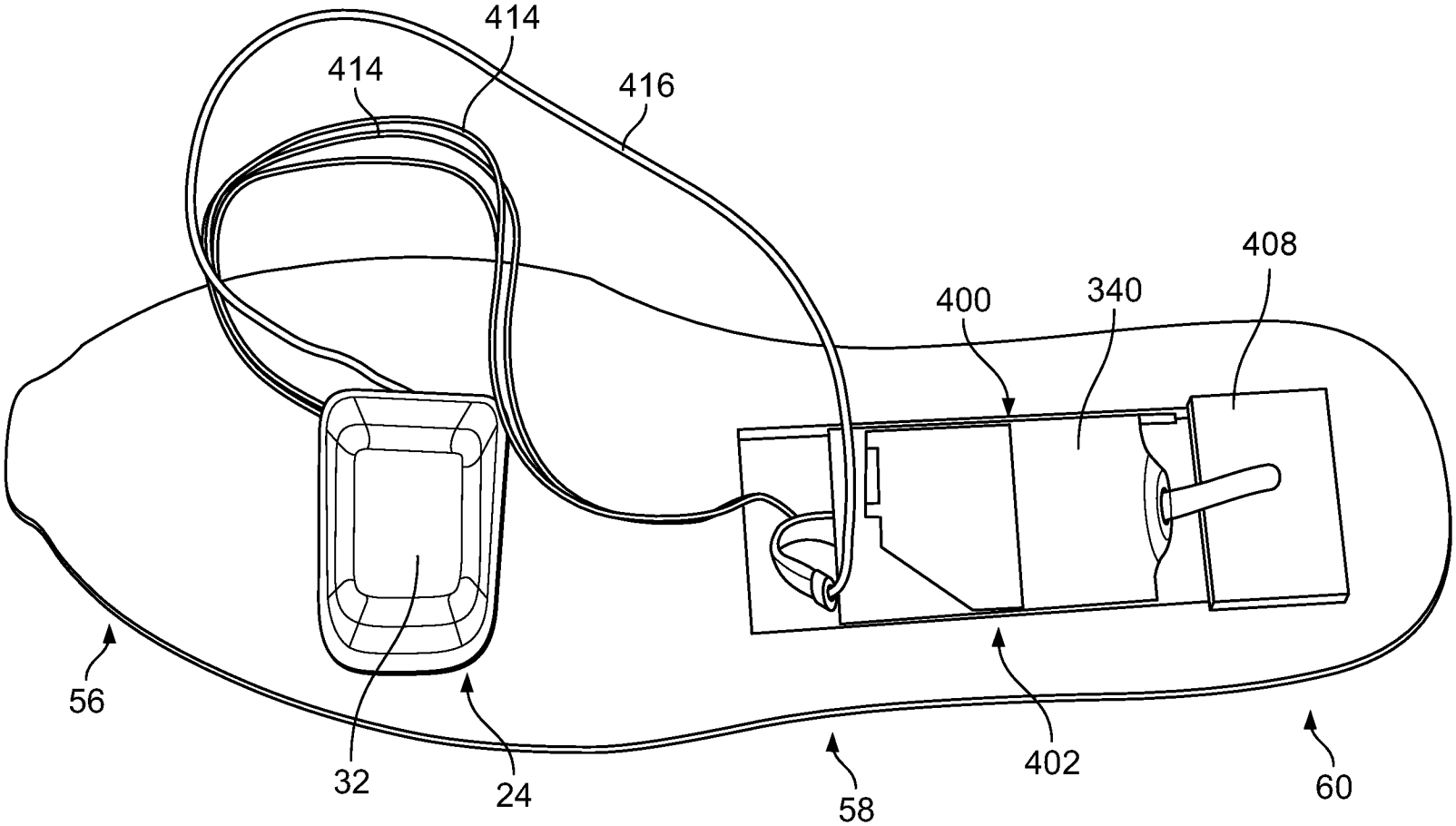
FIG. 22 is a top view of a sole of the shoe of FIG. 2 and a battery of the automatic lacing system of FIG. 7.

Referring now to FIG. 22, the sole structure 52 of the shoe 44 is shown with the upper 50 having been removed. A battery case 400 is shown disposed within a battery cavity 402 that is defined within the sole structure 52. The battery cavity 402 may be shaped to fittingly receive the battery case 400, and is generally disposed centrally between the lateral side 80 and the medial side 82 of the sole structure 52. The battery cavity 402 does not extend all the way through the sole structure 52. The battery case 400 is shown, which includes the battery 340, a coil housing 408, which encases the charging coil 384 (see FIGS. 23A-23C), a control PCB or second controller 410 (see FIG. 26) and a charging PCB or third controller 412 (see schematic of FIG. 33). Referring to FIG. 22, the battery case 400 is electrically coupled with the housing 140 via at least one motor wire 414, which is/are electrically coupled with the motor 216, and a control wire 416, which is electrically coupled to the flexible circuit 322 disposed within the housing 140. As will be described in greater detail hereinafter below, the motor wires 414 couple the control PCB 410 with the motor 216, and the control wire 416 (which may comprise a number of wires) couples the control PCB 410 with the flexible circuit 322, including the electrical components disposed thereon.

Figure 23B:
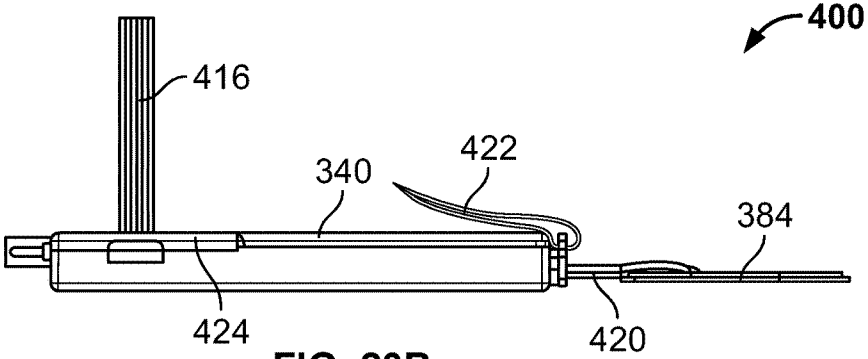
FIGS. 23A-C depict top, side, and perspective views of a battery case of the automatic lacing system.
Figure 23C:
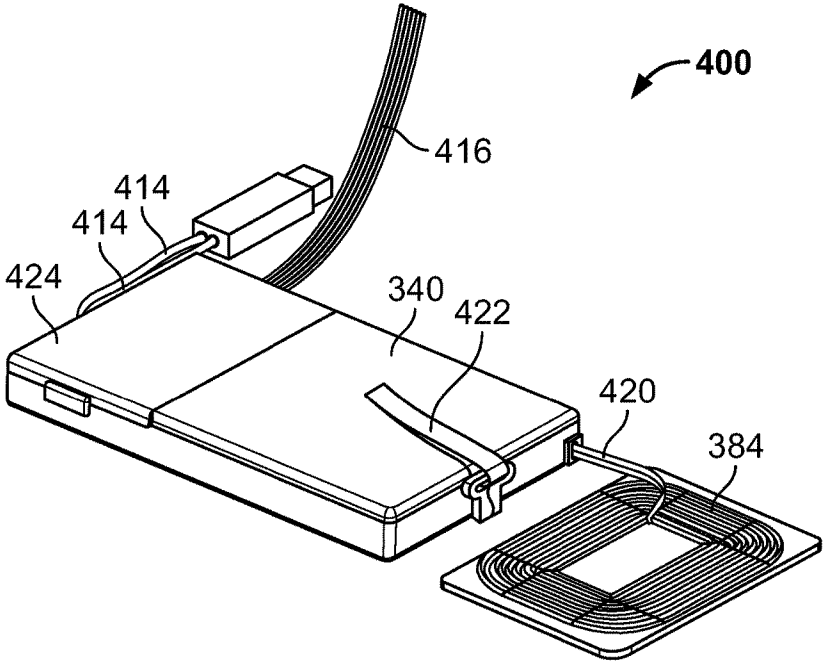
Figure 23A:
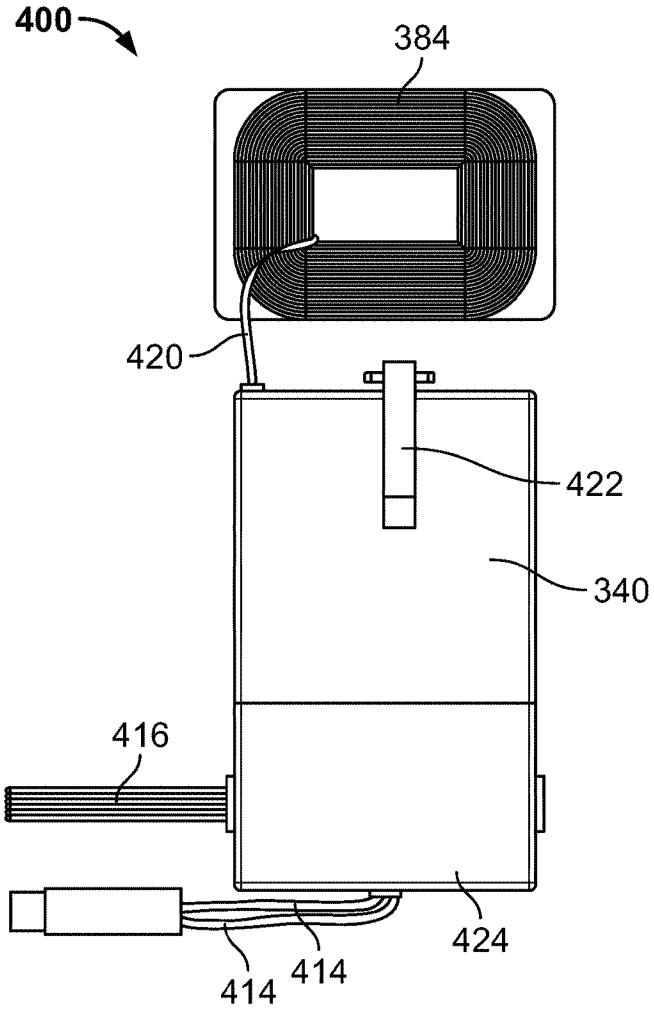

FIGS. 23A-23C depict the battery case 400 without the coil housing 408. In some embodiments, the coil housing 408 is not included. Referring specifically to FIG. 23A, the shoe coil 384 is shown in greater detail. The coil 384 is electrically coupled with the battery 340 via a charging wire 420. During charging, the coil 384 is aligned with the coil (not shown) within the charger 26, and is capable of charging the battery 340 through wireless or inductive charging. The battery 340 is shown disposed within the battery case 400, the battery 340 being removable through the use of a battery removal strap 422 disposed at an end of the battery 340. The battery case 400 further includes a controller housing 424, which is disposed at an opposing end of the battery case 400. The controller housing 424 may provide access to the control PCB 410 and/or the charging PCB 412. The battery case 400 may comprise alternative forms so as to efficiently and securely be retained within the sole structure 52 of the shoe 44.

Figure 24:
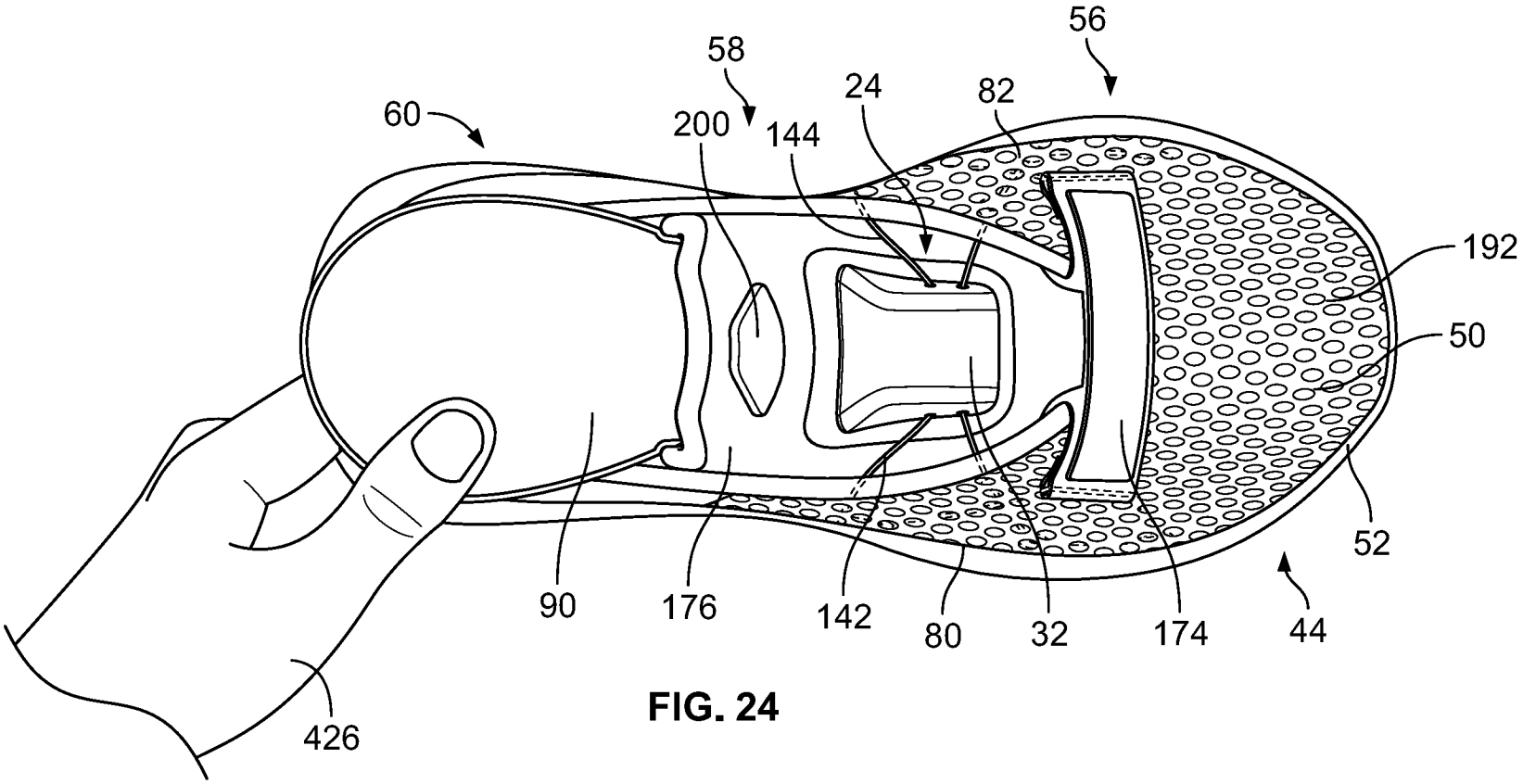
FIG. 24 is a top view of one of the shoes of FIG. 2 showing a step of removing an insole for access to a battery that is disposed within the sole or midsole.
Figure 25:
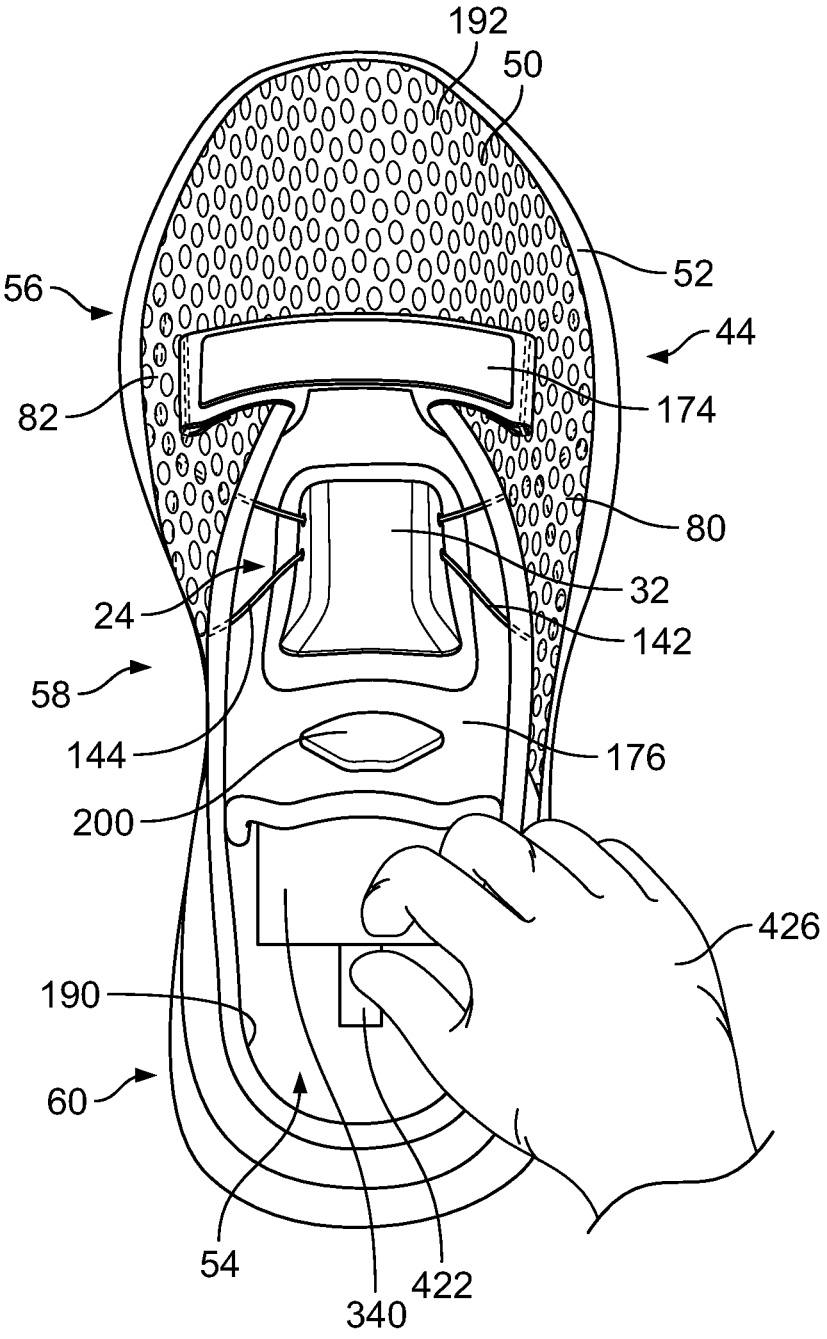
FIG. 25 is a top view of the shoe of FIG. 24 showing a step of removing the battery that is disposed within the sole or midsole.

FIGS. 24 and 25 depict illustrative views of the steps of removing the battery 340 from the sole structure 52. Referring to FIG. 24, a user 426 is shown removing the insole 90 from the interior cavity 54 of the shoe 44. The insole 90 may be secured within the shoe 44 as known to those of ordinary skill in the art. Once the insole 90 has been removed, and referring specifically to FIG. 25, the user 426 is able to access the removal strap 422 of the battery 340. The user 426 can then grasp the strap 422 and remove the battery 340 from the battery case 400. The user 426 can then place the battery 340 into the battery cartridge 28, as discussed above. Additional steps of removal and/or charging may be included in addition to the steps disclosed herein. In some embodiments, the strap 422 is not included, and a finger groove (not shown) is provided within the battery case 400 so as to allow a user to grasp the battery 340 and pull it out manually.

Figure 26:
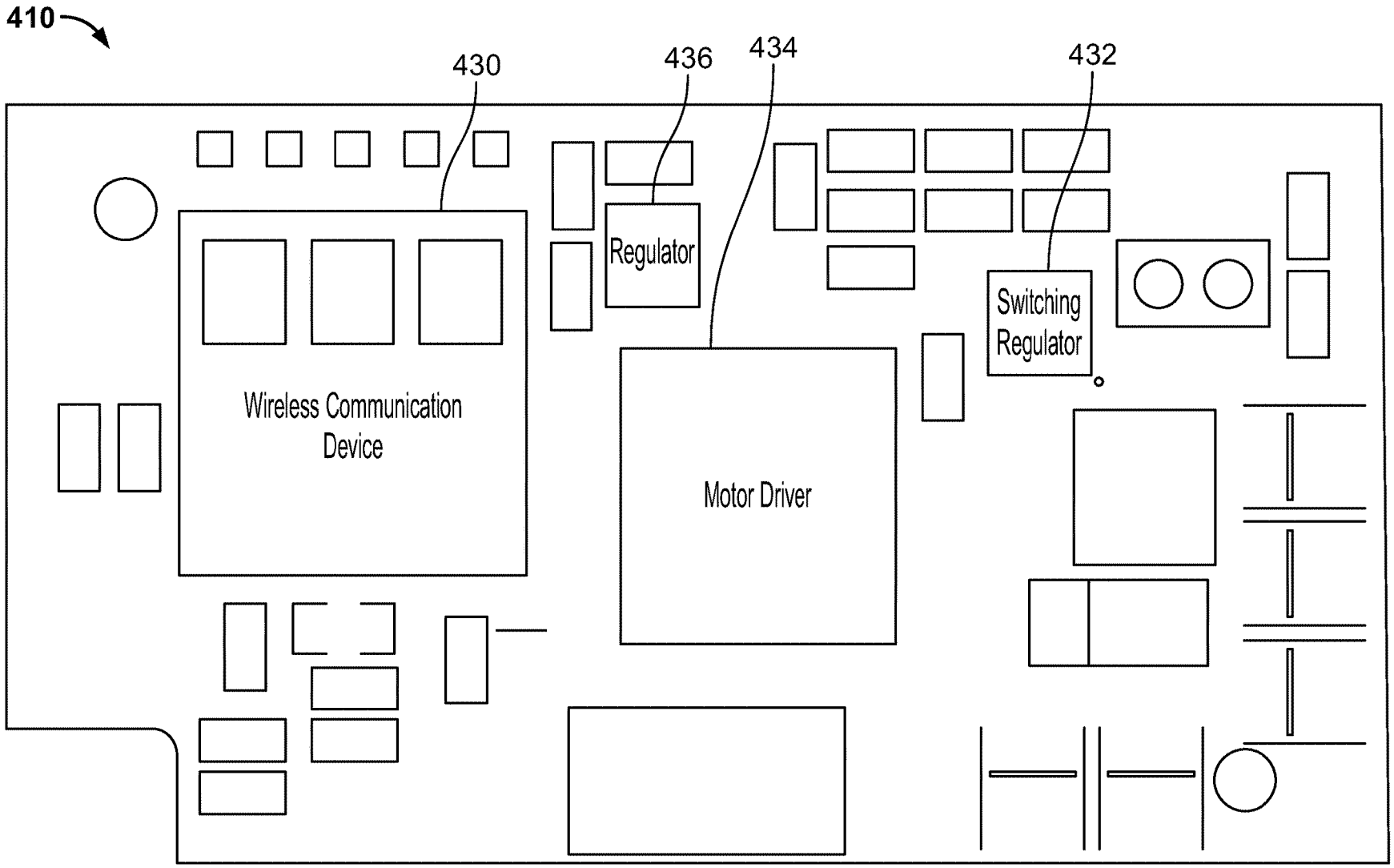
FIG. 26 is a top view of a control printed circuit board (PCB) that includes one or more controllers, drivers, memory, and other electrical components.

Referring now to FIG. 26, the control PCB 410 is shown. The control PCB 410 includes a plurality of components disposed thereon, including a wireless communication device 430, which may be a module that supports wireless communication, a first regulator 432, which may be a switching regulator, a motor driver 434, which may be a DC motor driver, and a second regulator 436, which may be a voltage regulator. A plurality of resistors, capacitors, and other electrical components are also disposed along the control PCB 410, but are not specifically referenced herein. The wireless communication device 430 supports Bluetooth® Low Energy (BLE) wireless communication or another type of short-range wireless communication. In a preferred embodiment, the wireless communication device 430 includes onboard crystal oscillators, chip antenna, and passive components. The wireless communication device 430 may support a number of peripheral function, e.g., ADC, timers, counters, PWM, and serial communication protocols, e.g., I2C, UART, SPI, through its programmable architecture. The wireless communication device 430 may include a processor, a flash memory, a timer, and additional components not specifically noted herein.

Still referring to FIG. 26, the motor driver 434 is also provided along the control PCB 410. The motor driver 434 may be a dual brushed DC motor driver that works with 3 V to 5 V logic levels, supports ultrasonic (up to 20 kHz) PWM, and features current feedback, under-voltage protection, over-current protection, and over-temperature protection. The motor driver 434 can supply up to or above 3 Amps of continuous current per channel to the motor 216, and supports ultrasonic (up to 20 kHz) pulse width modulation (PWM) of a motor output voltage, which helps to reduce audible switching sounds caused by PWM speed control.

Still referring to FIG. 26, the linear regulator 436 may also be provided. The linear regulator 436 may comprise a fixed output voltage low dropout linear regulator. The linear regulator 436 may include built-in output current-limiting. The switching regulator 432 is also included on the control PCB 410. The switching regulator 432 may be a monolithic nonsynchronous switching regulator with integrated 5-A, 24-V power switch. The switching regulator 432 regulates output voltage with current mode PWM control, and has an internal oscillator. The switching frequency of PWM may be set by an external resistor or by synchronizing to an external clock signal. The switching regulator 432 may include an internal 5-A, 24-V Low-Side MOSFET Switch, 2.9-V to 16-V Input Voltage Range a fixed-Frequency-Current-Mode PWM Control, and a frequency hat that is adjustable from about 100 kHz to about 1.2 MHz.

Referring again to FIG. 16, the microcontroller 326 is shown disposed along the flexible circuit 322. The microcontroller 326 enables and controls a capacitive, touch sensing user interface along the panel 32 of the housing 140. The microcontroller 326 may be able to support up to 16 capacitive sensing inputs, and allows for capacitive buttons, sliders, and/or proximity sensors to be electrically coupled thereto, some or all of which may be incorporated along the flexible circuit 322. The microcontroller 326 can include an analog sensing channel and delivers a signal-to-noise ratio (SNR) of greater than 100:1 to ensure touch accuracy even in noisy environments. The microcontroller 326 may be programmed to dynamically monitor and maintain optimal sensor performance in all environmental conditions. Advanced features, such as LED brightness control, proximity sensing, and system diagnostics, may be programmable. The microcontroller 326 may be operable to enable liquid-tolerant designs by eliminating false touches due to mist, water droplets, or streaming water.

Still referring to FIG. 16, a Hall effect IC or sensor 440 may be provided (which is shown disposed along the flexible circuit 322), which may be operable to detect a switch in a magnetic field adjacent the motor 216 from N to S or vice versa and maintain its detection result on the output until the next switch. Output is pulled low for S-pole fields and high for N-pole fields. The Hall effect sensor 440 may be operable to provide feedback regarding a direction of the motor 216. Additional sensors may be provided, and varying types of sensors may be provided along the flexible circuit 322 or along portions of the shoe 44. The Hall effect sensor 440 therefore may operate to detect rotation, position, open/closed configuration, current detection, and/or various other aspects of the motor 216. The Hall effect sensor 440 is electrically coupled with the microcontroller 326.

Figure 27:
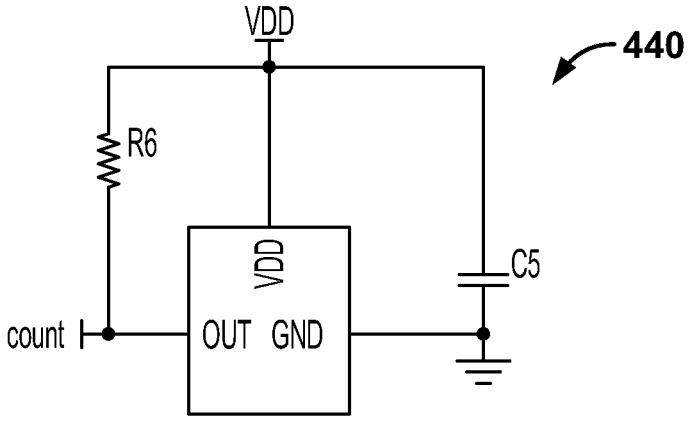
FIG. 27 is another electronic schematic depicting various electrical components of the automatic lacing system in accordance with the present disclosure.
Figure 28:
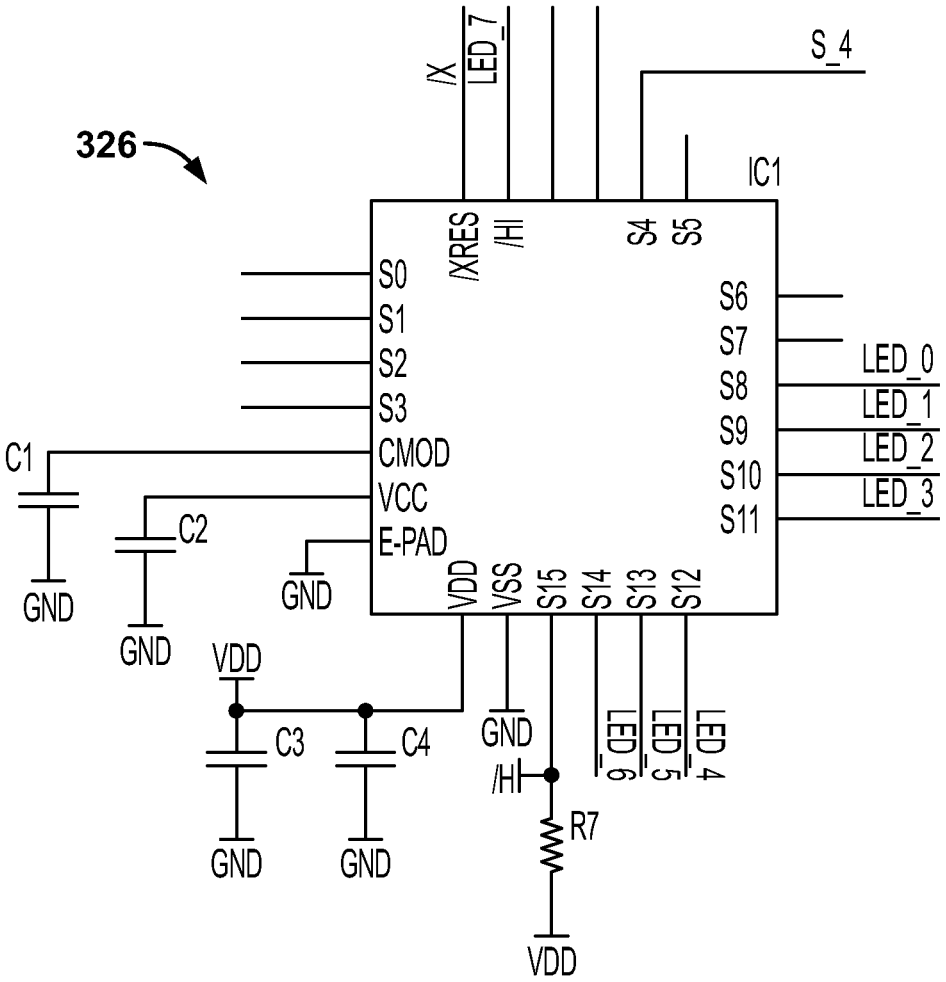
FIG. 28 is yet another electronic schematic depicting various electrical components of the automatic lacing system.
Figure 29:
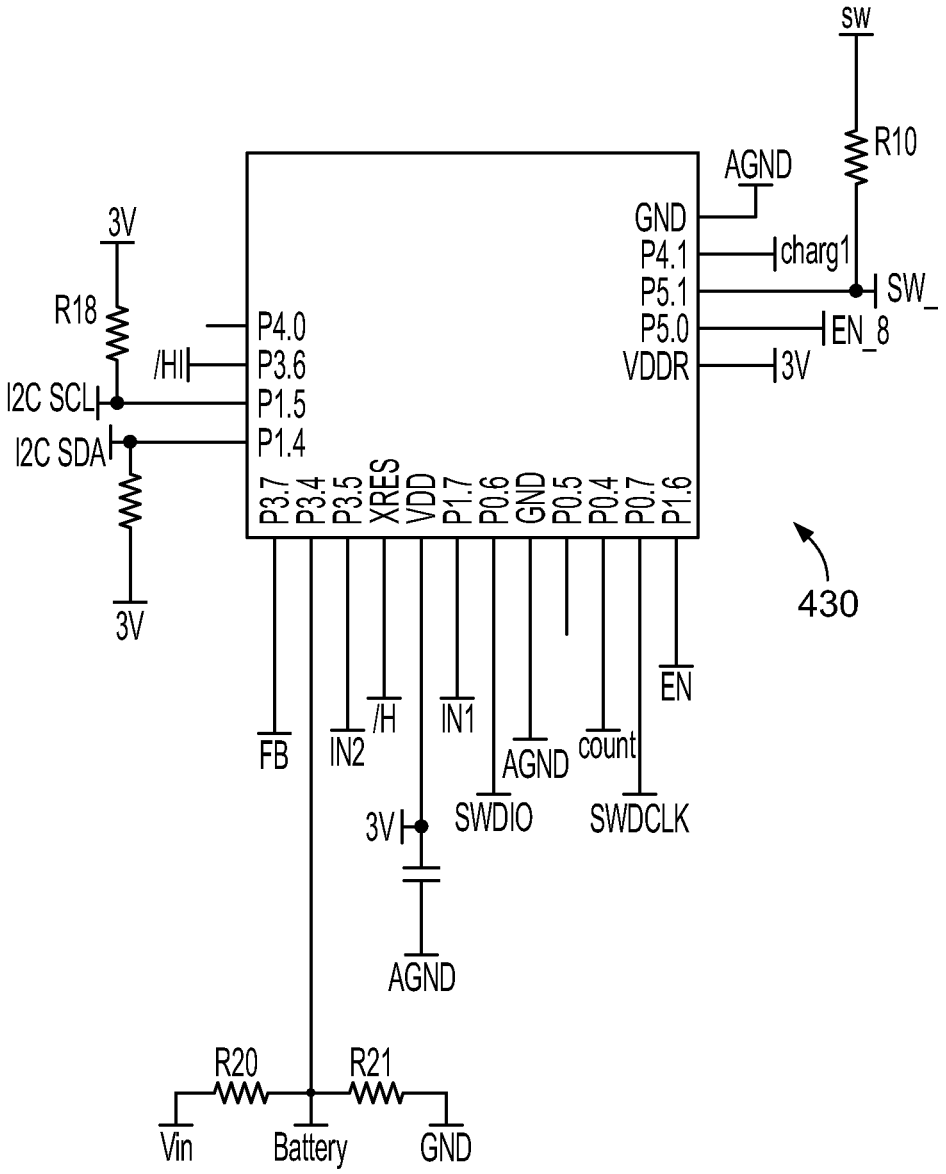
FIG. 29 is still another electronic schematic depicting various electrical components of the automatic lacing system.
Figure 30:
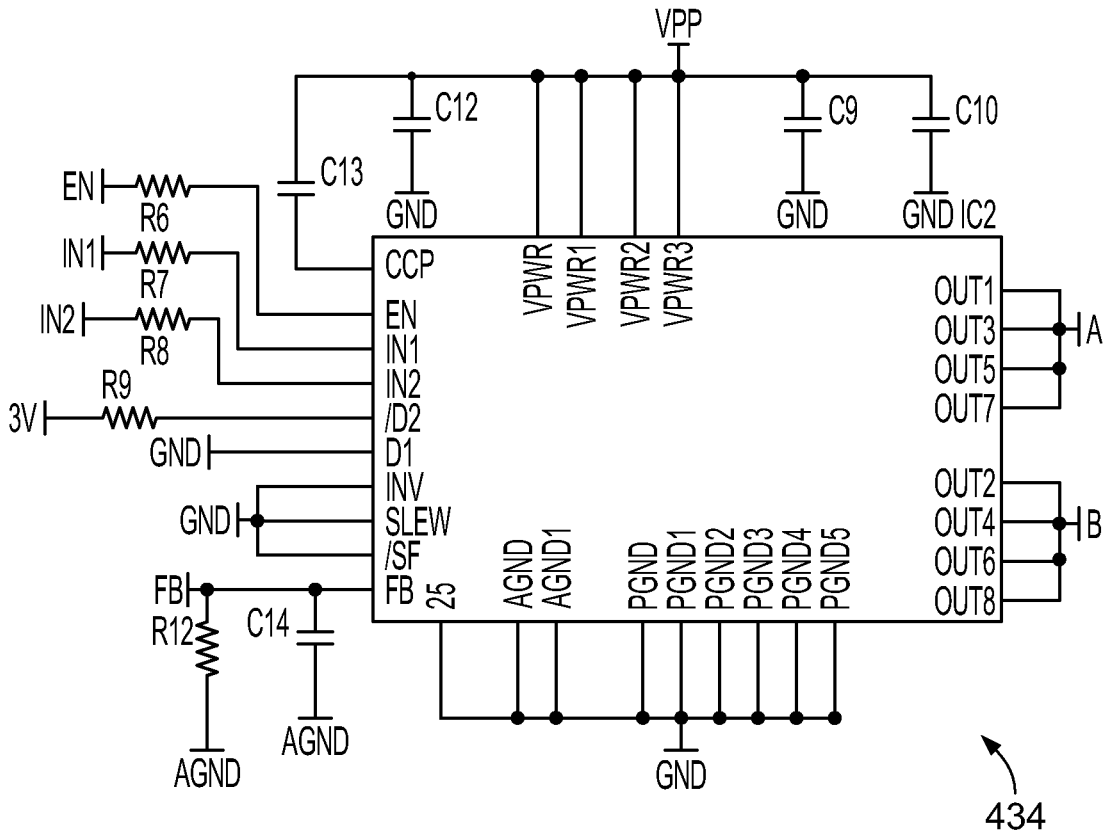
FIG. 30 is yet another electronic schematic depicting various electrical components of the automatic lacing system.
Figure 31:
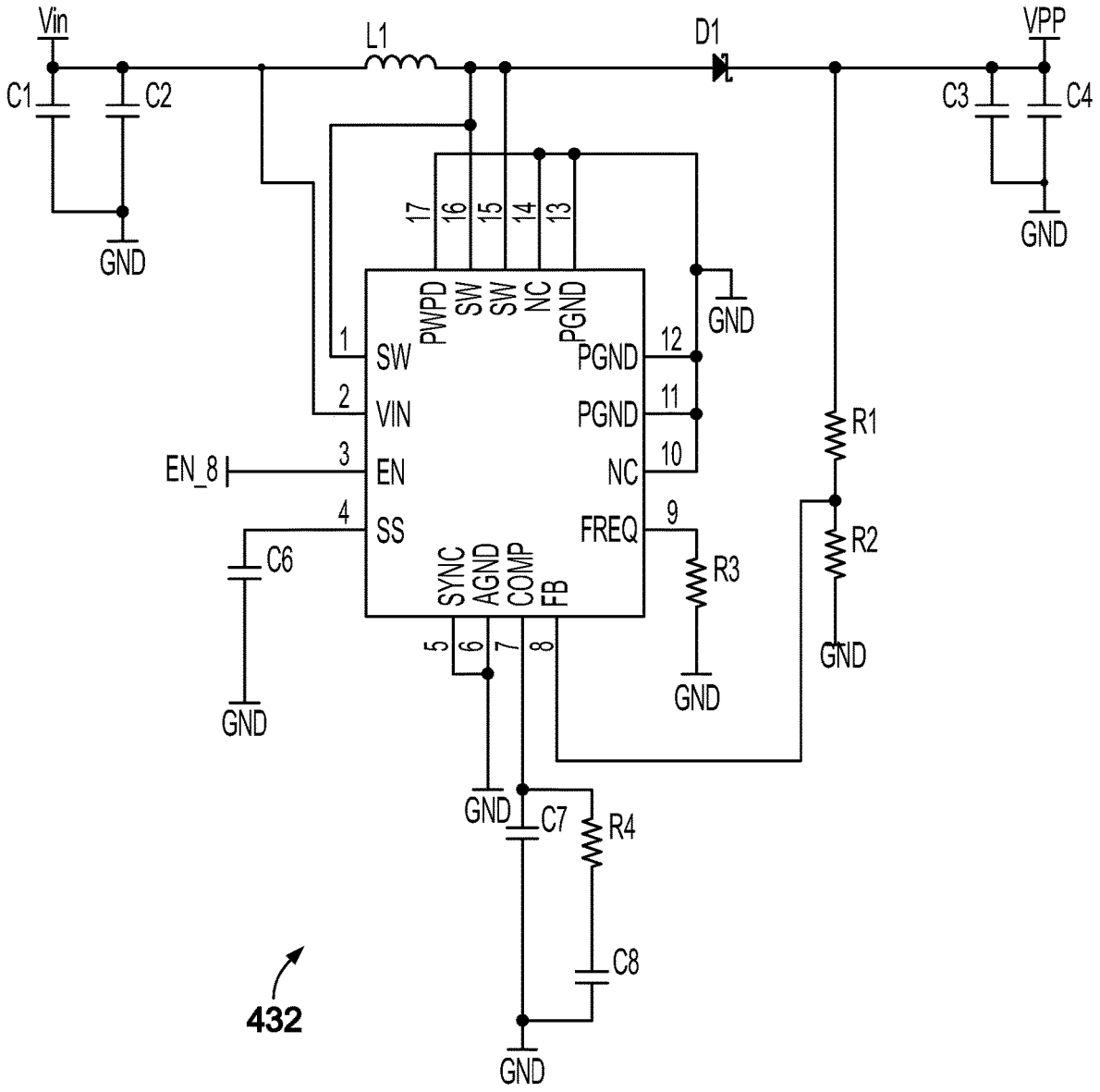
FIG. 31 is another electronic schematic depicting various electrical components of the automatic lacing system.
Figure 32:
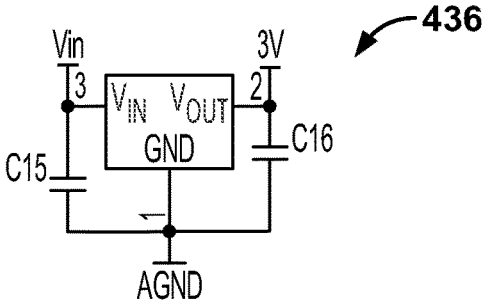
FIG. 32 is yet another electronic schematic depicting various electrical components of the automatic lacing system.

Referring now to FIGS. 27-34, electrical schematics for the electrical components as described above are shown in greater detail. Referring to FIG. 27, a schematic of the Hall effect sensor 440 is shown in greater detail. As noted above, the sensor 440 is intended to keep track of the number and/or direction of rotations of the motor 216. Referring to FIG. 28, a schematic of the microcontroller 326 is shown in detail. As noted above, the microcontroller 326 is connected to the LEDs 332, the swipe sensors 324, and the Hall effect sensor 440. The microcontroller 326 is also coupled with other electrical components that are disposed along the control PCB 410. FIG. 29 is an electrical schematic of the wireless communication module 430. FIG. 30 is an electrical schematic of the motor driver 434. FIG. 31 is an electrical schematic of the switching regulator 432. FIG. 32 is an electrical schematic of the regulator 436.

Figure 33:
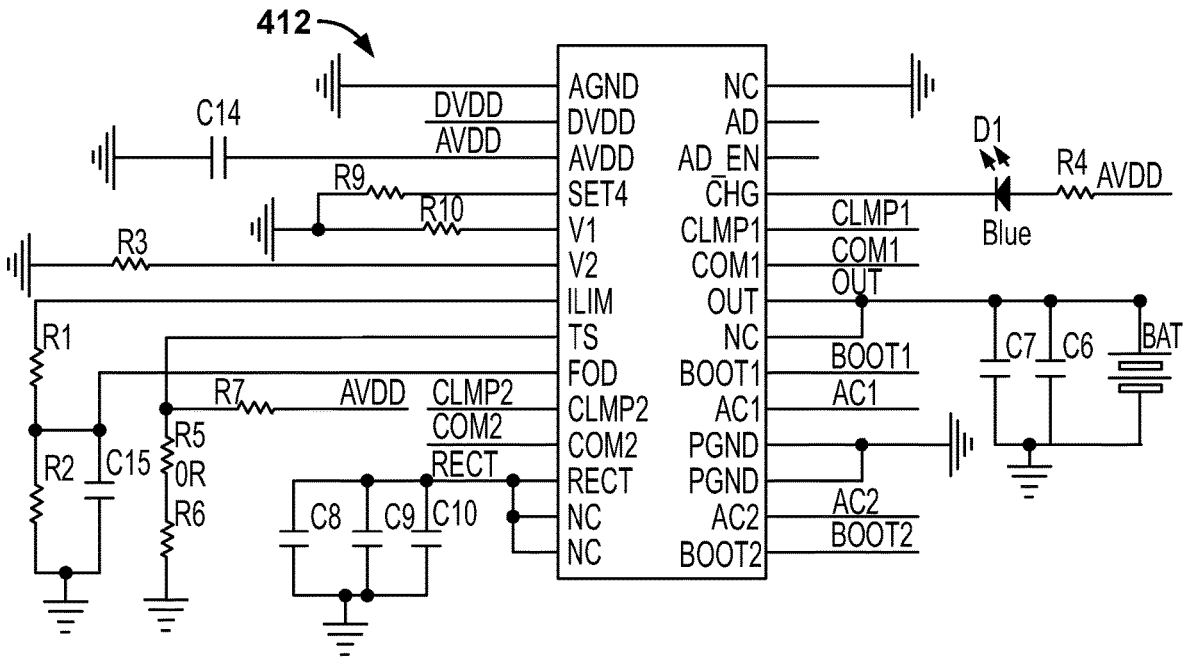
FIG. 33 is another electronic schematic depicting various electrical components of the automatic lacing system.
Figure 34:
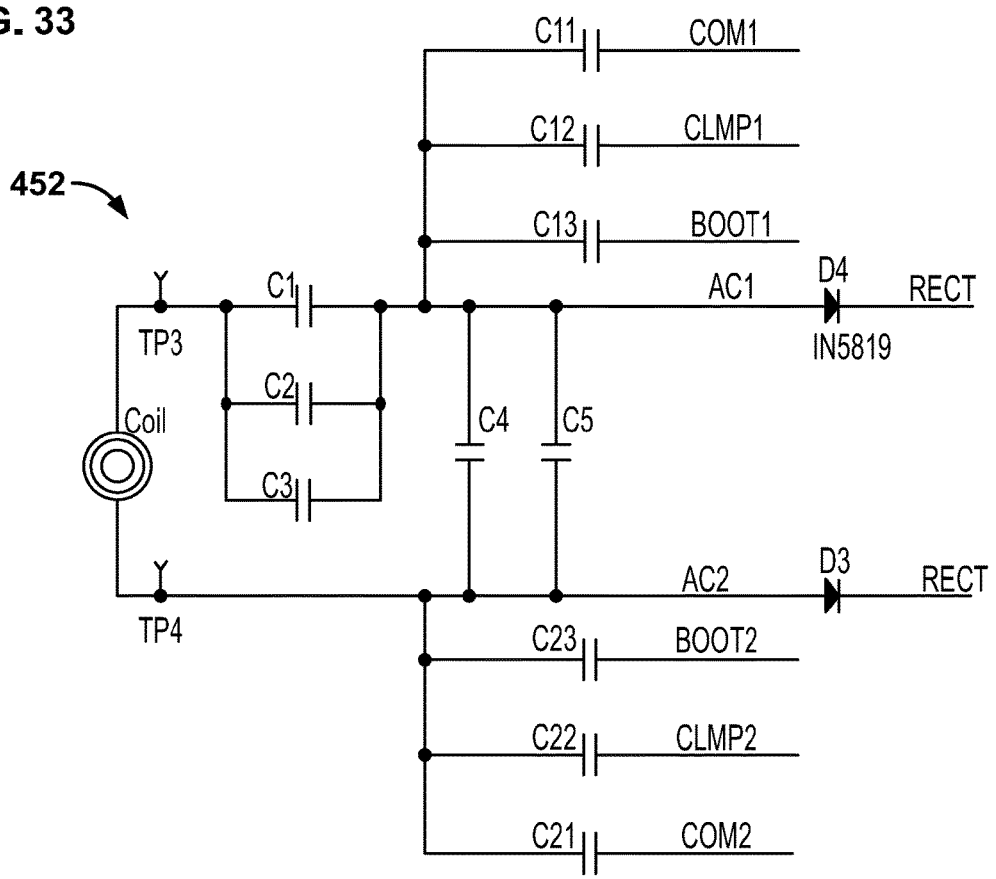
FIG. 34 is still another electronic schematic depicting various electrical components of the automatic lacing system.

Referring now to FIGS. 33 and 34, an electrical schematic of the charging PCB 412 and a charging module 452 are shown. The charging PCB 412 may be provided along the charging PCB 412, which may be housed within the battery case 400. The charging module 452 comprises a variety of capacitors, diodes, and rectifiers, and may have a number of alternative configurations. The charging module 452 is configured to allow for charging of the battery 340 when a user desires to charge the battery 340.

Figure 35:
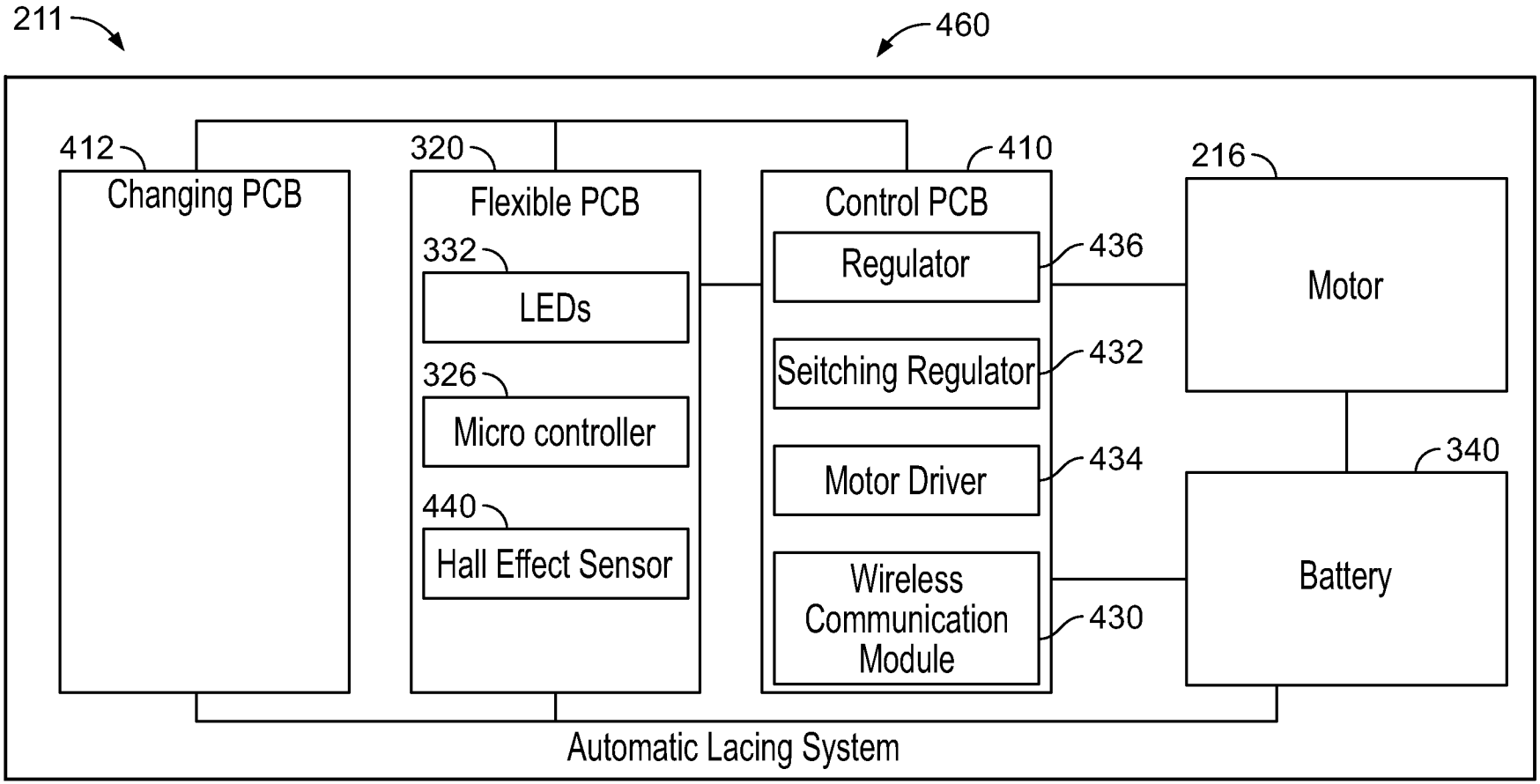
FIG. 35 is a block diagram of various electrical components of the automatic lacing system.

A block diagram 460 is illustrated in FIG. 35, the block diagram 460 including the various electrical components described above within the automatic lacing system 24. The automatic lacing system 24 broadly includes the control PCB 410, the motor 216, the flexible circuit 320, the battery 340, and the charging PCB 412. The plurality of LEDs 332, the microcontroller 326, and the Hall Effect sensor 440 are provided along the flexible circuit 322. The control PCB 410 includes the wireless communication module 430, the regulator 436, the switching regulator 432, and the motor driver 434. The motor 216 is in electrical communication with the control PCB 410. The flexible circuit 322 is also in electrical communication with the control PCB 410. The battery 340 is in electrical communication with all of the electrical components, however, the battery 340 may be directly coupled with the control PCB 410. Additional electrical components not specifically addressed herein may also be included along one of the control PCB 410 or the flexible circuit 322.

Figure 37:
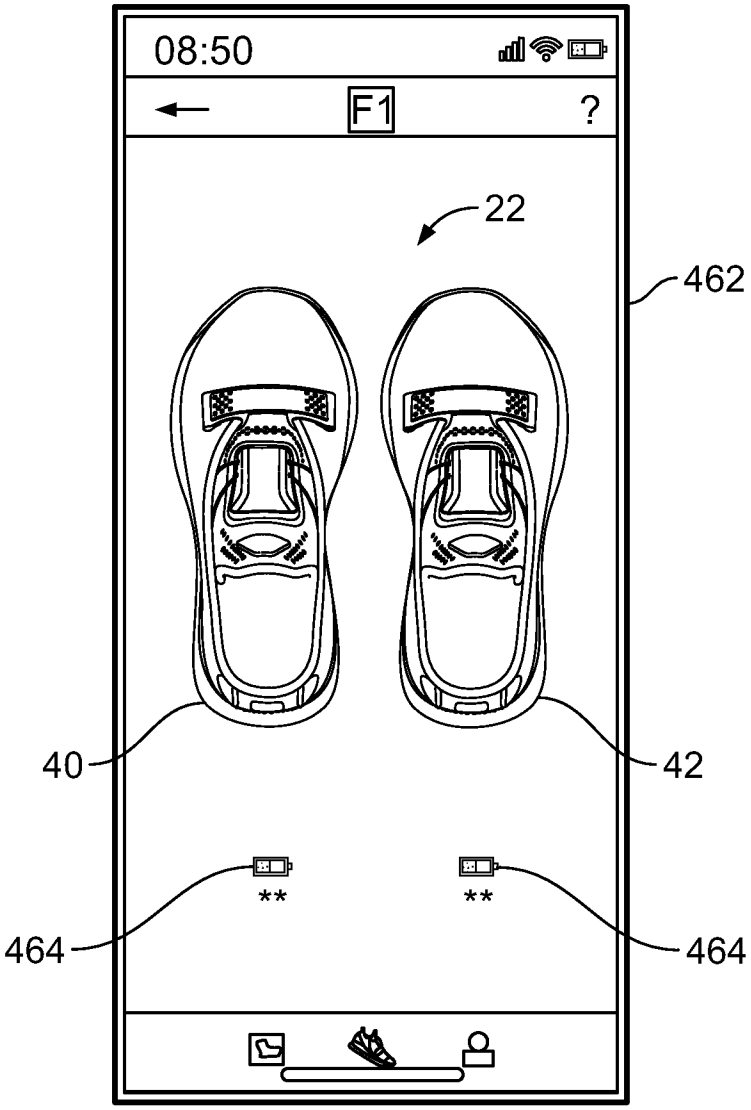
FIG. 37 is a view of a graphical user interface depicting a second display that allows a user to control the automatic lacing system of the present disclosure.
Figure 36:
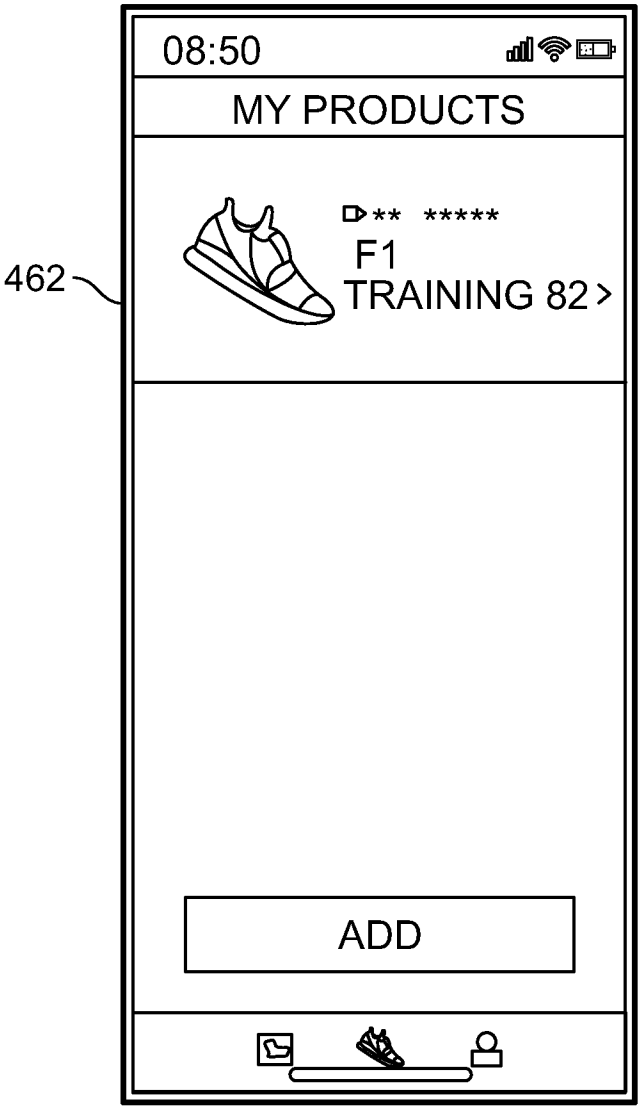
FIG. 36 is a view of a graphical user interface depicting a first display that allows a user to control the automatic lacing system of the present disclosure.

Referring to FIGS. 36-39, the automatic lacing system 24 can also be controlled using the wireless device 30, which can be paired with or connected to the lacing system 24 via Bluetooth® i.e., a type of short-range wireless communication, or another wireless signal. The figures provide exemplary screenshots of a display screen 462 of the wireless device 30, which has been paired, via Bluetooth®, i.e., a type of short range wireless communication, with the automatic lacing system 24. First, and referring to FIG. 36, the display screen 462 prompts a user to pair their wireless device 30 with a particular pair of shoes 22 to be adjusted via the electronic device. Subsequent to pairing, the user is brought to a screen as shown in FIG. 37. The user is provided shoe information 464, which in the present case, is an energy level of the batteries 340 within the left shoe 40 and the right shoe 42. The shoe information 464 is conveyed on the screen in the form of batteries having a certain level of charge. The shoe information may include other information, such as a tightness level, a temperature of the shoe(s), a configuration of the shoe(s), etc. The shoe information may also include additional aspects not specifically addressed herein.

Figure 38:
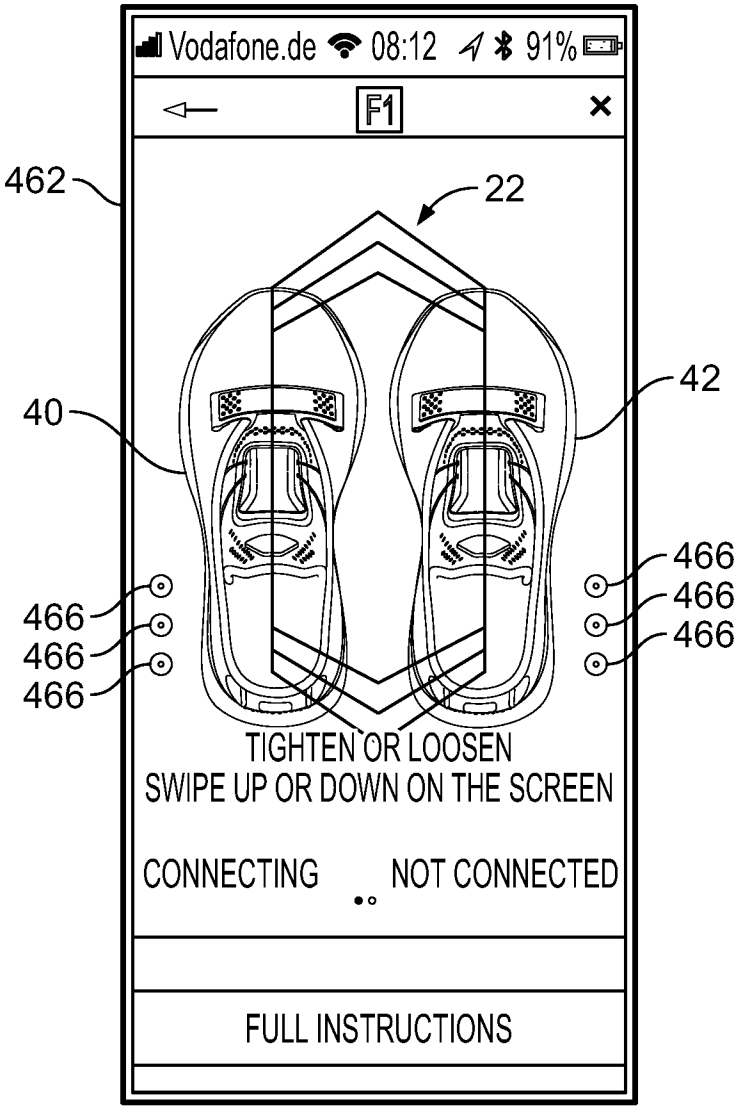
FIG. 38 is a view of a graphical user interface depicting a third display that allows a user to control the automatic lacing system of the present disclosure.

FIG. 38 illustrates the display screen 462 just before both of the shoes 22 have been paired with the wireless device 30. After selecting the pair of shoes 22, the wireless device 30 activates the LEDs 332 along the left shoe 40 or the right shoe 42 and may prompt the user to indicate whether the LEDs 332 have illuminated on both of the shoes 22. In some embodiments, the display screen may request information regarding the left shoe 40 or the right shoe 42, such as whether the LEDs 332 have illuminated on both of the shoes 22. In addition to the LEDs 332 along the actual pair of shoes 22, the wireless device 30 also provides level indicators 466 that are proximate to the shoes shown on the display screen 462, which indicate a tightness level or state of tightness of each of the shoes 22. Once the shoes 22 are paired or connected to the wireless device 30, the user can name or register the selected footwear, select the shoes 22 for manipulation of one or more settings of the shoes 22, or select another input along the display screen 462.

Figure 39:
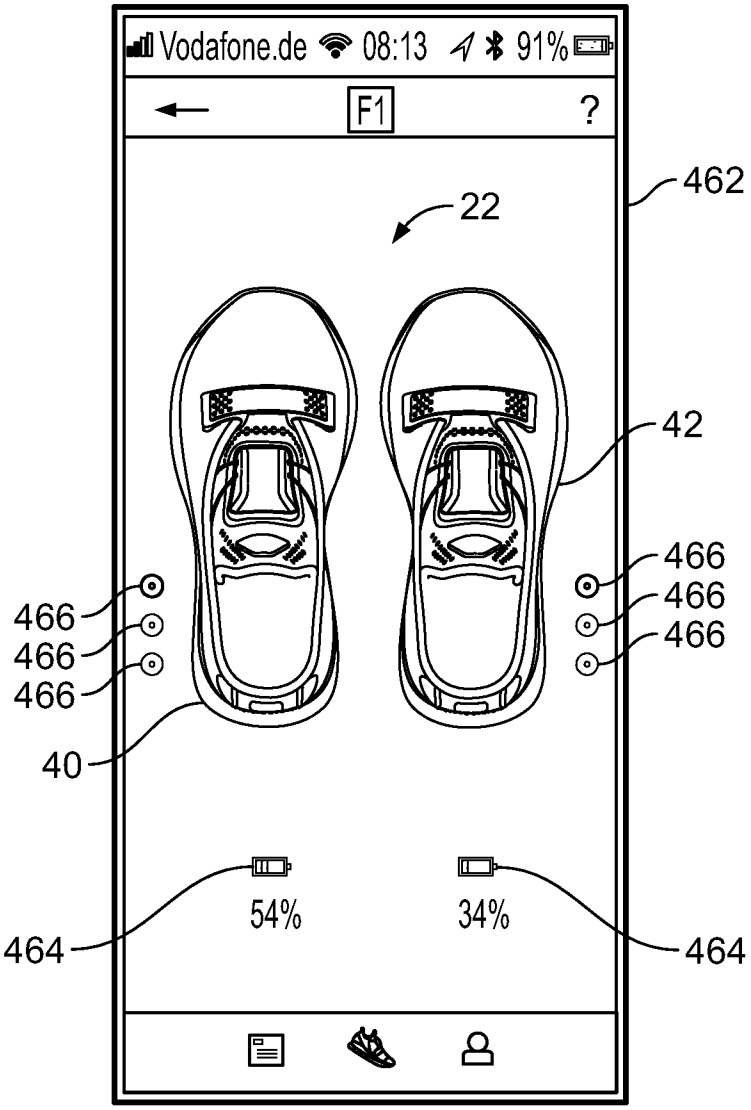
FIG. 39 is a view of a graphical user interface depicting a fourth display that allows a user to control the automatic lacing system of the present disclosure.

Once the shoes 22 are paired with the electronic device 30, which is depicted in FIG. 39, the user can loosen or tighten the shoes 22 as a pair by swiping up or swiping down on the left shoe 40, the right shoe 42, or the pair of shoes 22 shown on the display screen 462. In order to tighten or loosen the shoes 22 a user first pushes or taps the left shoe 40, the right shoe 42, or the pair of shoes 22. Next, a user swipes up or swipes down on the left shoe 40, the right shoe 42, or the pair of shoes 22 on the display screen 462 to loosen or tighten the shoes 22. Similar to how a user would interact with the top surface of the panel 32 as discussed above, a user may also tap a certain region of the selected shoe 44.

All of the commands as discussed above with respect to the first method of manipulation, i.e., physical adjustment, may also be implemented through interaction with the display screen 462 of the electronic device 30. To that end, the automatic lacing system 24 can have predetermined levels of tightness, which includes a pre-set open configuration, wherein the laces 142, 144 are loosened to a predetermined tightness, and a pre-set closed configuration, wherein the laces 142, 144 are tightened to a predetermined tightness. In practice, a user may be able to swipe down on the pair of shoes 22 along the display screen 462 to tighten the laces 142, 144 to the predetermined tightness of the pre-set closed configuration, or swipe up on the display screen 462 to loosen the laces 142, 144 to the predetermined tightness of the pre-set open state. Further, a user can adjust the predetermined tightness of the laces of the pre-set open and closed states by tapping a toe end of the pair of shoes 22 along the display screen 462 to decrease the tightness of either the pre-set closed configuration or the pre-set open configuration, or by tapping a heel end of the pair of shoes 22 along the display screen 462 to increase the tightness of either the pre-set closed configuration or the pre-set open configuration.

The swipe commands of FIGS. 18A-18M are also applicable to the display screen 462, and will now be discussed in that context. Referring to FIGS. 18A-M and 39, to effectuate the closing swipe command 350, a user touches the display screen 462 and swipes down. The open swipe command 352 can be effectuated by a user touching the display screen 462 and swiping up. The opening swipe command 352 may fully loosen the shoes 22. The adjust/loosen command 354 can be effectuated by a user touching the display screen 462 at a heel end of the shoes 22 on the display screen 462. The adjust/loosen command 354 incrementally loosens the laces 142, 144 of the automatic lacing system 24. The adjust/tighten command 356 can be effectuated by a user touching the display screen 462 at a toe end of the shoes 22 on the display screen 462. The adjust/tighten command 356 incrementally tightens the laces of the automatic lacing system 24.

The reset command 358 can be effectuated by a user touching or pressing the display screen 462 for 10 seconds. The reset command 358 may return the automatic lacing system 24 to factory settings, or another type of null setting. The connect/pair command 360 can be effectuated by a user depressing the display screen 462 for one to two seconds. The connect/pair command 360 may be used to connect or pair the shoes 22 with the electronic device 30 via Bluetooth®, i.e., a type of short-range wireless communication. The wake up command 362 can be effectuated by a user touching the display screen 462 along the pair of shoes 22. The wake up command 362 may turn on the automatic lacing system 24.

The various illumination configurations of the LEDs 332 can also be manipulated through the electronic device 30. A user may provide one or more inputs to the electronic device 30 to allow the shoes 22 to enter the open configuration 364, the first closed configuration 366, the second closed configuration 368, and/or the third closed configuration 370, respectively. Further, the configurations and states may be displayed to a user via the display screen 462. For example, the low battery state 372 or the charging state 374 may be displayed on the electronic device 30. While the above configurations and states have been described with respect to varying illumination configurations of the LEDs 332, alternative variations are contemplated along the display screen 462 of the electronic device 30. For example, in some configurations or states, the LEDs 332 may flash, turn a different color, blink, or blink one at a time to indicate alternative states or configurations.

In some embodiments, additional controls are provided along the display screen 462, such as one or more buttons that allow a user to fully tighten the selected shoes, fully loosen the selected shoes, incrementally tighten the selected shoes, incrementally loosen the shoes, select a particular color that will be displayed by the LEDs 332, and/or select a desired or preferred tightness of the selected shoe. In some embodiments, the user may be able to set one or more timers along the display screen 462 that may automatically loosen or tighten the selected shoe to a desired degree at a certain time.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out same.

The exclusive rights to all modifications which come within the scope of the appended claims are reserved.

We claim:

1. A lacing system for an article of footwear defining a forefoot region, a midfoot region, and a heel region, the lacing system comprising:

a sole structure;

an upper attached to the sole structure, the upper comprising a lateral side, a medial side, and a tongue;

a housing assembly that is disposed along the tongue and entirely within the midfoot region, the housing assembly including a first housing, a second housing, and a cover; and a lace tightening assembly enclosed entirely within the housing assembly, the lace tightening assembly being disposed at least partially within the second housing and configured to draw at least one lace into the housing assembly, wherein the cover is disposed over the second housing and is coupled with the first housing, wherein the at least one lace includes a first lace that extends from the housing assembly through a first aperture and a second aperture that are each disposed on a lateral side of the housing assembly, and the first lace further extends between the cover and the second housing, and wherein the first lace is drawn into the housing when a tightened configuration of the lace tightening assembly is initiated by a user.

2. The lacing system of claim 1, wherein the lace tightening assembly includes an electronics assembly, which includes a sensor that is responsive to tactile interaction with the housing by a user.

3. The lacing system of claim 2, wherein the electronics assembly further includes a plurality of light sources that project light through a portion of the housing.

4. The lacing system of claim 3, wherein the plurality of light sources display a first configuration based on a first tactile signal, and wherein the plurality of light sources display a second configuration based on a second tactile signal that is different than the first tactile signal.

5. The lacing system of claim 4, wherein the first tactile signal includes only a first swipe or a tap by a user.

6. The lacing system of claim 5, wherein the second tactile signal includes a second swipe or tap by a user.

7. The lacing system of claim 2, wherein the electronics assembly includes a motor and when the motor is activated, the first lace is spooled about a longitudinal axis and into the first housing.

8. The lacing system of claim 2, wherein a battery unit is located within the sole structure and is connected to the electronics assembly with a wire.

9. The lacing system of claim 8, wherein the battery unit includes a battery that is electrically coupled with a charging coil, and wherein the battery is charged by induction when the charging coil is inductively coupled with an external charger.

10. The lacing system of claim 1, wherein the first lace is pulled into the housing and is drawn about a longitudinal axis when the tightened configuration is initiated by the user.

11. A lacing system for an article of footwear defining a forefoot region, a midfoot region, and a heel region, the lacing system comprising:

a sole structure;

an upper attached to the sole structure, the upper comprising a lateral side, a medial side, and a tongue;

a housing assembly that is disposed along the tongue and entirely within the midfoot region, the housing assembly including a first housing, a second housing, and a cover; and a lace tightening assembly enclosed entirely within the housing, the lace tightening assembly being disposed at least partially within the second housing and configured to draw at least one lace into the housing, wherein the at least one lace includes a first lace that extends from the housing assembly through a first aperture and a second aperture that are each disposed on a lateral side of the housing assembly, the first lace being disposed between the cover and the second housing, and wherein the first lace is pulled into the housing assembly and is drawn about a longitudinal axis when a user tightens the lace tightening assembly.

12. The lacing system of claim 11, wherein the lace tightening assembly includes an electronics assembly, which includes a motor, and wherein the first lace is drawn into the housing when the motor is activated by the user.

13. The lacing system of claim 12, wherein the electronics assembly further includes a plurality of light sources that project light through a portion of the housing assembly.

14. The lacing system of claim 13, wherein the plurality of light sources display a first configuration based on a first tactile signal, and wherein the plurality of light sources display a second configuration based on a second tactile signal that is different than the first tactile signal.

15. The lacing system of claim 11, wherein the lace tightening assembly includes an electronics assembly, which is provided along a flexible circuit that is disposed within the housing assembly.

16. The lacing system of claim 13, wherein the electronics assembly is configured to provide light-based feedback to a user via the plurality of light sources.

17. A lacing system for an article of footwear defining a forefoot region, a midfoot region, and a heel region, the lacing system comprising:

a sole structure;

an upper attached to the sole structure, the upper comprising a lateral side, a medial side, and a tongue;

a housing assembly that is disposed along the tongue and entirely within the midfoot region, the housing assembly including a first housing, a second housing, and a cover; and an electronics assembly enclosed entirely within the housing assembly, the electronics assembly including at least a motor and a gear assembly, wherein the cover is disposed over the second housing and is coupled with the first housing, wherein a first lace extends from the housing assembly through a first aperture and a second aperture that are each disposed on a lateral side of the housing assembly, and the first lace further extends between the cover and the second housing, wherein the motor includes a motor shaft that defines a first axis, and when the motor is activated, the first lace is spooled about a second axis and into the housing, and wherein the first axis is offset with respect to the second axis.

18. The lacing system of claim 17, wherein the first axis and the second axis are orthogonally offset.

19. The lacing system of claim 17, wherein the electronics assembly further includes a plurality of light sources that project light through a portion of the housing.

20. The lacing system of claim 19, wherein the electronics assembly is configured to provide light-based feedback to a user via the plurality of light sources.

* * * * *